US007583261B2

(12) United States Patent
Shirasaki et al.

(10) Patent No.: US 7,583,261 B2
(45) Date of Patent: Sep. 1, 2009

(54) DISPLAY DRIVE DEVICE AND DISPLAY DEVICE

(75) Inventors: Tomoyuki Shirasaki, Higashiyamato (JP); Jun Ogura, Fussa (JP)

(73) Assignee: Casio Computer Co., Ltd., Tokyo (JP)

( * ) Notice: Subject to any disclaimer, the term of this patent is extended or adjusted under 35 U.S.C. 154(b) by 102 days.

(21) Appl. No.: 11/940,460

(22) Filed: Nov. 15, 2007

(65) Prior Publication Data

US 2008/0111812 A1 May 15, 2008

(30) Foreign Application Priority Data

Nov. 15, 2006 (JP) ..... 2006-309150

(51) Int. Cl.
*G09G 5/00* (2006.01)

(52) U.S. Cl. ..... 345/212; 345/76; 345/78; 345/89; 345/95; 345/210; 345/690

(58) Field of Classification Search ..... 345/76–84, 345/89–95, 204–215, 690
See application file for complete search history.

(56) References Cited

U.S. PATENT DOCUMENTS

| | | | |
|---|---|---|---|
| 2002/0089357 | A1 | 7/2002 | Pae et al. |
| 2006/0139261 | A1 | 6/2006 | Choi et al. |
| 2006/0158402 | A1 | 7/2006 | Nathan et al. |
| 2006/0221015 | A1 | 10/2006 | Shirasaki et al. |
| 2007/0080905 | A1 * | 4/2007 | Takahara ..... 345/76 |
| 2008/0238953 | A1 * | 10/2008 | Ogura ..... 345/697 |

FOREIGN PATENT DOCUMENTS

| | | | |
|---|---|---|---|
| EP | 1 221 686 | A2 | 7/2002 |
| EP | 1 675 093 | A1 | 6/2006 |
| WO | WO 2006/063448 | A1 | 6/2006 |
| WO | WO 2006/104259 | A1 | 10/2006 |

OTHER PUBLICATIONS

International Search Report and the Written Opinion of the International Searching Authority dated Mar. 3, 2008 for a counterpart International Application.

* cited by examiner

*Primary Examiner*—Vijay Shankar
(74) *Attorney, Agent, or Firm*—Frishauf, Holtz, Goodman & Chick, P.C.

(57) ABSTRACT

A predetermined voltage is supplied to a voltage supply line connected in common to respective current paths of driving elements of each of a plurality of display pixels. Adjustment voltages based on a predetermined unit voltage are sequentially applied to a plurality of data lines connected to the display pixels. Specific values corresponding to element characteristics of the respective driving elements of the display pixels are sequentially detected based on a value of a detection value that is a potential difference between a data line and the voltage supply line or a value of a current flowing into the voltage supply line. Correction gradation voltages are generated for each pixel by correcting a gradation voltage having a voltage value corresponding to display data for the pixel based on the specific value for the pixel, so as to compensate for characteristic fluctuation of the driving element of the pixel.

28 Claims, 25 Drawing Sheets

DISPLAY DRIVE DEVICE AND DISPLAY DEVICE

CROSS-REFERENCE TO RELATED APPLICATIONS

The present application is based upon and claims the benefit of priority under 35 USC 119 of Japanese patent application No. 2006-309150 filed on Nov. 15, 2006, the entire contents of which are incorporated herein by reference.

BACKGROUND OF THE INVENTION

1. Field of the Invention

The present invention relates generally to a display drive device and a method for driving the same, as well as a display device and a method for driving the same, and more particularly to a display drive device for driving a plurality of display pixels having light emitting elements that emit light when supplied with a current, a display device including the display drive device and methods for driving the display drive device and the display device.

2. Description of the Related Art

In recent years, in an effort to replace a liquid crystal display device, research and development efforts have been actively made to develop a light emitting element type display device (light emitting device type display) including a display panel on which organic electroluminescence elements (organic EL elements), or inorganic electroluminescence elements (inorganic EL elements), or current-driven light emitting elements such as a light emitting diode (LED), are arranged in a matrix (or matrix shape).

In particular, a light emitting element type display using an active matrix driving system has an extremely advantageous feature in that, in comparison with known liquid crystal display devices, the display response speed is high and the viewing angle dependency is small, making it possible to achieve high image quality, in particular, high luminance/high contrast and high resolution. Further, it is not necessary to provide a backlight or a light guiding plate (which are necessary for a liquid crystal display device), thus making it possible to obtain a display having a small thickness and light weight. Therefore, application of this type of display to a variety of electronic devices is expected in the future.

This type of light emitting element display is configured such that a pixel drive circuit is provided for each display pixel. The circuit includes a current control thin film transistor (TFT) in which a voltage signal corresponding to image data is applied to a gate to supply a current to an organic EL element, and a switching thin film transistor that carries out a switching operation for supplying the voltage signal that corresponds to the image data to the gate of the current control thin film transistor. Gradation control of display pixels in such a display includes supplying each of the display pixels with a gradation voltage having a voltage value that corresponds to display data, holding in the pixel drive circuit a voltage component that corresponds to a current flowing in response to the supplied gradation voltage, and supplying a driving current to a light emitting element, based on the held voltage component, thereby controlling light emitting luminance.

However, in the current control thin film transistor, a threshold value may vary with time (as time elapses). In this case, in a system of supplying the gradation voltage to display pixels to effect gradation control as described above, if there is a threshold value fluctuation over time, then even if the same gradation voltage is supplied, a value of a driving current flowing into a light emitting element fluctuates.

SUMMARY OF THE INVENTION

The present invention has an advantage in that, in a display drive device for driving display pixels provided with a light emitting element and in a display device provided with the display drive device, a reasonable display image quality can be provided at a luminance gradation that corresponds to display data over a long period of time by compensating for characteristic fluctuation of driving elements of the display pixels.

According to one aspect of the present invention, a display drive device is provided for driving a plurality of display pixels, each of which includes a light emitting element and a driving element that supplies a current flowing into a current path thereof to the light emitting element.

The display drive device includes a specific value detecting section which, in a state in which a predetermined voltage is supplied to a voltage supply line connected in common to the respective current paths of the driving elements of a plurality of the display pixels connected to the voltage supply line, detects for at least one of the plurality of display pixels connected to the voltage supply line a specific value corresponding to element characteristics of the driving element of the display pixel by: (i) generating an adjustment voltage based on a predetermined unit voltage and applying the generated adjustment voltage to the display pixel via a data line connected to the display pixel, (ii) detecting, as a detection value, one of a value of a potential difference between the data line and the voltage supply line, and a value of a current flowing in the current path of the driving element of the display pixel via the voltage supply line, and (iii) detecting the specific value of the display pixel based on the detection value.

The display drive device also includes a voltage adjusting circuit which, for each of the display pixels, generates a correction gradation voltage by correcting, based on the specific value detected for the display pixel, a gradation voltage for the display pixel which has a voltage value for causing the light emitting element of the display pixel to emit light at a luminance gradation corresponding to display data, and supplies the generated correction gradation voltage to the display pixel via the data line connected to the display pixel.

According to another aspect of the present invention, a display device for displaying image information corresponding to display data is provided.

The display device includes a display panel which includes: (i) a plurality of selection scan lines arranged in rows and a plurality of data lines arranged in columns; (ii) a plurality of display pixels arranged in a matrix shape, each of the display pixels being arranged in a vicinity of a point at which one of the plurality of selection scan lines crosses one of the plurality of data lines, and each of the display pixels including a light emitting element and a driving element that supplies a current flowing into a current path thereof to the light emitting element; and (iii) a voltage supply line connected in common to the respective current paths of the driving elements of a predetermined number of the plurality of display pixels. The display device also includes a voltage source which supplies a predetermined voltage to the voltage supply line, and a selection drive circuit which applies a selection signal to the selection scan lines that correspond to rows of the display pixels that are connected to the voltage supply line, so as to set the rows of the display pixels to a selected state.

Moreover, the display device includes a specific value detecting section which, for any row that is selected by the selection signal when the predetermined voltage is applied from the voltage source to the voltage supply line, detects for at least one of the plurality of display pixels in the row a specific value corresponding to element characteristics of the driving element of the display pixel by: (i) generating an adjustment voltage based on a predetermined unit voltage and applying the generated adjustment voltage to the display pixel via one of the plurality of data lines connected thereto; (ii) detecting, as a detection value, one of a value of a potential difference between the data line and the voltage supply line, and a value of a current flowing into the current path of the driving element of the display pixel via the voltage supply line; and (iii) detecting the specific value for the display pixel based on the detection value; and Still further, the display device includes a voltage adjusting circuit which generates a correction gradation voltage by correcting, based on the specific value detected for the display pixel, a gradation voltage for the display pixel which has a voltage value for causing the light emitting element of the display pixel to emit light at a luminance gradation corresponding to display data, and supplies the generated correction gradation voltage to the display pixel via the data line connected to the display pixel.

According to a further aspect of the present invention, a method is provided for driving a display drive device for driving a plurality of display pixels, each of which includes a light emitting element and a driving element that supplies a current flowing to a current path thereof to the light emitting element.

The method includes supplying a predetermined voltage to a voltage supply line connected in common to the respective current paths of the driving elements of a plurality of the display pixels.

Moreover, a process is performed to detect a specific value corresponding to element characteristics of the driving element of at least one of the display pixels connected to the voltage supply line sequentially, wherein the process includes: generating an adjustment voltage based on a predetermined unit voltage; applying the generated voltage to the display pixel via a data line connected to the display pixel; and detecting the specific value for the display pixel, based on a detection value which is one of a value of a potential difference between the data line and the voltage supply line and a value of a current flowing into the current path of the driving element of the display pixel via the voltage supply line.

Still further, the method includes: generating a gradation voltage having a voltage value for causing the light emitting element of the display pixel to emit light at a luminance gradation corresponding to display data; generating a correction gradation voltage by correcting the gradation voltage based on the specific value detected for the display pixel; and supplying the generated correction gradation voltage via the data line connected to the display pixel.

According to a still further aspect of the present invention, a method is provided for driving a display device for displaying image information corresponding to display data, wherein the display device includes a display panel including: (i) a plurality of selection scan lines arranged in rows and a plurality of data lines arranged in columns; (ii) a plurality of display pixels arranged in a matrix shape, each of the display pixels being arranged in a vicinity of a point at which one of the plurality of selection scan lines crosses one of the plurality of data lines, and each of the display pixels including is a light emitting element and a driving element that supplies a current flowing into a current path thereof to the light emitting element; and (iii) a voltage supply line connected in common to the respective current paths of the driving elements of a predetermined number of the display pixels of the plurality of display pixels.

The method includes supplying a predetermined voltage to the voltage supply line, and applying a selection signal to one of the selection scan lines that correspond to rows of the display pixels that are connected to the voltage supply line, so as to set the row of the display pixels corresponding to said one of the selection scan lines to a selected state.

Moreover, the method includes performing a process when the row is selected by the selection signal to detect a specific value corresponding to element characteristics of the driving element of at least one of the display pixels in the row, wherein the process includes: generating an adjustment voltage based on a predetermined voltage; applying the generated voltage to the display pixel via one of the plurality of data lines connected thereto; and detecting the specific value for the display pixel, based on a detection value which is one of a value of a potential difference between the data line and the voltage supply line and a value of a current flowing in the current path of the driving element of the display pixel via the voltage supply line.

Still further, the method includes: generating a gradation voltage having a voltage value for causing the light emitting element of the display pixel to emit light at a luminance gradation corresponding to display data; generating a correction gradation voltage by correcting the gradation voltage based on the specific value detected for the display pixel; and supplying the generated correction gradation voltage to the data line connected to the display pixel.

DETAILED DESCRIPTION OF THE PREFERRED EMBODIMENTS

Hereinafter, a display drive device and a method for driving the device, and a display device and a method of driving the device, according to the present invention, will be described in detail with reference to embodiments shown in the accompanying drawings.

<Constituent Elements of Display Pixels>

First, constituent elements of display pixels and a control operation of the constituent elements in a display device according to the present invention will be described with reference to the accompanying drawings. In the description below, an organic EL element is used as the current-driven light emitting element of each of the display pixels.

Figure 1:
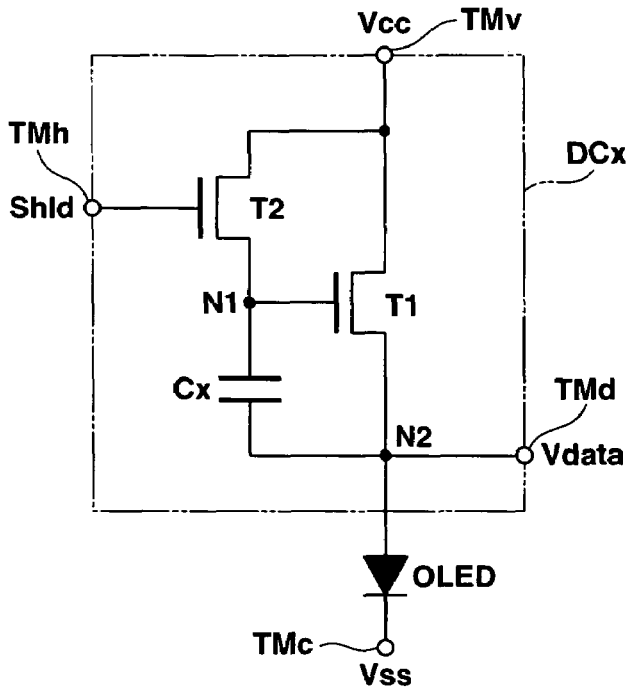
FIG. 1 is an equivalent circuit diagram showing constituent elements of display pixels of a display device according to the present invention.

As shown in FIG. 1, display pixels applied to the display device according to the present invention have a circuit construction including a pixel circuit DCx (equivalent to the pixel drive circuit DC described below), and an organic EL element OLED serving as a current-driven light emitting element. The pixel circuit DCx includes a driving transistor T1 (first switching means), a holding transistor T2 (second switching means) and a capacitor Cx (voltage holding element). The driving transistor T1 has a drain terminal connected to a power terminal TMv, a source terminal connected to a contact point N2 to which power voltage Vcc is applied, and a gate terminal connected to a contact point N1. The holding transistor T2 (second switching means) has a drain terminal connected to the power terminal TMv (drain terminal of the driving transistor T1), a source terminal connected to the contact point N1, and a gate terminal connected to a control terminal TMh. The capacitor Cx (voltage holding element) is connected between gate and source terminals of the driving transistor T1 (that is, between the contact point N1 and the contact point N2). In addition, in the organic EL element OLED, the contact point N2 is connected to an anode terminal, and a predetermined voltage Vss is applied to a cathode terminal TMc.

In a control operation of each such display pixel, as explained in more detail below, in response to an operating state of the display pixel (the pixel circuit DCx), a power voltage Vcc that has a voltage value that is different depending on the operating state is applied to the power terminal TMv; a power voltage Vss is applied to the cathode terminal TMc of the organic EL element OLED; a maintenance control signal Shld is applied to the control terminal TMh; and a data voltage Vdata corresponding to a gradation value of display data is applied to a data terminal TMd, which is connected to the contact point N2.

The capacitor Cx may be a parasitic capacitance formed between the gate and source terminals of the driving transistor T1. Alternatively, a capacitive element may be further connected in parallel between the contact point N1 and the contact point N2 in addition to the parasitic capacitance. In this embodiment, the driving transistor T1 and driving transistor T2 are n-channel type thin film transistors; however, an element structure and characteristics, etc., of the driving transistor T1 and the holding transistor T2 are not limited in particular.

<Control Operation of Display Pixels>

Next, a control operation (control method) of controlling the display pixels (each including the pixel circuit DCx and the organic EL element OLED) having the circuit configuration described above will be described.

Figure 2:
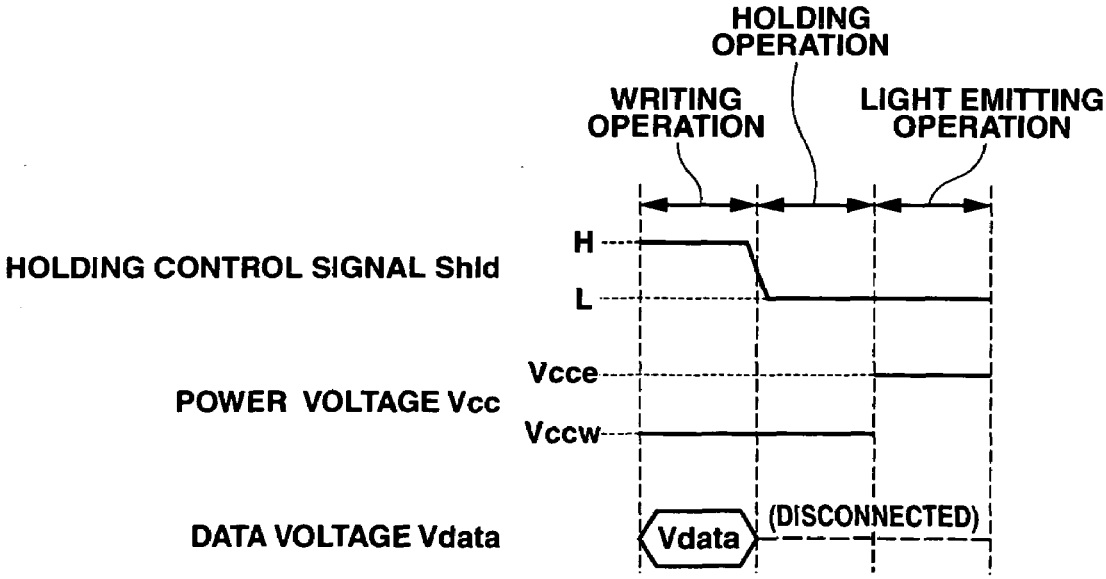
FIG. 2 is a signal waveform chart showing a control operation of the display pixels.

As shown in FIG. 2, the operating states of a display pixel (more specifically, the operating state of the pixel circuit DCx) having the circuit configuration shown in FIG. 1 can be roughly divided into: a writing operation in which a voltage component that corresponds to a gradation value of display data is written into the capacitor Cx; a holding operation in which the voltage component written in the writing operation is held in the capacitor Cx; and a light emitting operation in which a gradation current that corresponds to the gradation value of the display data is supplied to the organic EL element OLED based on the voltage component held in the capacitor Cx, so as to cause the organic EL element OLED to emit light with a luminance gradation corresponding to the display data. These operating states are described in more detail below.

(Writing Operation)

In the writing operation, a voltage component that corresponds to a gradation value of display data is written into the capacitor Cx while the organic EL element OLED is turned OFF (is in a turned-OFF state).

Figure 3A:
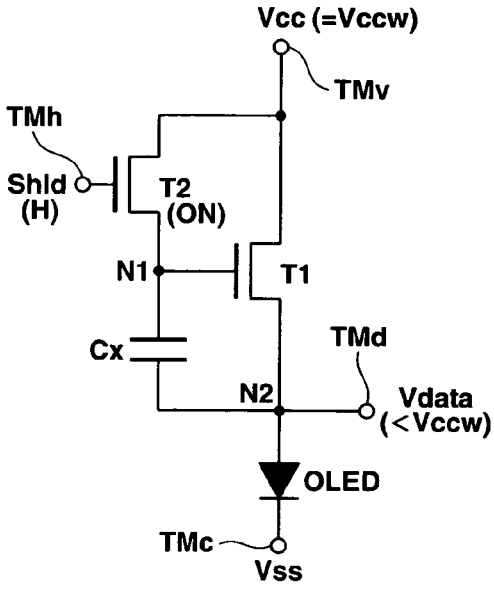
FIGS. 3A and 3B are schematic views each showing an operating state during a writing operation of the display pixels.

In more detail, first, as shown in FIGS. 2 and 3A, a holding control signal Shld having an ON level (high level) is applied to the control terminal TMh of the holding transistor T2 to turn ON the holding transistor T2. In this manner, the gate-to-drain path of the driving transistor T1 is connected (short-circuited), whereby the driving transistor T1 is set in a diode-connected state.

Subsequently, a first power voltage Vccw for the writing operation is applied to the power terminal TMv, and then a data voltage Vdata corresponding to the gradation value of the display data is applied to the data terminal TMd. At this time, a current Ids corresponding to a potential difference between the drain and source of the driving transistor T1 (Vccw−Vdata) flows between the drain and source of the driving transistor T1. The data voltage Vdata is set to a voltage value such that the current Ids has a current value required for the organic EL element OLED to emit light at a luminance gradation corresponding to the gradation value of the display data.

At this time, the driving transistor T1 is diode-connected, as explained above, such that, as shown in FIG. 3B a drain-source voltage Vds of the driving transistor T1 is equal to a gate-source voltage Vgs of the driving transistor T1, and the gate-source voltage Vgs is written (charged) into the capacitor Cx.

Figure 4A:
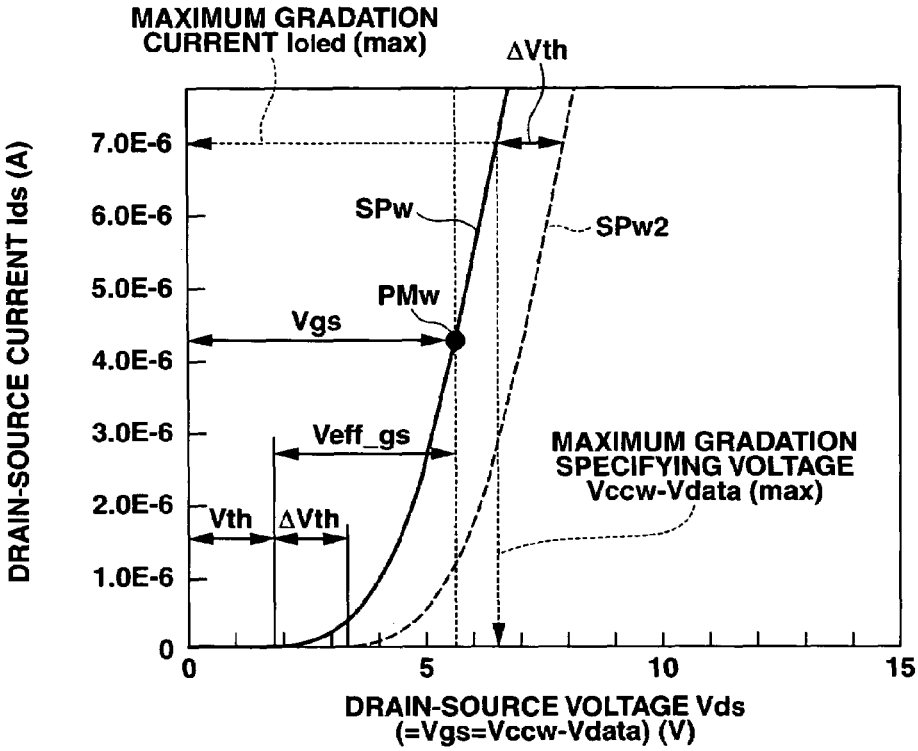
FIGS. 4A and 4B are views each showing operating characteristics of a driving transistor during the writing operation of display pixels.

The operating characteristics of the driving transistor T1 during the writing operation are shown in FIG. 4A. The solid line designated SPw in FIG. 4A is a characteristic line showing a relationship in an initial state (a state before the operating characteristics of the driving transistor T1 change over time) between the drain-source voltage Vds and the drain-source current Ids of the driving transistor T1 when the driving transistor T1 is an n-channel type thin film transistor and is diode-connected. (The dashed line designated SPw2 in FIG. 4A indicates an example of a characteristic line when a characteristic change has occurred in accordance with a driving history of the driving transistor T1, as described in more detail below.) The point PMw on the characteristic line SPw indicates an operating point of the driving transistor T1.

The characteristic line SPw has a threshold voltage Vth relative to the drain-source current Ids. If the drain-source voltage Vds exceeds the threshold voltage Vth, the drain-source current Ids increases nonlinearly with an increase in the drain-source voltage Vds. In other words, in FIG. 4A, a value indicated by Veff_gs (the component of the voltage in excess of the threshold voltage Vth) is a voltage component that forms the drain-source current Ids, and the drain-source voltage Vds is the sum of threshold voltage Vth and voltage component Veff_gs, as shown in formula (1).

$$Vds=Vth+Veff_gs \tag{1}$$

Figure 3B:
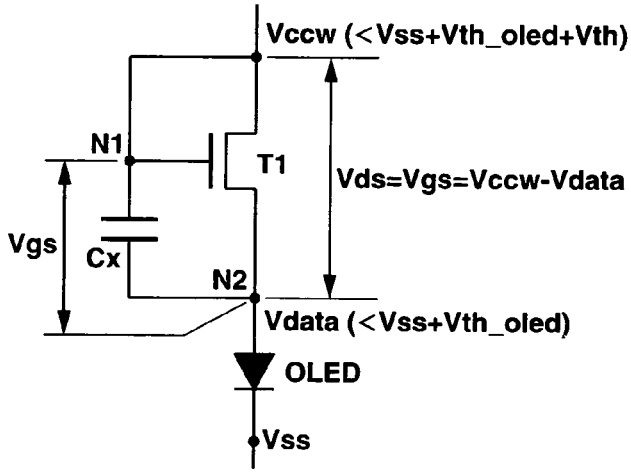

As noted above, when the driving transistor T1 is in the diode-connected state in the writing operation, as shown in FIG. 3B, the drain-source voltage Vds of the driving transistor T1 is equal to the gate-source voltage Vgs, and the drain-source voltage Vds is also equal to the difference between the first power voltage Vccw for the writing operation and the data voltage Vdata, as shown in formula (2).

$$Vds=Vgs=Vccw-V\mathrm{data} \tag{2}$$

A condition required for a value of the first power voltage Vccw will now be described. The driving transistor T1 is of the n-channel type, and thus, in order for drain-source current Ids to flow, the gate potential of the driving transistor T1 must be positive relative to the source potential. The gate potential is equal to the drain potential, and is the first power voltage Vccw. The source potential is the data voltage Vdata, and thus, the relationship shown in formula (3) must be established.

$$\mathrm{Vdata}<\mathrm{Vccw} \tag{3}$$

In addition, the contact point N2 is connected to the data terminal TMd and is also connected to the anode terminal of the organic EL element OLED.

Figure 4B:
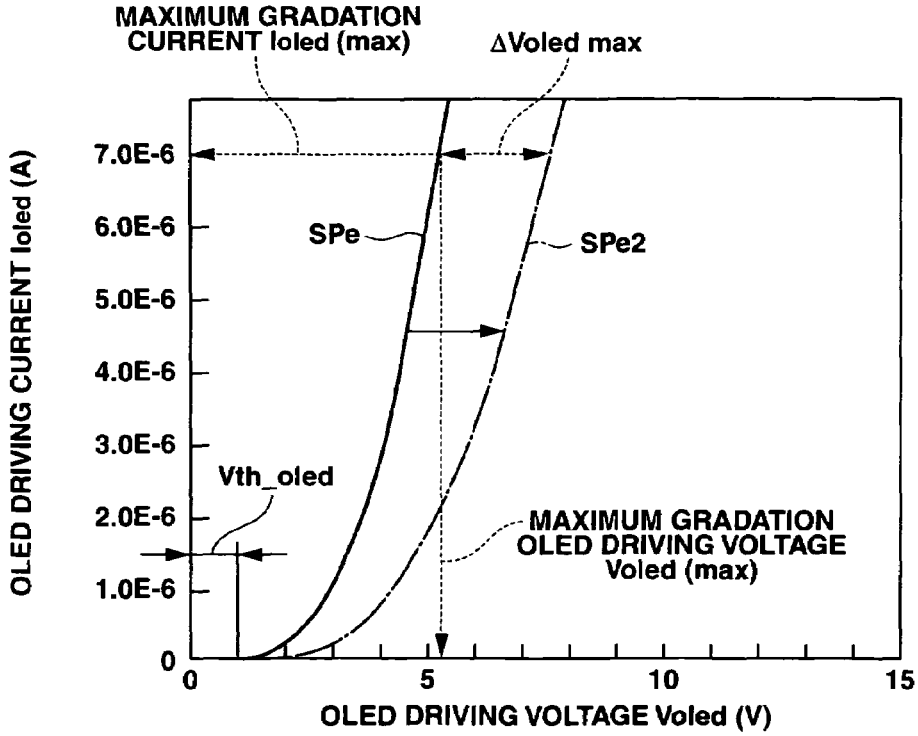

With respect to the organic EL element OLED, FIG. 4B illustrates a relationship between the driving voltage and the driving current of the organic EL element OLED. The solid line designated SPe in FIG. 4B is a characteristic line that shows a relationship between driving voltage Voled and driving current Ioled of the organic EL element OLED in initial state of the organic EL element OLED (a state before the operating characteristics of the organic EL element OLED change over time). The characteristic line SPe has threshold voltage Vth_oled relative to the driving voltage Voled. If the driving voltage Voled exceeds the threshold voltage Vth_oled, the driving current Ioled increases nonlinearly with an increase in the driving voltage Voled. (The single dot and chain line designated Spe2 in FIG. 4B indicates an example of a characteristic line when a characteristic change has occurred in accordance with a driving history of the organic EL element OLED, as described in more detail below.)

Thus, during the writing operation, in order for the organic EL element OLED to be turned OFF, the electric potential Vdata of the contact point N2 must be equal to or smaller than a value obtained by adding the threshold voltage Vth_oled of the organic EL element OLED to the voltage Vss of the cathode terminal TMc of the organic EL element OLED. That is, the value of the electric potential Vdata of the contact point N2 must satisfy formula (4).

$$V\mathrm{data}\leqq Vss+Vth_oled \tag{4}$$

Assuming that Vss is grounding potential 0 V, formula (5) is obtained.

$$\mathrm{Vdata}\leqq\mathrm{Vth_oled} \tag{5}$$

Formula (6) is obtained from formulas (2) and (5).

$$Vccw-Vgs\leqq Vth_oled \tag{6}$$

Further, from formula (1), Vgs=Vds=Vth+Veff_gs is established, and thus, formula (7) is obtained.

$$Vccw\leqq Vth_oled+Vth+Veff_gs \tag{7}$$

Formula (7) needs to be satisfied even when Veff_gs=0. Assuming that Veff_gs=0, formula (8) is obtained.

$$V\mathrm{data}<Vccw\leqq Vth_oled+Vth \tag{8}$$

In other words, during the writing operation, a value of the first power voltage Vccw must be set to a value satisfying formula (8) when the driving transistor T1 is in the diode-connected state.

Next, a description will be given with respect to the effect of a characteristic change, in accordance with a driving history, of the driving transistor T1 and the organic EL element OLED together. It is known that the threshold voltage Vth of the driving transistor T1 increases in accordance with the driving history of the driving transistor T1. The dashed line SPw2 in FIG. 4A indicates an example of a characteristic line of the driving transistor T1 when a characteristic change has occurred due to the driving history, and ΔVth indicates a change amount of the threshold voltage Vth. As shown in FIG. 4A, the fluctuation in the characteristic as a result of the driving history of the driving transistor T1 is such that an initial characteristic line (i.e., SPw) is moved substantially in parallel (or in other words, is substantially translated in the direction of increasing voltage). Thus, due to the fluctuation in the characteristics of the driving transistor T1, a value of data voltage Vdata required to obtain a gradation current (drain-source current Ids) corresponding to a given gradation value of display data must be increased by the change amount ΔVth of threshold voltage Vth with respect to the vale of the data voltage Vdata required when the driving transistor T1 is in the initial state.

In addition, it is known that the organic EL element OLED becomes highly resistive in accordance with its driving history. The alternate dash and chain line designated SPe2 in FIG. 4B indicates an example of a characteristic line of the organic EL element OLED when a characteristic change has occurred in accordance with the driving history. The fluctuation in the characteristic due to the high resistance as a result of the driving history of the organic EL element OLED generally changes the characteristic such that an increment in the driving current Ioled relative to an increment in the driving voltage Voled decreases relative to the initial characteristic line (SPe). In other words, the driving current Ioled required for the organic EL element OLED to emit light at a luminance gradation corresponding to a gradation value of display data is supplied so that driving voltage Voled increases by an amount corresponding to the difference between a value on the characteristic line SPe2 corresponding to the driving current Ioled for the luminance gradation and a corresponding value on the characteristic line SPe for the driving current Ioled. This increment is at a maximum when the driving current Ioled is a maximum value Ioled (max) corresponding to a maximum gradation, as shown in ΔVoled max in FIG. 4B.

(Holding Operation)

Figure 5A:
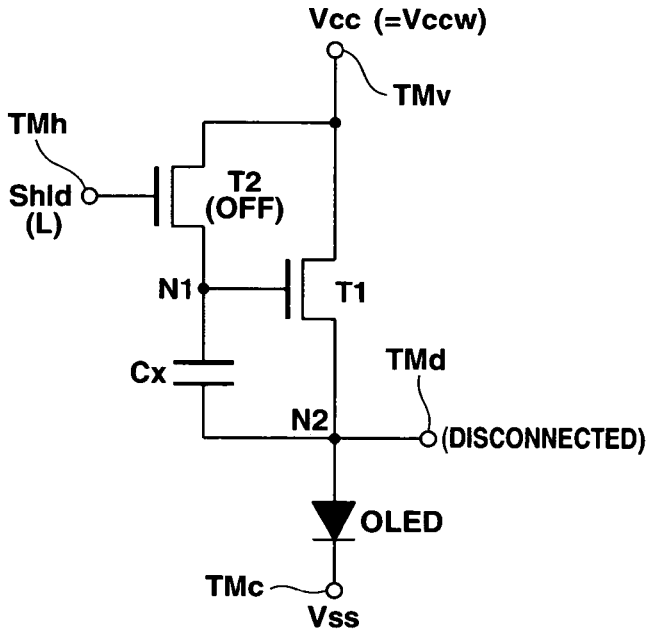
FIGS. 5A and 5B are schematic diagrams, each of which shows an operating state during a holding operation of the display pixels.
Figure 5B:
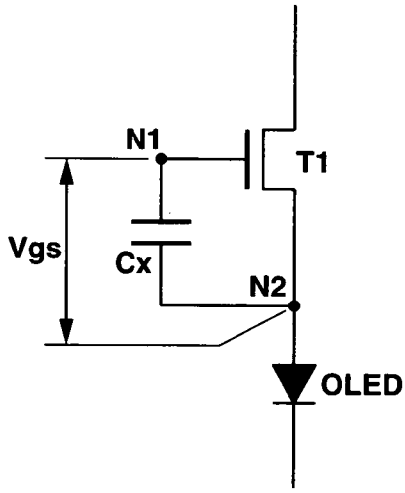

In the holding operation, as shown in FIGS. 2 and 5A, a holding control signal Shld having an OFF level (low level) is applied to the control terminal TMh, which turns OFF the holding transistor T2, thereby shutting down the gate-to-drain path of the driving transistor T1 to release the diode connection of the driving transistor T1. In this manner, as shown in FIG. 5B, the drain-source voltage Vds (=gate-source voltage Vgs) of the driving transistor T1 charged into the capacitor Cx in the writing operation described above is held in the capacitor Cx.

Figure 6:
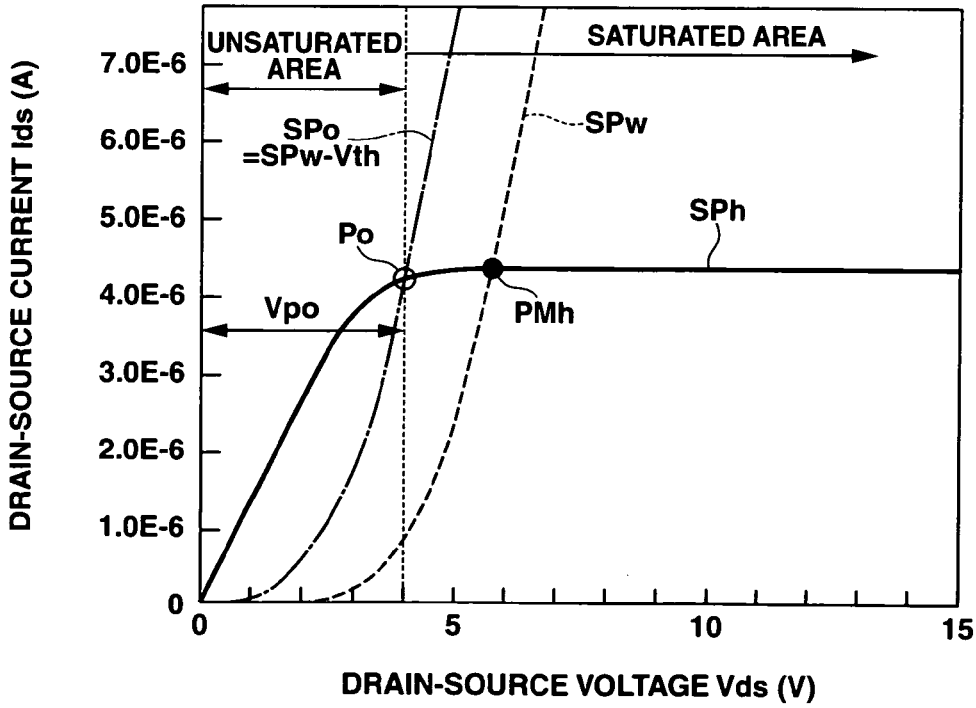
FIG. 6 is a view showing operating characteristics of a driving transistor during the holding operation of the display pixels.

The solid line designated SPh in FIG. 6 is a characteristic line of the driving transistor T1 when the diode connection of the driving transistor T1 is released and the gate-source voltage Vgs is a predetermined voltage. In addition, the dashed line designated SPw in FIG. 6 is a characteristic line of the driving transistor T1 when the driving transistor T1 is diode-connected. The operating point PMh of the driving transistor T1 at the time of the holding operation is a cross point between the characteristic line SPw when diode connection is established and the characteristic line SPh when diode connection is released.

The alternate single dot and chain line designated SPo in FIG. 6 is as a characteristic line SPw−Vth, and the cross point designated Po between the alternate single dot and chain line SPo and the characteristic line SPh indicates pinch-off voltage Vpo. As shown in FIG. 6, in characteristic line SPh, an area in which drain-source voltage Vds ranges from 0 V to the pinch-off voltage Vpo is as an unsaturated area, and an area in which the drain-source voltage Vds is equal to or greater than the pinch-off voltage Vpo is as a saturated area.

(Light Emitting Operation)

Figure 7A:
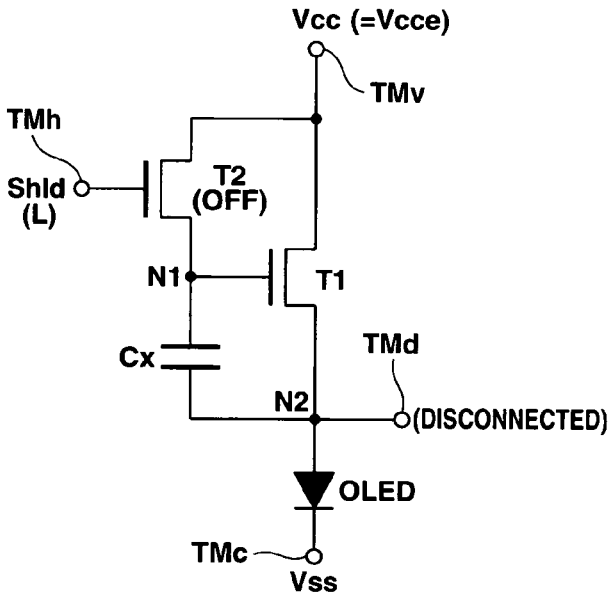
FIGS. 7A and 7B are schematic views each showing an operating state during a light emitting operation of the display pixels.
Figure 7B:
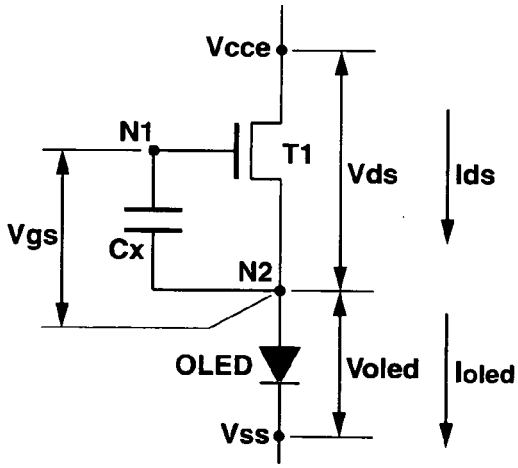

As shown in FIGS. 2 and 7A, to perform the light emitting operation, the state in which the holding control signal Shld having the OFF level (low level) is applied to the control terminal TMh is maintained (to maintain the state in which the diode connection is released), and then, the first power voltage Vccw for writing which is applied to the power terminal TMv is switched to a second power voltage Vcce for light emission. As a result, as shown in FIG. 7B, a current Ids corresponding to the voltage component Vgs held in the capacitor Cx flows between the drain and source of the driving transistor T1, and this current Ids is supplied to the organic EL element OLED, whereby the organic EL element OLED performs a light emitting operation at a luminance corresponding to a value of the supplied current.

Figure 8A:
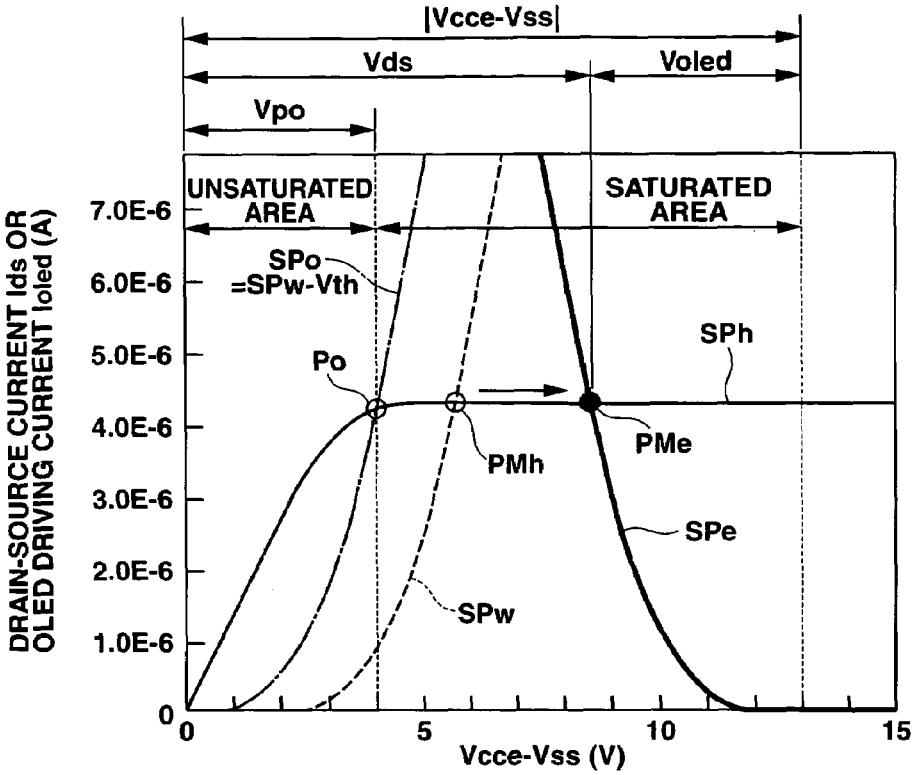
FIGS. 8A and 8B are views each showing operating characteristics of a driving transistor and load characteristics of an organic EL element during the light emitting operation of the display pixels.

The solid line designated SPh in FIG. 8A is a characteristic line of the driving transistor T1 when the gate-source voltage Vgs is a predetermined voltage. In addition, the solid line designated SPe indicates a load line of the organic EL element OLED. While a potential difference between the power terminal TMv and the cathode terminal TMc of the organic EL element OLED, i.e., a value of Vcce−Vss, is defined as a reference, driving voltage Voled-driving current Ioled characteristics of the organic EL element OLED are plotted in a reverse orientation.

An operating point of the driving transistor T1 during the light emitting operation moves from PMh (the operating point during the holding operation) to PME, which is a cross point between the characteristic line SPh of the driving transistor T1 and the load line SPe of the organic EL element OLED. The operating point PMe shown in FIG. 8A represents a point at which, in a state in which a voltage of Vcce−Vss is applied between the power terminal TMv and the cathode terminal TMc of the organic EL element OLED, this voltage is distributed between the source and drain of the driving transistor T1 and between the anode and cathode of the organic EL element OLED. In other words, at operating point PMe, voltage Vds is applied between the source and drain of the driving transistor T1, and then, driving voltage Voled is applied between the anode and cathode of the organic EL element OLED.

Operating point PMe must be maintained in a saturated area on the characteristic line so that current Ids (expectation current) flowing between the drain and source of the driving transistor T1 during the writing operation and driving current Ioled supplied to the organic EL element OLED during the light emitting operation do not change. Voled is obtained as the maximum Voled (max) when light is emitted at the maximum gradation. Therefore, in order to maintain PMe described previously in a saturated area, a value of the second power voltage Vcce must satisfy formula (9).

$$Vcce-Vss \leqq Vpo+Voled(\max) \quad (9)$$

Assuming that Vss is grounding potential 0 V, formula (10) is obtained.

$$Vcce \geqq Vpo+Voled(\max) \quad (10)$$

<Relationship between Fluctuation of Organic Element Characteristics and Voltage-Current Characteristics>

Figure 8B:
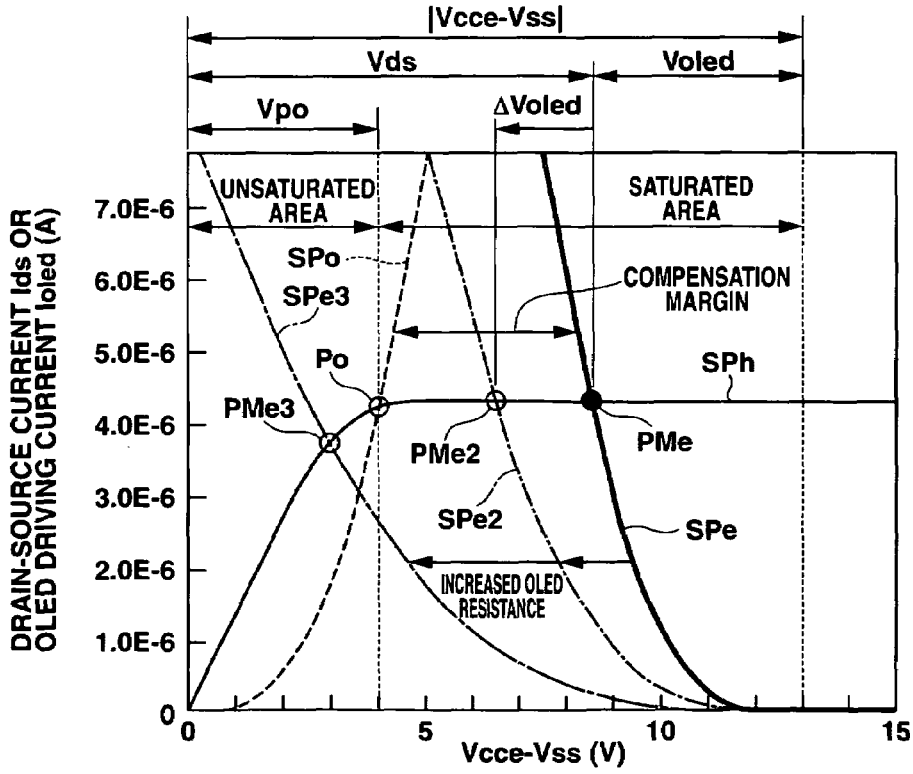

As shown in FIG. 4B, the organic EL element OLED becomes highly resistive in accordance with its driving history, and then changes such that an increment in the driving current Ioled relative to an increment in the driving voltage Voled decreases. In other words, the organic EL element OLED changes in a direction in which the gradient of load line SPe of the organic EL element OLED shown in FIG. 8A decreases. FIG. 8B shows an entry example of a change according to a driving history of load line SPe of the organic EL element OLED, wherein the load line changes from SPe→Spe2→Spe3. As a result, an operating point of the driving transistor T1 moves on the characteristic line SPh of the driving transistor T1 in the direction of PMe→PMe2→PMe3 in accordance with a driving history.

At this time, while an operating point is present in the saturated area on a characteristic line (PMe→PM2), driving current Ioled maintains a value of an expectation current at the time of the writing operation. However, if the unsaturated area is entered (PMe3), driving current Ioled decreases with respect to the expectation current during the writing operation, and a display failure occurs. In FIG. 8B, the pinch-off point Po exists at the boundary between the unsaturated area and the saturated area. In other words, a potential difference between operating points PMe and Po during light emitting operation is obtained as a compensation margin for maintaining an OLED driving current during light emission relative to the high resistance of organic EL. In other words, a potential difference on the characteristic line SPh of the driving transistor is obtained as a compensation margin, the characteristic line being sandwiched between trajectory SPo of a pinch-off point and load line SPe of the organic EL element in each Ioled level. As shown in FIG. 8B, this compensation margin decreases with an increase in a value of driving current Ioled, and increases with an increase in voltage Vcce−Vss applied between the power terminal TMv and cathode terminal TMe of organic EL element OLE.

<Relationship between Fluctuation of TFT Element Characteristics and Voltage-Current Characteristics>

In the voltage gradation control employing a transistor applied to the display pixel (pixel circuit) described above, the data voltage Vdata is set depending on drain-source voltage Vds—drain-source current Ids characteristics preset to an initial value. However, as shown in FIG. 4A, the threshold voltage Vth increases in response to the driving history, and as a result a current value of a light emitting driving current supplied to a light emitting element (the organic EL element OLED) does not correspond to display data (data voltage), and a light emitting operation cannot be performed at a proper luminance gradation. In particular, it is known that if an amorphous silicon transistor is applied as a transistor, significant fluctuation of element characteristics occurs.

In an amorphous silicon transistor having a designed value as shown in Table 1, there is shown an example of initial characteristics (voltage-current characteristics) of the drain-source voltage Vds and the drain-source current Ids when performing a display operation of 256 gradations.

TABLE 1

| <Transistor designed value> | |
|---|---|
| Gate insulation film thickness | 300 nm (3000 Å) |
| Channel width W | 400 μm |
| Channel length L | 6.28 μm |
| Threshold voltage Vth | 2.4 V |

An increase of Vth exerted by offset of a gate electric field due to a carrier trap for a gate insulation film in accordance with a driving history or a change with time (initial state: high voltage side from SPw: shift to SPw2) occurs in a relationship between voltage-current characteristics in an n-channel type amorphous silicon transistor, i.e., drain-source voltage Vds and drain-source current Ids shown in FIG. 4A. Therefore, when the drain-source voltage Vds applied to the amorphous silicon transistor is predetermined, the drain-source current Ids decreases, and the luminance gradation of a light emitting element decreases.

With respect to fluctuation of the element characteristics, when the threshold voltage Vth increases, a voltage-current characteristic line (V-I characteristic line) of an amorphous silicon transistor is formed in a shape such that the characteristic line in an initial state is moved substantially in parallel (translated). Thus, the V-I characteristic line designated SPw2, after being shifted, can be substantially equal to the voltage-current characteristics when a predetermined voltage (equivalent to offset voltage Vofst described later) corresponding to change amount ΔVth (about 2 V in FIG. 4A) of threshold value Vth is added to each value of the drain-source voltage Vds of V-I characteristic line SPw in an initial state (in other words, when the V-I characteristic line SPw is moved in parallel by ΔVth).

In other words, during the writing operation of display data into a display pixel (pixel circuit DCx), a data voltage (equivalent to correction gradation voltage Vpix described later) corrected by adding a predetermined voltage (offset voltage Vofst) corresponding to the change amount ΔVth of the element characteristics (threshold voltage) of the driving transistor T1 in the display pixel is applied to a source terminal (the contact point N2) of the driving transistor T1, thereby compensating for a shift of voltage-current characteristics due to fluctuation of the threshold voltage Vth of the driving transistor T1, supplying driving current Iem having a current value corresponding to display data to the organic EL element OLED and causing a light emitting operation at a desired luminance gradation.

It should be noted that the holding operation of switching the holding control signal Shld from the ON level to the OFF level and the light emitting operation of switching the power voltage Vcc from voltage Vccw to voltage Vcce may be carried out in synchronism with each other. In other words, there need not be a separate holding period between the writing operation and the light emitting operation.

Hereinafter, a specific description will be given with reference to an entire configuration of a display device including a display panel on which a plurality of display pixels including constituent elements of the pixel circuit as described above are arranged in a two-dimensional manner.

It should be noted that although the drawings (for example, FIG. 10) may illustrate a variety of signals and information being delivered between elements, the signals, data, currents, and voltages, which are illustrated for convenience, are not necessarily delivered simultaneously.

First Embodiment

<Display Device>

Figure 9:
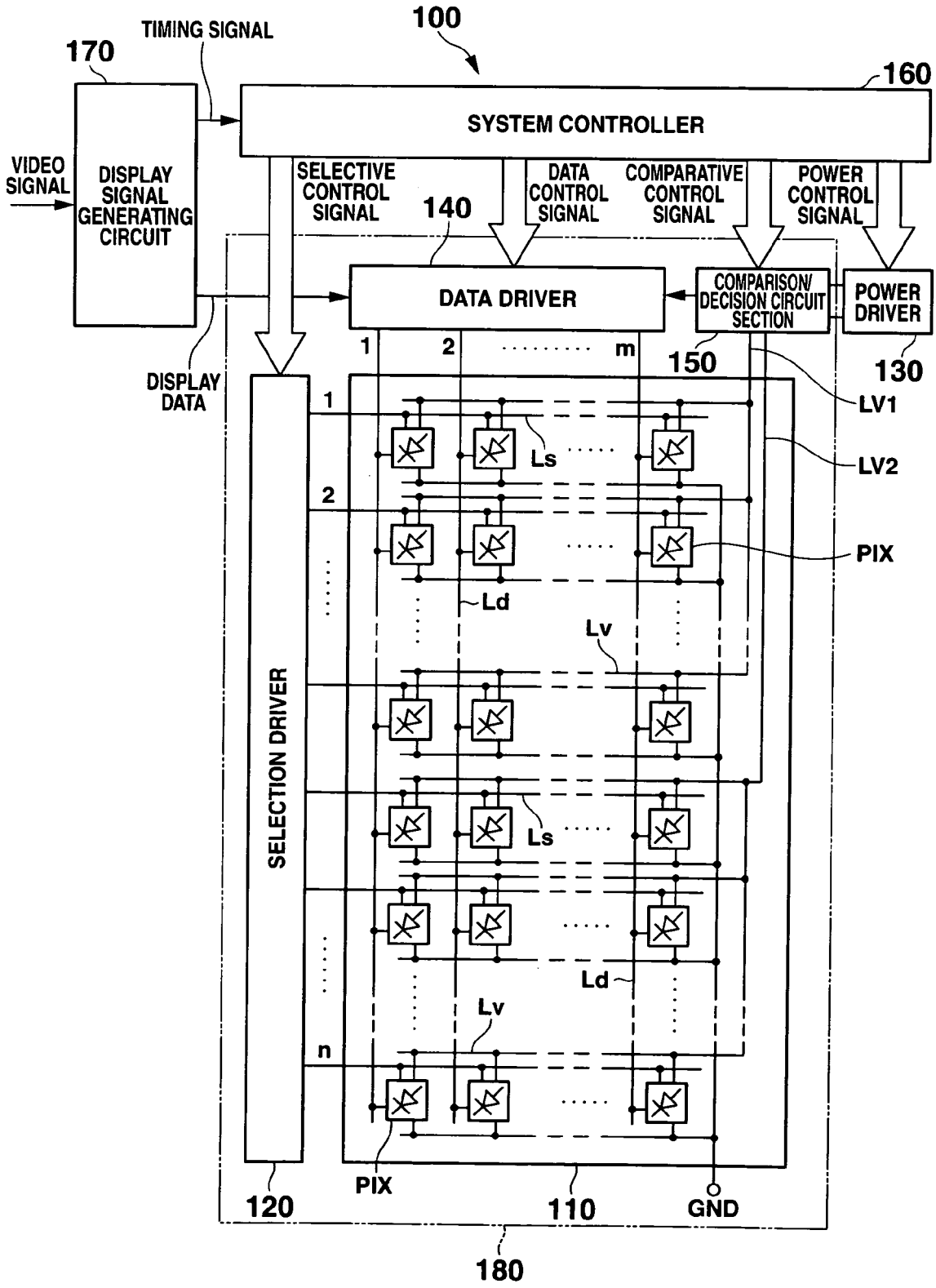
FIG. 9 is a schematic configuration diagram showing a first embodiment of the display device according to the present invention.

As shown in FIG. 9, a display device 100 according to the present embodiment, for example, includes a display area 110, a selection driver (selection drive circuit) 120, a power driver (power drive circuit) 130, a data driver (display drive device, data drive circuit) 140, a comparison/decision circuit section 150, a system controller 160, a display signal generating circuit 170 and a display panel 180.

A plurality of selection scan lines Ls are arranged in a row direction (horizontal direction in FIG. 9) of the display device. The selection driver (selection drive circuit) 120 applies a selection signal Ssel to each selection scan line Ls with a predetermined timing. In addition, a plurality of data lines Ld are arranged in a column direction (vertical direction in FIG. 9) of the display device. The data driver (display drive device, data drive circuit) 140 supplies a gradation signal (correction gradation voltage Vpix) to each data line Ld with a predetermined timing. Still further, a plurality of voltage supply lines Lv are arranged in the row direction in parallel to the selection scan lines Ls. The power driver (power drive circuit) 130 applies power voltage Vcc, which has a predetermined voltage level, at a predetermined timing to each of the voltage supply lines Lv.

A plurality of pixels PIX are arranged in a matrix shape in n rows×m columns (n and m are arbitrary positive integers) the display area 110. Each of the display pixels PIX is arranged in the vicinity of a cross point at which one of the selection scan lines Ls crosses one of the plurality of data lines Ld.

The comparison/decision circuit section 150 detects fluctuation of element characteristics of a driving transistor provided for each of a plurality of voltage supply lines Lv (and provided in each display pixel PIX (the pixel drive circuit DC)) in a correction data acquisition operation described below. The system controller 160 generates and outputs a selection control signal, a power control signal, a data control signal, and a comparison control signal for controlling an operating state of at least the selection driver 120, the power driver 130, the data driver 140, and the comparison/decision circuit section 150, based on a timing signal supplied from the display signal generating circuit 170. The display signal generating circuit 170 generates display data (luminance gradation data) which is a digital signal based on a video signal supplied from outside of the display device 100, for example, and then, supplies the display data to the data driver 140 and extracts or generates a timing signal (such as system clock) for displaying predetermined image information in the display area 110 based on the display data, and then, supplies the generated timing signal to the system controller 160.

The display panel 180 includes a substrate on which the display area 110, the selection driver 120, the data driver 140, and the comparison/decision circuit section 150 are arranged. The power driver 130 is connected via a film substrate outside of the display panel 180, for example, however, the power driver 130 may be directly mounted on the display panel 180. A structure may be provided such that a part of each of the data driver 140 and the comparison/decision circuit section 150 is arranged on the display panel 180 and the remaining part is connected via a film substrate outside of the display panel 180. Part of the data driver 140 and the comparison/decision circuit section 150 in the display panel 180 may be an IC chip or may be composed of a transistor manufactured with transistors of the pixel circuit DC described below. In addition, the selection driver 120 may be an IC chip or may be composed of a transistor manufactured with transistors of the pixel circuit DC described below.

The constituent elements mentioned above described below.

(Display Panel)

In the display device 100 according to the present embodiment, a plurality of display pixels PIX are arranged in a matrix shape in the display area 110, which is positioned at the center of the display panel 180. The plurality of display pixels PIX, for example, as shown in FIG. 9, are grouped into an upper area group of display pixels (positioned at the top of the display area 110 in FIG. 9) and a lower area group of display pixels (positioned at the bottom of the display area in FIG. 9) of the display area 110. Each row of the display pixels PIX in the display area 110 corresponds to one voltage supply line Lv, and each display pixel PIX in each row is connected to the voltage supply line Lv corresponding to the row. The voltage supply lines Lv provided for the display pixels PIX in the upper area are connected to (branched from) a first voltage supply line Lv1, and the voltage supply lines Lv provided for the display pixels in the lower area are connected to (branched from) a second voltage supply line Lv2. The first voltage supply line Lv1 and the second voltage supply line Lv2 are connected to the power driver 130 via the comparison/decision circuit section 150 described below. The first voltage supply line Lv1 and the second voltage supply line Lv2 are electrically independent of each other. Thus, the power voltage Vcc is applied in common via the first voltage supply line Lv1 to all of the display pixels PIX in the upper area of the display area 110 (namely, the display pixels PIX in the 1 through n/2-th rows (n is an even number) of the display pixels PIX), and the power voltage Vcc is applied in common via the second voltage supply line Lv2 to all of the display pixels PIX in the lower area of the display area 110 (namely the display pixels PIX in the 1+n/2 through n-th rows of the display pixels PIX). The power voltage Vcc is outputted independently and at respective different timings to each of the first power supply line Lv1 and the second power supply line Lv2 by the power driver 130.

(Display Pixels)

Figure 10:
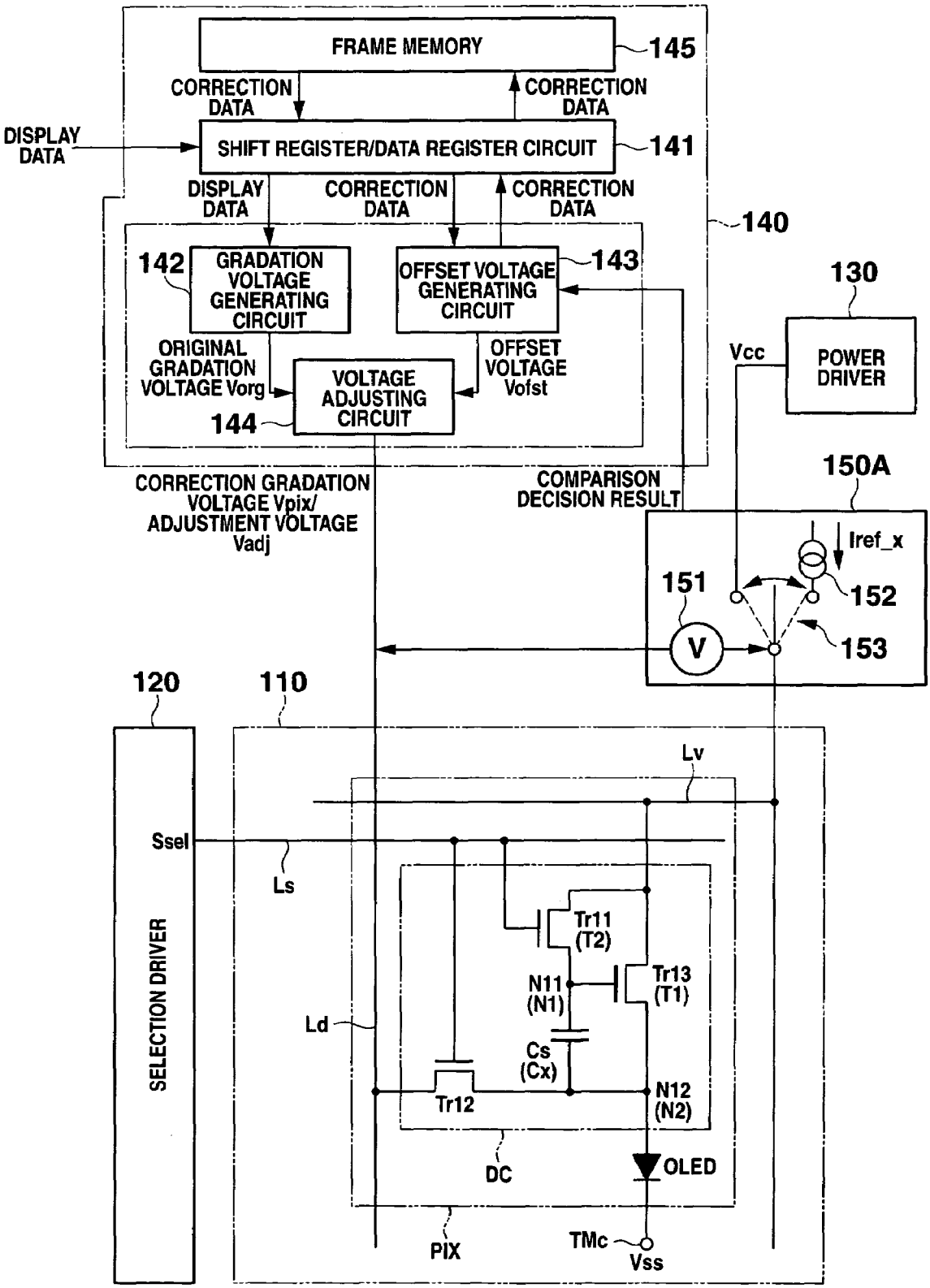
FIG. 10 is a schematic diagram showing an example of a data driver, a comparison/decision circuit section and a display pixel, which are applicable to the display device according to the first embodiment.

The display pixels PIX applied in the present embodiment are laid out in the vicinity of cross points between selection scan lines Ls connected to the selection driver 120 and data lines Ld connected to the data driver 140. For example, as shown in FIG. 10, each of the display pixels includes the organic EL element OLED serving as a current-driven light emitting element and a pixel drive circuit DC for generating a light emitting driving current and driving the organic EL element OLED. Elements of the pixel drive circuit DC that are the same as elements of the pixel drive circuit DCx described above with respect to FIG. 1 are identified both by their own respective reference numerals used in the following description, and by parenthetical reference numeral indicating the corresponding element in FIG. 1.

In more detail, the pixel drive circuit DC includes a transistor Tr11, a transistor Tr12, a transistor Tr13 and a capacitor Cs. The transistor Tr11 (diode connection transistor) includes a gate terminal connected to one of the selection scan lines Ls, a drain terminal connected to one of the voltage supply lines Lv, and a source terminal connected to a contact point N11. The transistor Tr12 includes a gate terminal connected to the selection scan line Ls, a source terminal connected to one of the data lines Ld, and a drain terminal connected to a contact point N12. The transistor Tr13 (driving transistor) includes a gate terminal connected to the contact point N11, a drain terminal connected to the voltage supply line Lv, and a source terminal connected to the contact point N12. The capacitor (voltage holding element) Cs is connected between the contact point N1l and the contact point N12 (between gate and source terminals of the transistor Tr13).

The transistor Tr13 corresponds to the driving transistor T1 shown in FIG; the transistor Tr11 corresponds to the holding transistor T2; the capacitor Cs corresponds to the capacitor Cx; and the contact points N11 and N12 correspond to the contact point N1 and the contact point N2, respectively. In addition, selection signal Ssel applied from the selection driver 120 to the selection scan line Ls corresponds to the holding control signal Shld described above, and a gradation signal (correction gradation voltage Vpix) applied from the data driver 140 to the data line Ld corresponds to the data voltage Vdata described above.

In the organic EL element OLED, an anode terminal is connected to the contact point N12 of the pixel drive circuit DC and reference voltage Vss serving as a constant low voltage is applied to the cathode terminal TMc. In a drive control operation of the display device described below, in a writing operation period in which a gradation signal (correction gradation voltage Vpix) corresponding to display data is supplied to the pixel drive circuit DC, correction gradation voltage Vpix applied from the data driver 140, reference voltage Vss, and power voltage Vcc (=Vcce) of high electric potential applied to voltage supply line Lv during a light emitting operation period satisfy formulas (3)-(10) above. Therefore, the organic EL element OLED does not light during the writing operation.

Moreover, the capacitor Cs may be a parasitic capacitance formed between the gate and source terminals of the transistor Tr13. In addition to the parasitic capacitance, a capacitive element other than the transistor Tr13 may be connected between the contact point N11 and the contact point N12 or both of them may be combined with one another.

The transistors Tr11, Tr12 and Tr13 are n-channel type electric field effect transistors, for example, without being limited thereto, whereby n-channel type amorphous silicon thin film transistors can be used. In this case, with the use of the already established amorphous silicon manufacturing technique, a pixel drive circuit DC including amorphous silicon thin film transistors with stable element characteristics (such as extent of electron transfer) can be manufactured by a comparatively simple manufacturing process.

The circuit configuration of display pixels PIX (in particular, the circuit configuration of the pixel drive circuit DC) is not limited to that shown in FIG. 10. Any other circuit configuration may be used as long as it includes at least elements corresponding to the driving transistor T1, the holding transistor T2, and the capacitor Cx as shown in FIG. 1, and as long as a current path of the driving transistor T1 is connected in series to a current-driven light emitting element (the organic EL element OLED). In addition, the light emitting element driven by the pixel drive circuit DC are not limited to the organic EL element OLED, and may be any other current-driven light emitting element such as a light emitting diode.

(Selection Driver)

The selection driver 120 sets rows of display pixels PIX in either a selected state or an unselected state by applying a selection signal Ssel having a selection level (high level in display pixels PIX shown in FIG. 10) to selection scan lines Ls, based on a selection control signal supplied from the system controller 160. Specifically, at least during a correction data acquisition operation period and during a writing operation period described below, the selection signal Ssel having an ON (selection) level (high level) is sequentially applied to the to selection scan lines Ls with a predetermined timing, so as to sequentially set each row of display pixels PIX in the selected state.

The selection driver 120, for example, may include a shift register for sequentially outputting shift signals corresponding to the selection scan lines Ls based on the selection control signal supplied from the system controller 160 described later, and an output circuit (output buffer) for converting the shift signals to a predetermined signal level (selection level), and then, sequentially outputting selection signals Ssel to the selection scan lines Ls. If a driving frequency of the selection driver 120 is within a range such that operation is possible by means of an amorphous silicon transistor, part or all of the transistors included in the selection driver 120 may be manufactured from amorphous silicon transistors together with the transistors Tr11, Tr12 and Tr13 in the pixel drive circuit DC.

(Power Driver)

The power driver 130 applies power voltage Vcc having a low potential (=Vccw: first power voltage) to voltage supply lines Lv in at least a correction data acquisition operation period and writing operation period described below, and applies power voltage Vcc (=Vcce: second power voltage) having a high potential with respect to the power voltage Vccw of low potential in a light emitting operation period, based on a power control signal supplied from the system controller 160. In the structure shown in FIG. 9, the power driver 130 outputs the power voltage Vcc to the display pixels PIX arranged in the upper area via the first voltage supply line Lv1 and outputs the power voltage Vcc to the display pixels PIX arranged in the lower via the second voltage supply line Lv2.

The power driver 130 may include a timing generator for generating a timing signal corresponding to the voltage supply line Lv of each area (group) (such as shift register for sequentially outputting shift signals, for example) based on the power control signal supplied from the system controller 160, for example, and an output circuit for converting the timing signal to a predetermined voltage level (voltage values Vccw, Vcce) and then outputting the power voltage Vcc to voltage supply line Lv of each area. If a small number of voltage supply lines exist as in the first voltage supply line Lv1 and the second voltage supply line Lv2, the power driver 130 may be disposed in part of the system controller 160 (without the power driver 130 being disposed on the display panel 180).

(Data Driver)

The data driver 140 detects an offset voltage Vofst (described later in detail) corresponding to a change amount of element characteristics (threshold voltage) of the transistor Tr13 (equivalent to the driving transistor T1) and the transistor Tr12 provided in each of the display pixels (the pixel drive circuit DC) arranged in the display area 110, based on a comparison decision result (comparison result) outputted from the comparison/decision circuit section 150, and stores correction data (specific values) for the display pixels PIX. The data driver 140 corrects a signal voltage (original gradation voltage Vorg) corresponding to display data (luminance gradation data) by display pixels PIX supplied from the display signal generating circuit 170 described below based on the correction data. The data driver 140 generates a data voltage (correction gradation voltage Vpix) corresponding to element characteristics of the transistor Tr13 and the transistor Tr12 and then supplies the generated data voltage to display pixels PIX via data line Ld.

The data driver 140, for example, as shown in FIG. 10, includes a shift register/data register circuit 141, a gradation voltage generating circuit 142, an offset voltage generating circuit (adjustment voltage setting circuit, specific value extraction circuit, compensation voltage generating circuit) 143, a voltage adjusting circuit (gradation voltage correction circuit) 144, and a frame memory (storage circuit) 145. The gradation voltage generating circuit 142, the offset voltage generating circuit 143, and the voltage adjusting circuit 144 are provided for each of the data lines Ld (for each of the columns), and m groups thereof are arranged in the display device 100 according to the present embodiment. In addition, the shift register/data register circuit 141 and the frame memory 145 are provided in common for all of the data lines Ld (all of the columns).

While, in the present embodiment, as shown in FIG. 10, the frame memory 145 is incorporated in the data driver 140, the frame memory may be provided independently outside of the data driver 140. In addition, in the case where the display panel 180 has a pixel configuration corresponding to display of a color image (in other words, if each of the display pixels PIX are includes a group of three color pixels of red (R), green (G), and blue (B)), individual data lines are provided for each of the colors in each column, and a respective shift register/data register circuit is provided for each color.

The shift register/data register circuit 141 includes: a shift register for sequentially outputting shift signals based on a data control signal supplied from the system controller 160, for example; and a data register for picking up display data (luminance gradation data) supplied from the display signal generating circuit 170, based on the shift signals, transferring the picked up data to the gradation voltage generating circuit 142 provided for each column and picking up correction data outputted from the offset voltage generating circuit 143 by column and outputting the picked up data to the frame memory 145. Further, the data register picks up correction data output from the frame memory 145 and then transfers the picked up data to the offset voltage generating circuits 143 during the writing operation and during the correction data acquisition operation.

The shift register/data register circuit 141 selectively executes the following operations: an operation of sequentially picking up display data (luminance gradation data) corresponding to display pixels PIX for one row of the display area 110, the display data being sequentially supplied as serial data from the display signal generating circuit 170 described below, and then transferring the picked up data to the gradation voltage generating circuits 142 provided by column; an operation of picking up correction data corresponding to a change amount of element characteristics (threshold voltage) of the transistor Tr13 and the transistor Tr12 of the display pixels PIX (the pixel drive circuit DC), the data being sequentially outputted from the offset voltage generating circuits 143 provided by column based on a comparison decision result in a voltage comparison/decision circuit section 150A described below, and then sequentially transferring the picked up data to the frame memory 145; and an operation of sequentially picking up the correction data of the display pixels PIX for one specific row from the frame memory 145 and then transferring the picked up data to the offset voltage generating circuits 143 provided by column. These operations each will be described below in more detail.

The gradation voltage generating circuit 142 generates and outputs an original gradation voltage (original gradation signal) Vorg having a voltage value for causing a light emitting operation or a no-light emitting operation (black display operation) of the organic EL element OLED at a luminance gradation that is based on display data for a display pixel PIX picked up via the shift register/data register circuit 141.

The original gradation voltage Vorg generated by the gradation voltage generating circuit 142 serves as a voltage value that is capable of making a light emitting operation or a no-light emitting operation of the organic EL element OLED at a luminance gradation corresponding to display data, and the original gradation voltage Vorg is a and a voltage applied between the anode and cathode of the organic EL element OLED, and a threshold voltage component of the transistor OLED is not added to the original gradation voltage Vorg. In other words, as described below, the transistor Tr13 outputs to data line Ld a voltage obtained by adding threshold voltage Vth of the transistor Tr13 to the original gradation voltage Vorg so that a potential difference occurs between voltage supply line Lv and data line Ld to an extent that a current flows at a luminance gradation corresponding to display data to the transistor Tr13 in a state of the V-I characteristic line SPw described below (threshold value fluctuation and dispersion of threshold value of transistors Tr13).

The gradation voltage generating circuit 142 may include a digital-analog converter (D/A converter) for converting a digital signal voltage of the display data to an analog signal voltage based on a gradation reference voltage (reference voltage corresponding to the number of gradations included in display data) supplied from a power supply circuit (not shown), and an output circuit for outputting the analog signal voltage as the original gradation voltage Vorg with a predetermined timing.

The offset voltage generating circuit 143 generates and outputs an offset voltage (compensation voltage) Vofst corresponding to a change amount (equivalent to ΔVth shown in FIG. 4A) of a threshold voltage of the transistor Tr13 of display pixels PIX (the pixel drive circuit DC), based on correction data picked up from the frame memory 145. When the pixel drive circuit DC has the circuit configuration shown in FIG. 10, a current supplied to data line Ld during the writing operation is set to a direction of drawing a current from data line Ld to the data driver 140. Thus, the offset voltage (compensation voltage) Voft to be generated is also set so that a current flows from voltage supply line Lv via data line Ld between the drain and source of the transistor Tr13 and between the drain and source of the transistor Tr12.

Specifically, in a writing operation, offset voltage Vofst is obtained as a value satisfying formula (11).

$$Vofst = Vunit \times Minc \tag{11}$$

In formula (11), Vunit denotes a unit voltage, a preset voltage minimum unit, and a negative potential. Minc denotes an offset setting value and digital correction data read out from the frame memory 145. A detailed description will be given below.

As described above, the offset voltage Vofst is a voltage obtained by correcting for a change amount of a threshold voltage of the transistor Tr13 of display pixels PIX (the pixel drive circuit DC) and a change amount of a threshold voltage of the transistor Tr12 so that a correction gradation current approximated to a current value in a normal gradation flows between the source and drain of the transistor Tr13 by means of correction gradation voltage Vpix output from the voltage adjusting circuit 144 in a writing operation.

On the other hand, in a correction data acquisition operation executed prior to the writing operation, optimization is promoted by properly changing a value of the offset setting value (variable) Minc until it becomes a conforming value. Specifically, the offset voltage Vofst is generated according to a value of an initial offset setting value Minc, and then, the offset setting value Minc is outputted as the correction data to the shift register/data register circuit 141 based on a comparison decision result outputted from the comparison/decision circuit section 150.

With respect to such offset setting value Minc, with a counter being provided inside of the offset voltage generating circuit 143, the counter operating at a predetermined clock frequency and counting up a count value by one if a signal of a predetermined voltage value picked up with a timing of clock frequency CK is inputted, based on the comparison decision result, the count value of the counter may be sequentially modulated (increased, for example) and set or based on the comparison decision result. The setting value properly modulated may be supplied from a controller such as the system controller 160.

In addition, while unit voltage Vunit can be set to an arbitrary predetermined voltage, the smaller the absolute voltage value of the unit voltage Vunit is set, the smaller the voltage difference between offset voltages Vofst can be obtained. Thus, in a writing operation, an offset voltage Vofst approximating a change amount of a threshold voltage of the transistor Tr13 of a display pixel PIX (the pixel drive circuit DC) can be generated, and a gradation signal can be corrected more finely and properly.

As a voltage value set to this unit voltage Vunit, for example, may be a voltage difference between source-drain voltages Vds corresponding in adjacent gradations in voltage-current characteristics of transistors (operating characteristics shown in FIG. 4A, for example). Such a unit voltage Vunit may be stored in a storage medium such as a memory (not shown) provided in the offset voltage generating circuit 143 or the data driver 140, for example, and may be temporarily saved in a resistor provided in the data driver 140 after being supplied from a controller such as the system controller 160.

In this case, it is preferable that unit voltage Vunit be set to the smallest potential difference among the potential differences obtained by subtracting drain-source voltage Vds_k+1 (>Vds_k) at the (k+1)-th gradation from drain-source voltage Vds_k (positive voltage value) at the k-th gradation (k denotes an integer and denotes that higher luminance gradation is obtained with increase of integer) in the transistor Tr13. In a thin film transistor such as the transistor Tr13, particularly in an amorphous silicon TFT, if it is combined with the organic EL element OLED in which light emitting luminance increases substantially linearly relative to current density of a current that flows, in general, the higher the gradation is, namely, the higher the drain-source voltage Vds is (in other words, the greater the drain-source current Ids is), a potential difference between the adjacent gradations is prone to decrease. More specifically, if 256-gradation voltage gradation control is carried out (while the 0-th gradation is defined as no-light emission), a potential difference between voltage Vds at the maximum luminance gradation (the 255-th gradation, for example) and voltage Vds at the 254-th gradation becomes the smallest among the potential differences between the adjacent gradations. Thus, it is preferable that the unit voltage Vunit be a value obtained by subtracting the drain-source voltage Vds of the maximum luminance gradation (or gradation in the vicinity thereof) from the drain-source voltage Vds of a luminance gradation that is smaller by one gradation than the maximum luminance gradation (or gradation in the vicinity thereof).

The voltage adjusting circuit 144 adds the original gradation voltage Vorg outputted from the gradation voltage generating circuit 142 and the offset voltage Vofst outputted from the offset voltage generating circuit 143, and then outputs the added voltage to the corresponding data line Ld. Specifically, in a correction data acquisition operation described below, the offset voltage Vofst generated based on the offset setting value Minc optimized by properly modulating it as described above is added (in the case where the gradation voltage generating circuit 142 includes a D/A converter) to original gradation voltage Vorg_x corresponding to a predetermined gradation (x gradation) outputted from the gradation voltage generating circuit 142, and then a voltage component serving as a sum thereof is outputted as adjustment voltage Vadj to data line Ld.

In addition, in a writing operation, a correction gradation voltage Vpix generated by the voltage adjusting circuit 144 is obtained as a value satisfying formula (12).

$$Vpix=Vorg+Vofst \tag{12}$$

Offset voltage Vofst generated by the offset voltage generating circuit 143 based on correction data picked up from the frame memory 145 is added to original gradation voltage Vorg corresponding to display data outputted from the gradation voltage generating circuit 142, and then a voltage component serving as a sum thereof is outputted as correction gradation voltage Vpix to data line Ld at the time of writing operation.

The frame memory 145 sequentially picks up, from the offset voltage generating circuits 143 corresponding respectively to the columns, offset setting values Minc set for the display pixels PIX as correction data for the display pixels PIX for one row via the shift register/data register circuit 141 in the correction data acquisition operation executed prior to the operation of writing display data (correction gradation voltage Vpix) in each display pixel PIX arranged in the display area 110. The frame memory 145 then stores the picked up data in individual areas for each of the display pixels PIX for one screen (single frame). In addition, during the writing operation, the frame memory 145 sequentially reads out the correction data for the display pixels PIX of one row via the shift register/data register circuit 141 and then outputs (transfers) the read data to the offset voltage generating circuits 143 corresponding respectively to the columns.

(Comparison/Decision Circuit Section)

The comparison/decision circuit section 150 of the display device 100 (FIG. 9) in the present embodiment includes a voltage comparison/decision circuit section 150A for each group of voltage supply lines Lv (i.e., one voltage comparison/decision circuit section 150A for the first voltage supply line Lv1 and one voltage comparison/decision circuit section 150A for the second voltage supply line Lv2 in the structure shown in FIG. 9), as shown in FIG. 10. The voltage comparison/decision circuit section 150A includes at least a voltmeter 151, a constant current source 152, and a connection path changeover switch 153. The voltage comparison/decision circuit section 150A switches/controls the connection path changeover switch 153 based on a comparison control signal supplied from the system controller 160 to connect the voltage supply line Lv connected thereto to the constant current source 152 or the power driver 130.

Although a detailed description will be given later, the voltage comparison/decision circuit section 150A first controls the connection path changeover switch 153 to connect the voltage supply line Lv to the constant current source 152 in the correction data acquisition operation period. Using the constant current source 152, a current (reference current) Iref_x equal to an expected value in a preset predetermined gradation (x-gradation, for example) is supplied so as to flow in the direction of the data driver 140 from the voltage comparison/decision circuit section 150A via the voltage supply line Lv, a specific display pixel PIX (the pixel drive circuit DC), and a data line Ld. In this manner, a potential difference (reference voltage) Vref_x generated between voltage supply line Lv (or output contact point of the voltage comparison/decision circuit section 150A) and data line Ld connected to the specific display pixel PIX (or output contact point of the data driver 140) is measured by the voltmeter 151.

Next, the connection path changeover switch 153 is controlled to connect the voltage supply line Lv to the power driver 130, and an adjustment voltage Vadj generated by changing (modulating) a voltage value by the voltage adjusting circuit 144 is applied to the specific display pixel PIX (the pixel drive circuit DC) via the data line Ld. In this manner, a potential difference (detected voltage) Vdet generated between the voltage supply line Lv (or output contact point of voltage comparison/decision circuit section 150A) and the data line Ld connected to the specific display pixel PIX (output contact point of the data driver 140) is measured by the voltmeter 151.

Then, the voltage comparison/decision circuit section 150A compares a voltage value of the measured reference voltage Vref_x and a voltage value of the detected voltage Vdet, and outputs a magnitude relationship (comparison decision result) to the offset voltage generating circuit 143 of the data driver. During a writing operation, the connection path changeover switch 153 is controlled so that the voltage supply line Lv and the power driver 130 are connected to each other, and neither measurement of a potential difference between the voltage supply line Lv and data line Ld described above nor voltage comparison processing is carried out.

A description will now be given of an example of a specific configuration of the voltage comparison/decision circuit section 150A with respect to FIGS. 11A, 11B, and 11C.

Figure 11A:
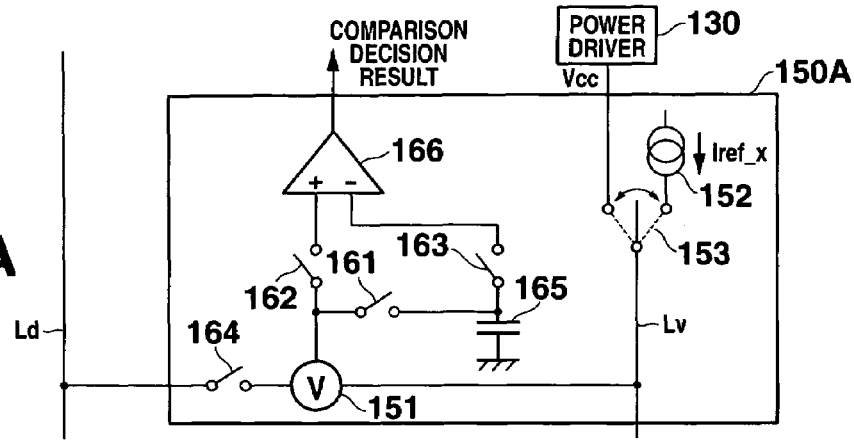
FIGS. 11A, 11B, and 11C are schematic diagrams, each of which shows an example of a configuration of a voltage comparison/decision circuit section in the first embodiment.

The voltage comparison/decision circuit section 150A, for example, as shown in FIG. 11A includes: the voltmeter 151; changeover switches 161, 162, 163, and 164; a voltage holding capacitor 165; and a comparator 166 forming a voltage comparison circuit. In this case, in a state in which the changeover switch 164 is conductive, the reference current Iref_x described above flows into the specific display pixel PIX. In a state in which the changeover switches 162 and 163 are open and changeover switch 161 is conductive, measurement of the reference voltage Vref_x is carried out by the voltmeter 151. Then, a voltage value of the reference voltage Vref_x measured by the voltmeter 151 is applied to the capacitor 165 and is held there. In a state in which the changeover switches 162 and 163 are conductive and the changeover switch 161 is opened, measurement of the detected voltage Vdet is carried out by the voltmeter 151. A voltage value of the measured detected voltage Vdet is applied to one input terminal of the comparator 166; the voltage value of the reference voltage Vref_x held in the capacitor 165 is applied to the other input terminal of the comparator 166; and a comparison of a magnitude relationship between the reference voltage Vref_x and the detected voltage Vdet is carried out by the comparator 166.

Figure 11B:
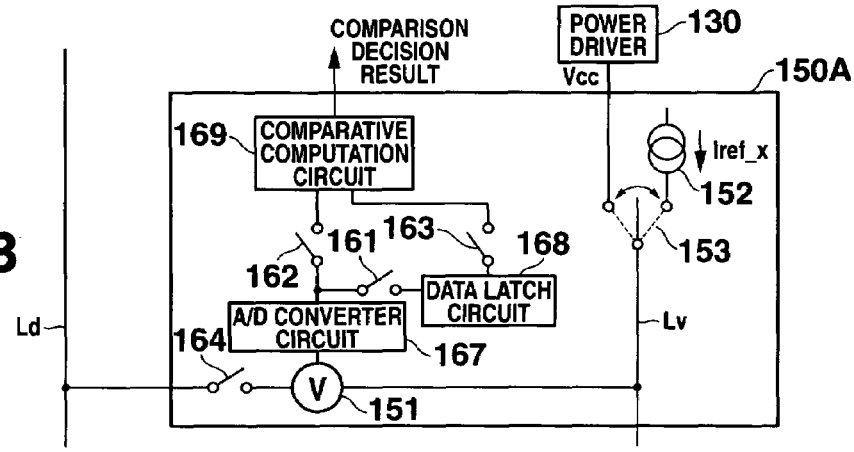
Figure 11C:
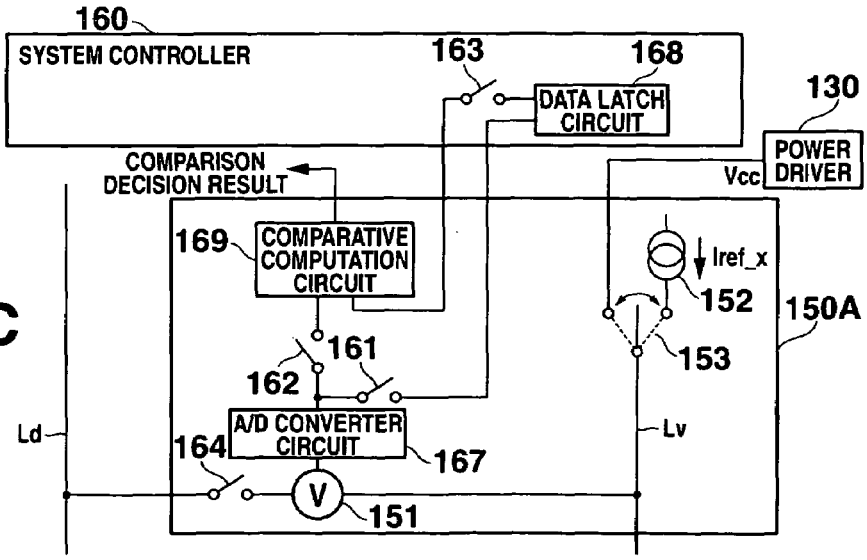

The voltage comparison/decision circuit section 150A may alternatively have the structure shown in FIG. 11B, which includes: the voltmeter 151; the changeover switches 161, 162, 163, and 164; an A/D converter circuit 167; a data latch circuit 168; and a comparative computation circuit 169 forming a voltage comparison circuit. The operation of this voltage comparison/decision circuit section 150A shown in FIG. 11B is basically similar to the operation of the first exemplary configuration shown in FIG. 11A, but is different therefrom in that the voltage values measured by the voltmeter 151 are converted to digital values, and then a comparison is carried out by means of computation between digital values. In other words, after the flowing of reference current Iref_x has been carried out in a state in which the changeover switch 164 is conductive, in a state in which the changeover switches 162 and 16.3 are opened and the changeover switch 161 is conductive, the measurement of reference voltage Vref_x is carried out by the voltmeter 151. Then, the measured voltage value is converted to a digital value by the A/D converter circuit 167, and then the converted digital value is latched by the data latch circuit 168. Next, in a state in which the changeover switches 162 and 163 are conductive and the changeover switch 161 is opened, measurement of the detected voltage Vdet is carried out by the voltmeter 151. The measured voltage value is converted to a digital value by the A/D converter circuit 167 and then the converted digital value is applied to one input terminal of the comparative computation circuit 169. The digital value of the reference voltage Vref_x that has been latched by the data latch circuit 168 is applied to the other input terminal of the comparative computation circuit 169 and then a comparative computation of the magnitude relationship between a voltage value of reference voltage Vref_x and a voltage value of detected voltage Vdet is carried out by the comparative computation circuit 169.

In the configuration shown in FIG. 11B, the data latch circuit 168 is provided in voltage comparison/decision circuit section 150A. This latch circuit may alternatively be provided, for example, in the system controller 160. FIG. 11C shows an exemplary configuration of this structure. In this case, the voltage value of the reference voltage Vref_x measured by the voltmeter 151 and converted to a digital value by the A/D converter circuit 167 is sent to the system controller 160, and then the voltage value is latched by the data latch circuit 168 in the system controller 160. Then, the value latched by the data latch circuit 168 is sent to the comparative computation circuit 169 in the voltage comparison/decision circuit section 150A, and then a comparative computation is carried out, as is the case with the structure of FIG. 11B.

,As described above, it is preferable that the voltage comparison/decision circuit section 150A include the changeover switch 164 to cut off connection between the data line Ld and the voltmeter 151 and that the changeover switch 164 be opened so as to release connection between data line Ld and the voltmeter 151 during the writing operation.

(System Controller)

The system controller 160 generates and outputs a selection control signal, a power control signal, a data control signal, and a comparison control signal for controlling an operating state, to the selection driver 120, the power driver 130, the data driver 140, and the comparison/decision circuit section 150 (the voltage comparison/decision circuit section 150A in FIG. 10), respectively, so as to operate the drivers with a predetermined timing to generate and output selection signal Ssel, power voltage Vcc, adjustment voltage Vadj, and correction gradation voltage Vpix, each of which has a predetermined voltage level. Further, the system controller 160 executes a series of drive control operations (correction data acquisition operation, writing operation, holding operation, and light emitting operation) relative to the display pixels PIX (the pixel drive circuits DC) and controls performing display on the display area 110 of image information that is based on a video signal.

The display signal generating circuit 170 extracts a luminance gradation signal component from a video signal supplied from outside of the display device 100, for example, and then supplies the luminance gradation signal component to the data driver 140 as display data (luminance gradation data) including a digital signal for each row of the display area 110. When the video signal includes a timing signal component that specifies a display timing of image information as in a television broadcast signal (composite video signal), the display signal generating circuit 170 may be configured to extract the timing signal component and supply the extracted component to the system controller 160 in addition to extracting the luminance gradation signal component. In this case, the system controller 160 generates control signals to be individually supplied to the selection driver 120, the power driver 130, the data driver 140, and the comparison/decision circuit section 150, based on a timing signal supplied from the display signal generating circuit 170.

<Method of Driving Display Device>

A description will now be given of a method for driving a display device according to the present embodiment.

A drive control operation of the display device 100 according to the present embodiment roughly includes a correction data acquisition operation of detecting, for each of the display pixels PIX, the offset voltage Vofst (strictly, the detected voltage Vdet) corresponding to a fluctuation of element characteristics (threshold voltage) of the transistor Tr13 (driving transistor) for driving of a display pixel PIX (the pixel drive circuit DC) arranged in the display area 110, and then storing an offset setting value Minc for generating the offset voltage Vofst as correction data in the frame memory 145 corresponding to each of the display pixels PIX. The drive control operation also includes a display drive operation of correcting an original gradation voltage Vorg corresponding to display data, for each of the pixels, based on the correction data acquired by display pixels PIX, writing correction gradation voltages Vpix into display pixels PIX to hold a voltage component, and then supplying to the organic EL elements OLED light emission drive currents Iem having a current value corresponding to display data compensated for an effect of the fluctuation of element characteristics of the transistor Tr13 of the corresponding pixel, based on the voltage component, and then, emitting light at a predetermined luminance gradation.

The correction data acquisition operation and display drive operation are executed based on a variety of control signals supplied from the system controller 160.

Specific details of these two operations are described below.

(Correction Data Acquisition Operation)

The correction data acquisition operation in the display device according to the present embodiment will be described with respect to FIGS. 12, 13 and 14.

Figure 12:
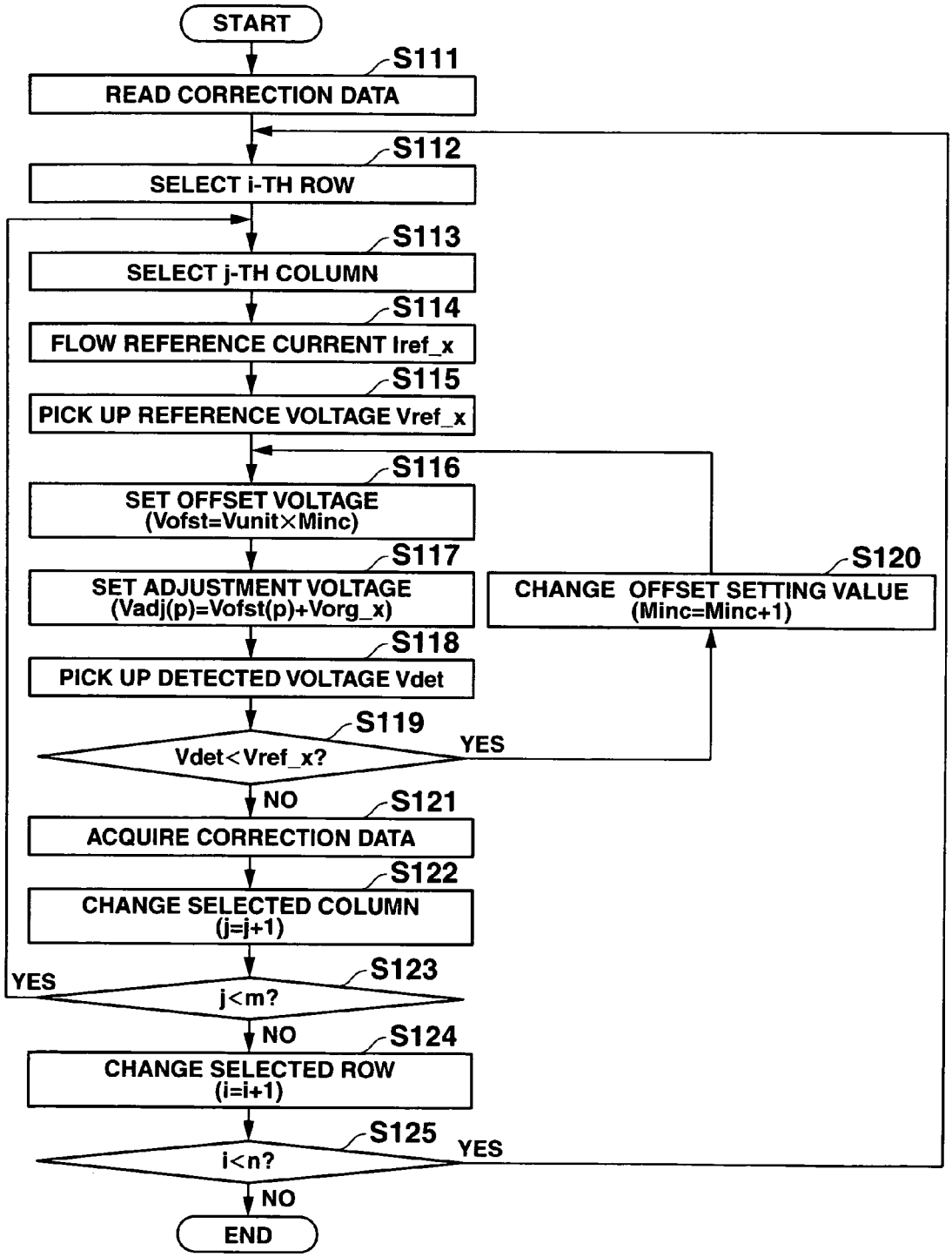
FIG. 12 is a flow chart showing an example of a correction data acquisition operation in the display device according to the first embodiment.

With respect to the correction data acquisition operation according to the present embodiment, first, as shown in FIG. 12, the offset voltage generating circuits 143 are caused to read an offset setting value Minc (Minc=0 during an initial state) for each of the display pixels PIX of an i-th row (positive integer, $1 \leqq i \leqq n$) from the frame memory 145 via the shift register/data register circuit 141, for example (step S111). (As noted below, this need not be the first step in the correction data acquisition operation.) That is, each offset voltage generating circuit 143 reads the offset setting value Minc for the display pixel PIX in the i-th row in the column corresponding to the offset voltage generating circuit 143. Thereafter, a selection signal Ssel of a selection level (high level) is applied to the selection scan line Ls of the i-th row from the selection driver 120, to set the display pixels PIX of the i-th row to a selected state (step S112). In this manner, display pixels PIX of the i-th row are set to a selected state, in which the transistors Tr11 provided in each pixel drive circuit DC of the display pixels PIX of the i-th row is turned ON, and the transistor Tr13 (driving transistor) in each pixel drive circuit DC of the display pixels PIX of the i-th row is set to a diode connected state Next, as shown in FIG. 13, the potential of data line Ld of a j-th column is set to be lower than the potential of the voltage supply line Lv for the i-th row by the voltage adjusting circuit 144 connected via a data line Ld to the display pixels PIX of the j-th column (positive integer, $1 \leqq j \leqq m$) so that current flowed from the voltage comparison/decision circuit section 150A flows via the data line of the j-th column in step S114, described later. At this time, the current flowed from the voltage comparison/decision circuit section 150A is prevented from flowing into data lines Ld other than the data line Ld of the j-th column. Therefore, for example, data lines Ld each are designed to establish a floating state in the voltage adjusting circuit 144 provided in each data line Ld other than the data line Ld of the j-th column.

Then, the potential of voltage supply line Lv is applied to a drain terminal and a gate terminal (the contact point N11 and one end of the capacitor Cs) of the transistor Tr13 and the transistor Tr13 is turned ON. A source terminal of the transistor Tr13 (the contact point N12 and the other end of the capacitor Cs) is electrically connected to data line Ld, and then reference current Iref_x described later flows.

Next, in the voltage comparison/decision circuit section 150A individually provided in voltage supply line Lv (which is either the first voltage supply line Lv1 or second voltage supply line Lv2 connected in common to all of display pixels PIX of group in which the i-th row is included, in the present embodiment), the connection path changeover switch 153 is controlled so that voltage supply line Lv is connected to the constant current source 152. Then, reference current Iref_x, which is set to be equal to a target EL drive current (expectation current) produced by voltage when writing display data having a predetermined gradation (x-gradation, for example) into the display pixel PIX, is forcibly flowed from the constant current source 152 to the display pixel PIX, which is set to the selected state and is provided in the j-th column, via voltage supply line Lv (step S114).

Therefore, the current voltage of the drain-source current Ids_x of the transistor Tr13 provided in the display pixel PIX (the pixel drive circuit DC) at the i-th row and the j-th column is equal to that of reference current Iref_x regardless of whether the transistor Tr12 and the transistor Tr13 have a V-I characteristic line SPw in an initial state or a V-I characteristic line SPw2 after being shifted by a threshold voltage change amount ΔVth (refer to FIG. 4A). In addition, at this time, it is preferable that the reference current Iref_x be normalized at a high speed to a target current value and have a greater current value than the maximum luminance gradation or its proximal gradation.

In this state, the potential difference (reference voltage) Vref_x between the voltage supply line Lv (or the constant current source 152) and the data line Ld of the j-th column (in other words, the data line Ld connected to the display pixel PIX at the i-th row and the j-th column or output terminal of the voltage adjusting circuit 144) is measured by the voltmeter 151 in the voltage comparison/decision circuit section 150A (step S115). The measured reference voltage Vref_x measured here is changed as a resistance of the transistor Tr12 and a resistance the transistor Tr13, between the respective drains and sources of which the reference current Iref_x flows, become higher.

It should be noted that the step S111 of reading the offset setting value Minc for the offset voltage generating circuit 143 may follow any one of step S112, step S113, step 114 or step S115.

Reference voltage Vref_x is affected by the extent of advancement of V-I characteristic line SPw2 after a threshold voltage Vth shown in FIG. 4A has been shifted at the gate-source (or drain-source) voltage Vgs of the diode-connected transistor Tr13 and the extent of advancement of V-I characteristic line SPw2 after a threshold voltage Vth has been shifted at gate-source voltage Vgs of the transistor Tr12. In other words, if the shifting of threshold voltage Vth advances at the transistor Tr13 and the transistor Tr12 (if Vth increases by a change amount ΔVth), the reference voltage Vref_x is lowered. The measured reference voltage Vref_x may be temporarily saved in a register or the like in the voltage comparison/decision circuit section 150A, for example.

Next, a power voltage (first power voltage) Vcc (=Vccw≦reference voltage Vss), having a low potential serving as a writing operation level, from the power driver 130 is applied to the voltage supply line Lv connected to the display pixels PIX of the i-th row (in this embodiment, the voltage supply line Lv connected in common to all display pixels PIX of a group in which the i-th row is included). Then, in this state, the offset voltage Vofst is set as shown in formula (11), based on the offset setting value Minc inputted to the offset voltage generating circuit 143 provided corresponding to the data line Ld of the j-th column (step S116).

Offset voltage Vofst generated in the offset voltage generating circuit 143 is calculated by the multiplying offset setting value Minc by the unit voltage Vunit (Vofset=Vunit×Minc). Thus, at the initial time, when no threshold shift has occurred, the offset setting value Minc=0 is outputted from the frame memory 145, whereby the initial value of offset voltage Vofst is set to 0 V.

The voltage adjusting circuit 144 adds the offset voltage Vofst outputted from the offset voltage generating circuit 143 and the original gradation voltage Vorg_x corresponding to the predetermined gradation (x-gradation) outputted from the gradation voltage generating circuit 142 based on display data, as shown in formula (13) to generate adjustment voltage Vadj (p) and then applies the generated adjustment voltage to the data line Ld of the j-th column (step S117).

$$Vadj(p)=Vofst(p)+Vorg_x \quad (13)$$

Variable p of Vadj (p) and Vofst (p) denotes the offset setting count in the correction data acquisition operation and denotes a natural number, which sequentially increases in accordance with a change of an offset setting value described later. Therefore, Vofst (p) is a variable serving as a negative value having an absolute value that increases as p increases, and Vadj (p) is a variable serving as a negative value having an absolute value that increases in accordance with a value of Vofst (p), namely, as "p" increases.

In this state, a potential difference (detected voltage) Vdet between the voltage supply line Lv (or output terminal of the power driver 130) and the data line Ld of the j-th column (or output terminal of the voltage adjusting circuit 144), i.e., a differential voltage (Vccw−Vadj (p)) between the power voltage Vcc (=Vccw) having a low potential and the adjustment voltage Vadj (p) is measured by the voltmeter 151 in the voltage comparison/decision circuit section 150A (step S118).

In the voltage comparison/decision circuit section 150A, a magnitude of the reference voltage Vref_x measured in step S115 by equipment such as the comparator described above and the magnitude of the detected voltage Vdet measured in step S118 are compared with each other. For example, it is compared whether or not the detected voltage Vdet is lower than the reference voltage Vref_x (step S119).

In this comparison processing, when the detected voltage Vdet is lower than the reference voltage Vref_x, if the adjustment voltage Vadj (p) were defined as the correction gradation voltage Vpix as it is, and if the voltage were applied to the data line Ld during the writing operation, a current corresponding to the gradation to be displayed cannot be flowed between the drain and source of the transistor Tr13 due to the influence of the threshold shift indicated by the V-I characteristic line SPw2 of the transistor Tr12 and the transistor Tr13. On the other hand, a current at a gradation lower than the gradation to be displayed can flow between the drain and source terminals of the transistor Tr13.

Thus, if the detected voltage Vdet is lower than the reference voltage Vref_x, the voltage comparison/decision circuit section 150A (such as comparator) outputs to the counter of the offset voltage generating circuit 143 a comparison decision result indicating that the detected voltage Vdet is lower than the reference voltage Vref_x (for example, a positive voltage signal), and the counter value of the counter of the offset voltage generating circuit 143 increases (counts up) by one.

When the counter of the offset voltage generating circuit 143 counts up by one, the offset voltage generating circuit 143 adds 1 to the value of offset setting value Minc (step S120), repeats step S116 again based on the incremented offset setting value Minc, and then generates Vofst (p+1). Therefore, Vofst (p+1) is obtained as a negative value satisfying formula (14).

$$Vofst(p+1)=Vofst(p)+V\text{unit} \quad (14)$$

Steps S117, S118, S119, S120 and S116 are repeated until the detected voltage Vdet becomes equal to or greater than reference voltage Vref_x in step S119.

In step S119, when detected voltage Vdet is equal to or greater than reference voltage Vref_x, the voltage comparison/decision circuit section 150A (such as comparator) outputs to the counter of the offset voltage generating circuit 143 a comparison decision result indicating that the detected voltage Vdet is equal to or greater than the reference voltage Vref_x (for example, a negative voltage signal), and the counter value of the counter of the offset voltage generating circuit 143 is not increased.

The counter of the offset voltage generating circuit picks up the comparison decision result from the voltage comparison/decision circuit section 150A at a predetermined frequency. If the comparison decision result indicating that the detected voltage Vdet is equal to or greater than the reference voltage Vref_x (negative voltage signal) is picked up by the counter, the offset voltage generating circuit 143 determines that adjustment voltage Vadj (p) has corrected the threshold shift of the V-I characteristic line SPw2 of the transistor Tr12 and the transistor Tr13. Then, the offset setting value Minc is defined as correction data for the display pixel PIX so that the adjustment voltage Vadj (p) is defined as the correction gradation voltage Vpix applied to data line Ld, and the correction data is outputted to the shift register/data register circuit 141 (step S121).

After the correction data has been acquired for the display pixel PIX at the i-th row and the j-th column (after the correction data has been outputted to the shift register/data register circuit 141), a process for incrementing the variable "j" for specifying a column (j=j+1) is executed. The incremented column number "j" is compared to the total number of columns "m" and it is determined whether or not the incremented variable "j" is smaller than the total column number "m" set to the display area 110 (j<m) (step S123).

At step S123, when it is determined that variable "j" is smaller than the number of columns "m" (j<m), the processes from step S113 through step S123 described above are executed again to obtain the correction data for the next display pixel PIX in the i-th row (i.e., the display pixel PIX at the next column (j+1-th column) and the i-th row) (step S122). The processing is repeatedly executed until variable "j" is determined to be equal to column number "m" (j=m) so as to obtain the correction data for all of the display pixels PIX in the i-th row.

In step S123, when it is determined that variable "j" is equal to column number "m" (j=m), it is assumed that an offset setting value Minc serving as correction data has been outputted to the shift register/data register circuit 141 for all the display pixels PIX in the i-th row. These items of correction data are sequentially transferred to the frame memory 145 by the shift register/data register circuit 141, and then the transferred data is individually stored in a predetermined storage area.

After correction data has been acquired for all of the display pixels PIX of the i-th row as described above, a process for incrementing variable "i" for specifying a row (i=i+1) is executed. The incremented row number "i" is compared with the total number of rows "n" and it is determined whether or not the incremented variable "i" is smaller than the total number of rows "n" in the display area 110 (i<n) (step S125).

At step S125, when it is determined that variable "i" is smaller than row number "n" (i<n), the processes from step S112 to step S125 described above are executed again to obtain the correction data for all of the display pixels PIX in the next (i+1-th row) (step S124). The processing is repeatedly executed until variable "i" is determined to be equal to row number "n" (i=n) so as to obtain the correction data for all of the display pixels PIX.

In step S125, when it is determined that variable "i" is equal to row number "n" (i=n), a correction data acquisition operation for the display pixels PIX in reach row has been executed for all of the rows of the display area 110. Then, it is assumed that correction data of display pixels PIX has been individually stored in a predetermined storage area of the frame memory 145, and the correction data acquisition operation described above is terminated.

During either the correction data acquisition operation described above or a writing operation described below, the frame memory 145 outputs the stored offset setting values Minc to the offset voltage generating circuits 143 in each column via the shift register/data register circuit 141.

In addition, during the correction data acquisition operation described above, potentials of terminals of display pixels PIX (the pixel drive circuit DC) satisfy relationships of formula (3) through formula (10). Therefore, no current flows to the organic EL element OLED and no light emitting operation occurs.

Figure 13:
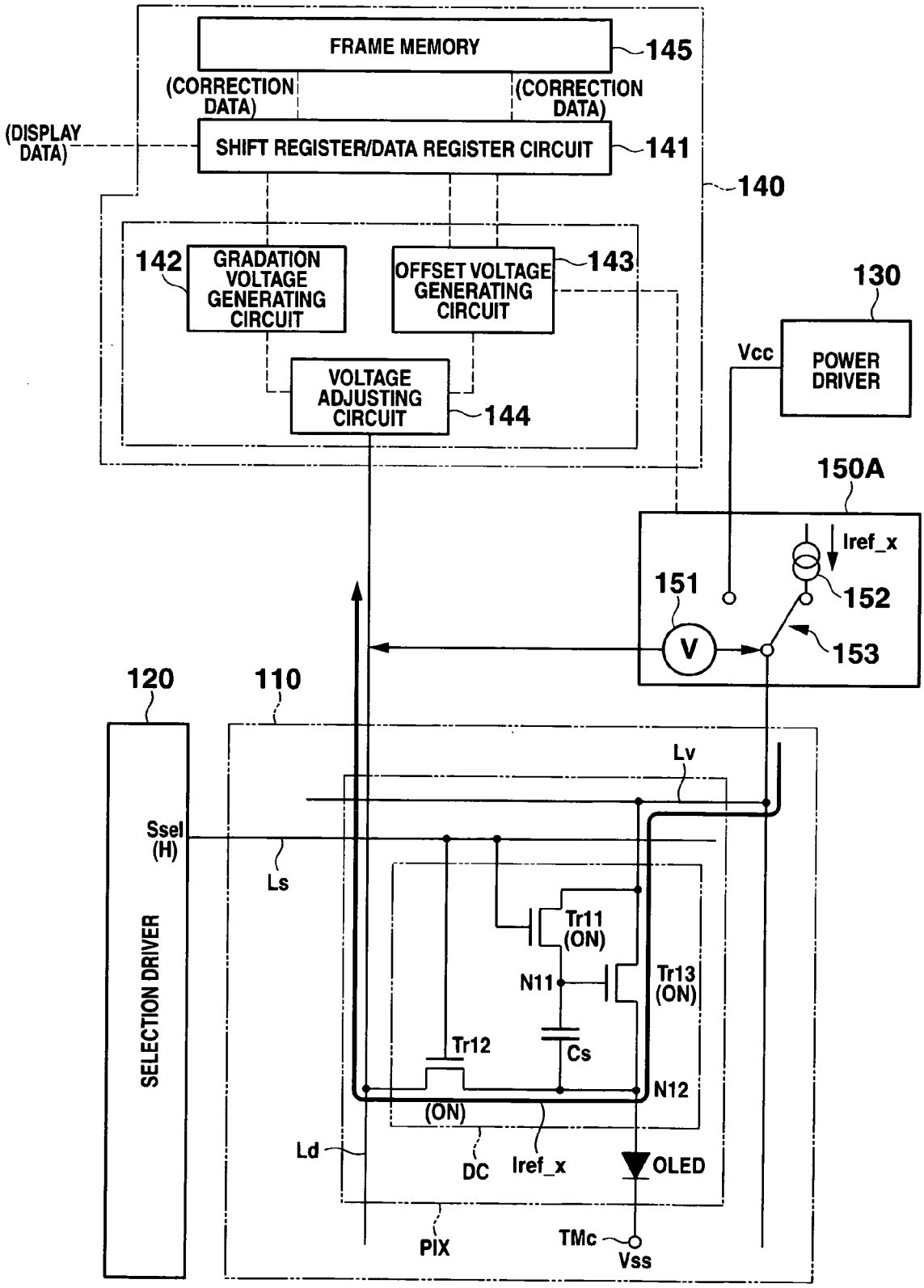
FIG. 13 is a conceptual view showing an example of the correction data acquisition operation in the display device according to the first embodiment.
Figure 14:
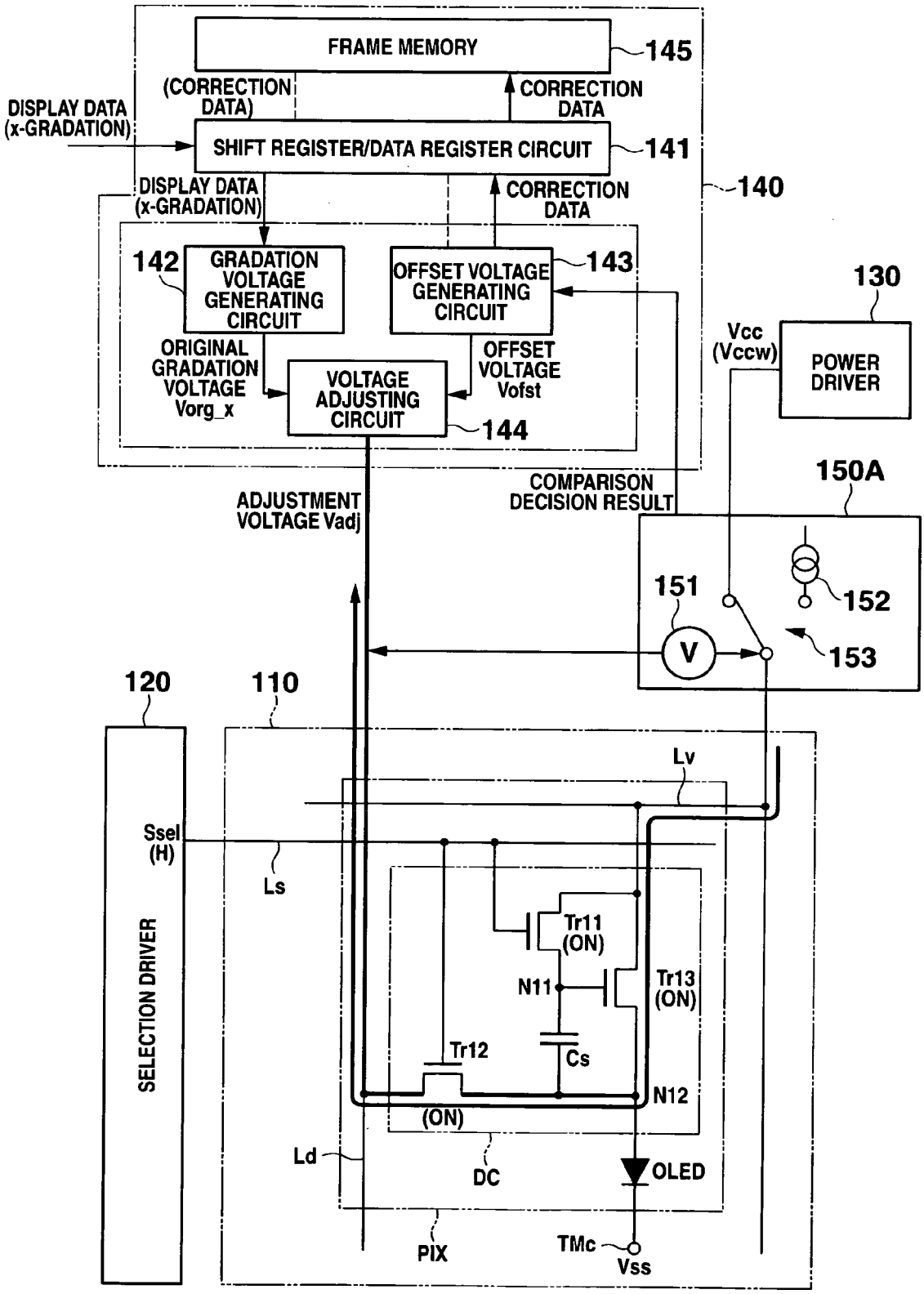
FIG. 14 is a conceptual view showing an example of the correction data acquisition operation in the display device according to the first embodiment.

As described above, during the correction data acquisition operation, as shown in FIG. 13, the constant current source 152 is connected to the voltage supply line Lv, and then a voltage (reference voltage Vref_x) between the voltage supply line Lv and the data line Ld is measured. Then, as shown in FIG. 14, the power driver 130 is connected to the voltage supply line Lv, and then a voltage difference (detected voltage Vdet) between the voltage supply line Lv and the data line Ld is compared to the reference voltage Vref_x. Based on the comparison decision result, if the drain-source current Ids_x of the transistor Tr13 at x-gradation according to V-I characteristic line SPw in an initial state is defined as an expected value, the adjustment voltage Vadj is set for flowing a drain-source current Ids of the transistor Tr13 that is approximated to the expected value during the writing operation. Then, offset setting value Minc in the offset voltage Vofst is defined as correction data, and the correction data is saved in the frame memory 145.

If the voltage adjusting circuit 144 generates adjustment voltage Vadj (p) produced by adding offset voltage Vofst (p) having a negative potential according to offset setting value Minc from the offset voltage generating circuit 143 and original gradation voltage Vorg_x having a negative potential of x-gradation from the gradation voltage generating circuit 142 as shown in formula (13), and then adjustment voltage Vadj (p) is corrected so as to approximate drain-source current Ids_x of the expected value of the transistor Tr13 during the writing operation, the offset setting value Minc for generating this adjustment voltage Vadj (p) is saved in the frame memory 145 as correction gradation voltage Vpix applied to data line Ld.

Therefore, according to the correction data acquisition operation, one voltage comparison/decision circuit section 150A is provided to each voltage supply line Lv connected in common to each group of the display pixels PIX arranged in the display area 110 (upper area or lower area in FIG. 9). Then, by measuring and mutually comparing potential differences (reference voltage Vref_x and detected voltage Vdet) between the data line Lv and the voltage supply line Lv when reference current Iref_x is flowed from the constant current source 152 to the display pixels PIX and when adjustment voltage Vadj is applied, offset setting values Minc corresponding to change amounts of the threshold voltages of the transistors Tr13 (driving transistor) provided in the display pixels PIX (in the pixel drive circuits DC) are sequentially acquired (plotting sequential operation), so that the acquired data can be stored in the frame memory 145 to correspond to the display pixels PIC.

In the correction data acquisition operation described above, the original gradation voltage Vorg_x is generated by the gradation voltage generating circuit 142 based on display data for display pixels PIX supplied from the display signal generating circuit 170. However, by defining the original gradation voltage Vorg_x for adjustment as a fixed value, the fixed value may be set so that the gradation voltage generating circuit 142 outputs it instead of supplying generating the original gradation voltage Vorg_x based on display data from display signal generating circuit 170. It is preferable that the original gradation voltage Vorg_x to be used to generate the adjustment voltage, as described previously, have a specific potential such that reference voltage Iref_x is obtained as a current allowing the organic EL element OLED to emit light at the maximum luminance gradation (or gradation in the vicinity thereof) during the light emitting operation. That is, it is preferable that the original gradation voltage Vorg_x to be used to generate the adjustment voltage have a value to cause the organic EL element OLED to emit light at a maximum gradation (or gradation in the vicinity thereof).

In addition, the present embodiment is directed to a current drawing type display device in which the drain-source current Ids of the transistor Tr13 flows from display the transistor Tr13 to the data driver 140, and thus the unit voltage Vunit is a negative value. However, for a current push type display device in which the drain-source current Ids of the transistor flows from a data driver to a transistor connected in series to the organic EL element OLED, the unit voltage Vunit is set to a positive value. In this case, the reference current Iref_x is set so that it is drawn by the constant current source 152 provided at the voltage comparison/decision circuit section 150A.

(Display Driving Operation)

A display driving operation in a display device according to the present embodiment will now be described with respect to FIG. 15.

Figure 15:
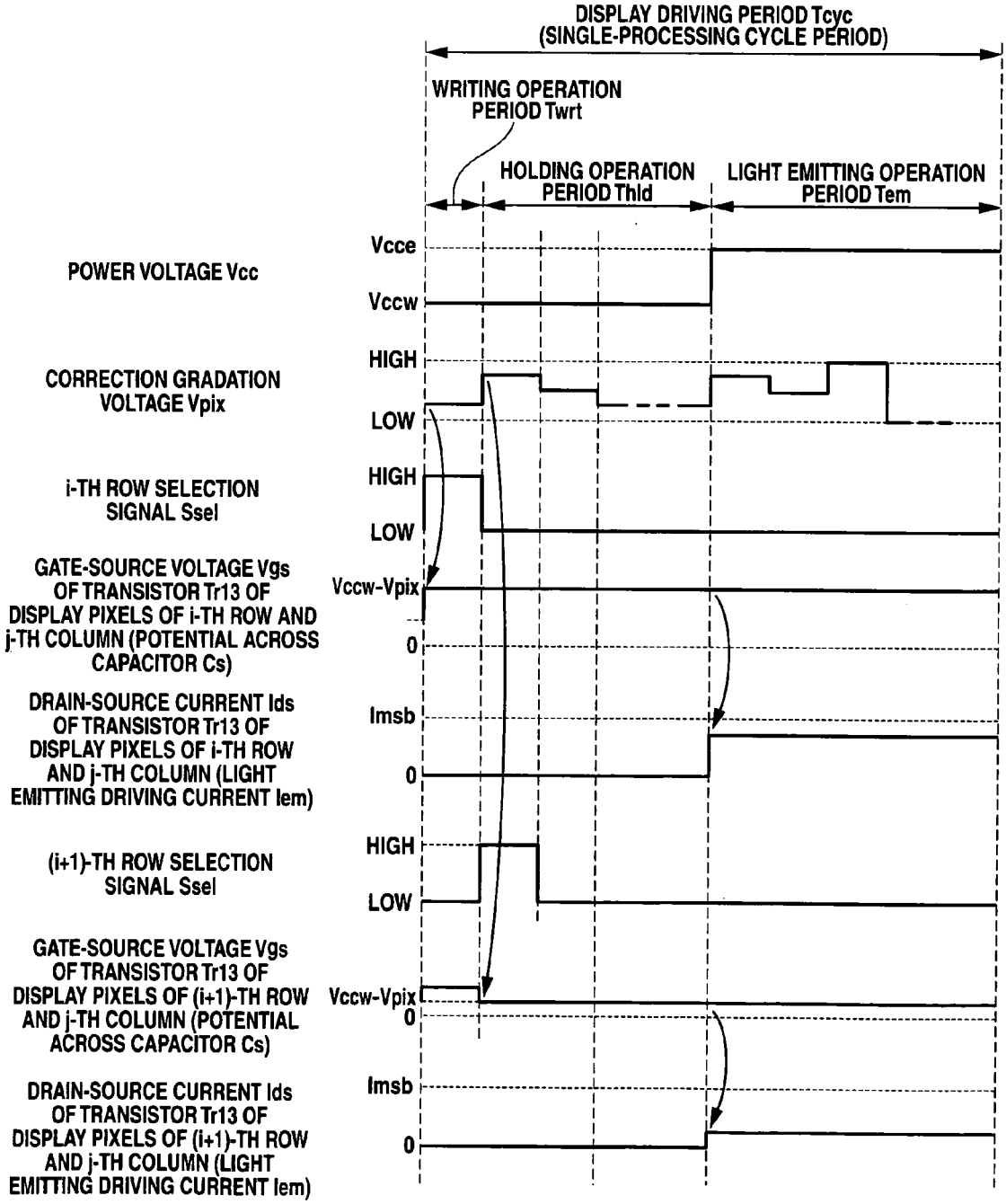
FIG. 15 is a timing chart showing an example of a display driving operation in the display device according to the first embodiment.

For clarity, the timing chart shown in FIG. 15 is limited to the signals for operating the display pixel PIX at the i-th row and the j-th column and the display pixel PIX at the (i+1)-th row and the j-th column to emit light at a luminance gradation corresponding to display data, among the display pixels PIX arranged in a matrix shape in the display area 110.

With respect to the display driving operation of the display device 100 according to the present embodiment, for example, as shown in FIG. 15, in display pixels PIX of a group of either the upper area or the lower area of the display area 110 including the i-th row and (i+1)-th row, offset voltages Vofst generated by setting the correction data stored in the frame memory 145 as offset setting values Minc are added to original gradation voltages Vorg corresponding to display data for display pixels PIX supplied from at least the display signal generating circuit 170 during a predetermined display driving period (single processing cycle period) Tcyc to generate correction gradation voltages Vpix. Then, the generated voltages are applied to display pixels PIX of the i-th row, for example, via data lines Ld. The display driving operation includes, for each pixel: a writing operation (writing operation period Twrt) of flowing a writing current based on the correction gradation voltage Vpix (drain-source current Ids of the transistor Tr13); a holding operation of charging to and holding in the capacitor Cs a voltage component corresponding to the correction gradation voltage Vpix, namely, an electric charge to an extent that the transistor Tr13 flows a writing current (holding operation period Thld), the voltage component being set and written between the gate and source of the transistor Tr13 in the pixel drive circuit DC of the display pixel PIX by the writing operation; and a light emitting operation of into the organic EL element OLED a light emitting driving current Iem having a current value corresponding to display data, after the influence of fluctuation of element characteristics of the transistor Tr13 has been compensated for, based on the voltage component held by the capacitor Cs by the holding operation, flowing into the organic EL element OLED light emitting driving current Iem having a current value corresponding to display data, and then emitting light at a predetermined luminance gradation (light emitting operation period Tem) (Tcyc ≧Twrt +Thld Tem).

A single processing cycle period applied to display driving period Tcyc according to the present embodiment is set to a period required for one display pixel PIX to display image information for one pixel among a single-frame image. In other words, when a single-frame image is displayed in the display area 110 in which a plurality of display pixels PIX are arranged in matrix in a row direction and a column direction, the single-processing cycle period Tcyc is set to a period required for display pixels PIX for one row to display an image for one row among the single-frame image.

(Writing Operation)

In the writing operation (writing operation period Twrt), as shown in FIG. 15, first, in a state in which a power voltage (first power voltage) Vcc (=Vccw≦reference voltage Vss) having a low potential that is at a writing operation level is applied to the voltage supply line Lv connected to the display pixels PIX of an i-th row, as in the writing operation of the pixel circuit DCx described above, the selection signal Ssel having a selection level (high level) is applied to selection scan line Ls of the i-th row, to set the display pixels PIX of the i-th row to a selected state, in which the transistor Tr11 (holding transistor) and the transistor Tr12 in the pixel drive circuit DC are turned ON, and in which the transistor Tr13 (driving transistor) is set to a diode-connected state. The power voltage Vcc is applied to a drain terminal and a gate terminal of the transistor Tr13 and a source terminal thereof is connected to the data line Ld.

Correction gradation voltages Vpix corresponding to display data are applied to the data lines Ld in synchronism with this timing. The correction gradation signal Vpix is generated based on a series of processing operations (gradation voltage correction operation) as shown in FIG. 16, for example.

Figure 16:
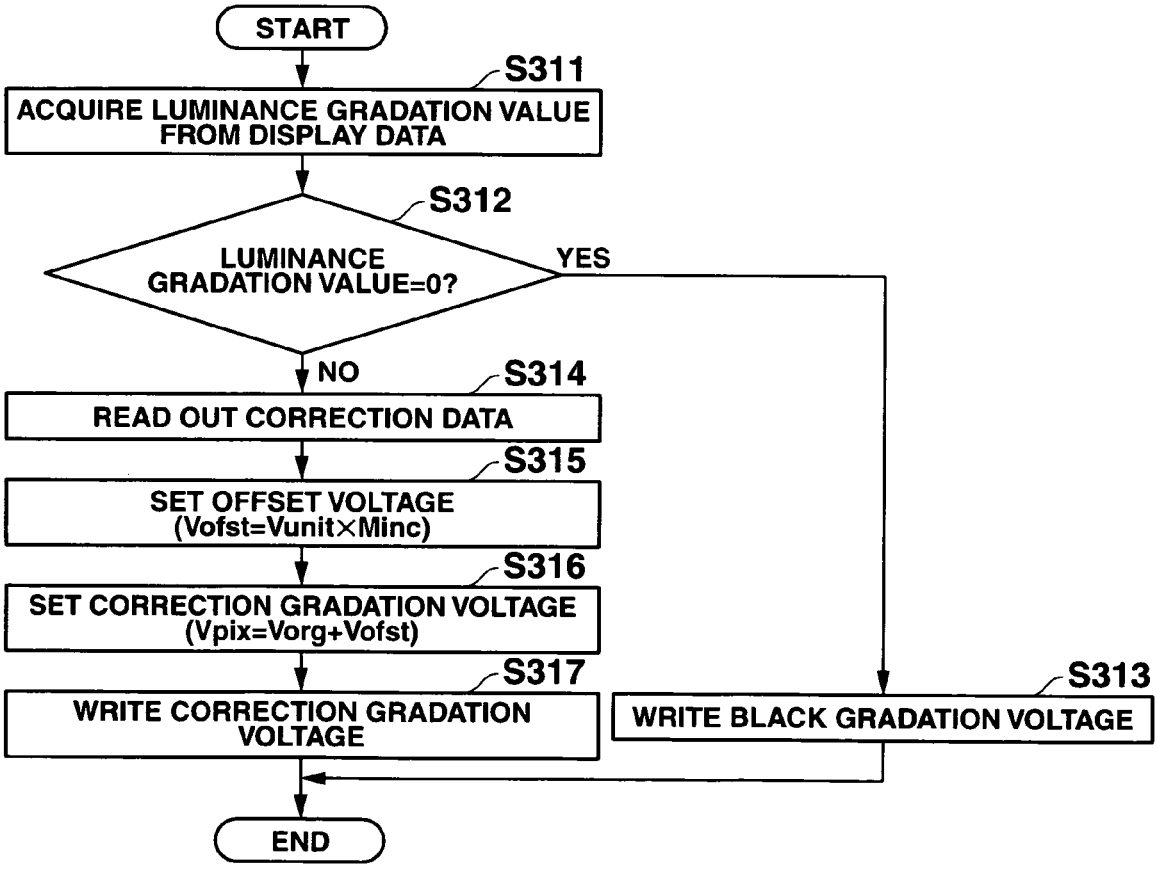
FIG. 16 is a flow chart showing an example of a writing operation in the display device according to the first embodiment.

As shown in FIG. 16, first, the display data supplied from the display signal generating circuit 170 is picked up via the shift register/data register circuit 141, and is transferred to the gradation voltage generating circuits 142 provided corresponding to the columns of display pixels PIX (data lines Ld)

Then, in each of the gradation voltage generating circuits 142, a luminance gradation value (luminance gradation data) for the display pixel PIX in the column targeted for a writing operation (set to a selected state) is acquired from the display data (step S311), and it is determined whether or not the luminance gradation value is "0" (step S312).

If the luminance gradation value is "0", a predetermined gradation voltage (black gradation voltage) Vzero for carrying out a no-light emitting operation (or black display operation) is outputted from the gradation voltage generating circuit 142 and is applied to the data line Ld as it is, without adding an offset voltage Vofst in the voltage adjusting circuit 144 (namely, without carrying out a compensation processing relative to the fluctuation of the threshold voltage of the transistor Tr12 and the transistor Tr13) (step S313). Gradation voltage Vzero for a no-light emitting operation is set to a voltage value (−Vzero<Vth−Vccw) having a relationship (Vgs<Vth) such that the voltage Vgs (≈Vccw−Vzero) applied between the gate and source terminals of the diode-connected transistor Tr13 is lower than the threshold voltage Vth of the transistor Tr13 and is lower than the threshold voltage after the fluctuation (Vth0+ΔVth, where Vth0 is threshold voltage at the time of initial state of the transistor Tr13). It is preferable that the gradation voltage Vzero be equal to Vccw in order to restrain fluctuation of the threshold voltage Vth of transistors Tr12 and Tr13.

On the other hand, if the luminance gradation value is not "0", an original gradation voltage Vorg is generated and outputted from the gradation voltage generating circuit 142. The original gradation voltage has a voltage value corresponding to the luminance gradation value. Correction data stored corresponding to the selected display pixels PIX in the frame memory 145 is sequentially read out via the shift register/data register circuit 141 (step S314), and is outputted to the offset voltage generating circuits 143corresponding respectively to the data lines Ld of the columns. In each of the offset voltage generating circuits 143, the received correction data (offset setting value Minc) is multiplied by unit voltage Vunit to generate offset voltage Vofst (=Vunit×Minc), which corresponds to a change amount of the threshold voltage of the transistor Tr13 of the selected display pixel PIX (the pixel drive circuit DC) in the column for which the offset voltage generating circuit 143 is provided (step S315).

Figure 17:
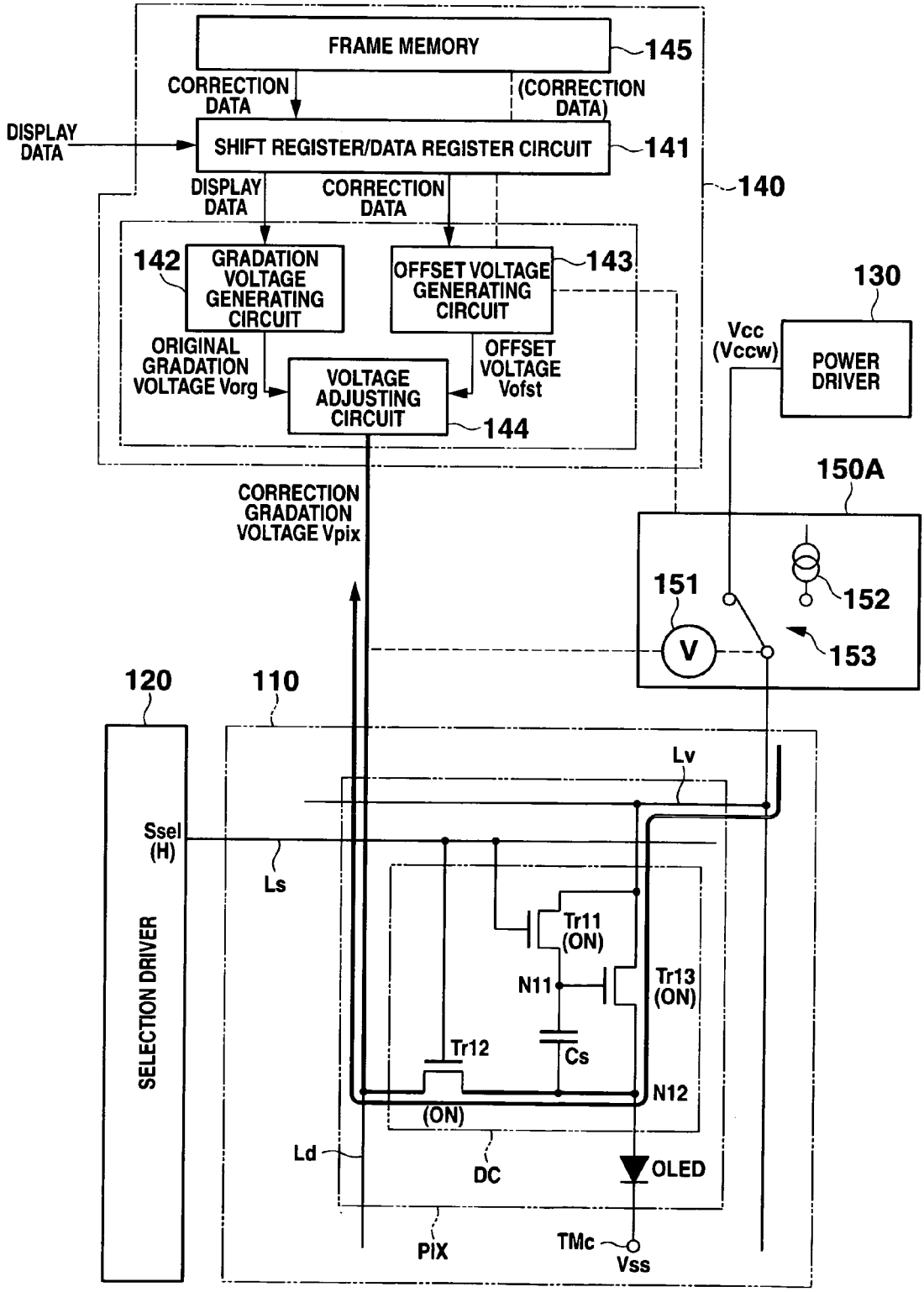
FIG. 17 is a conceptual view showing a writing operation in the display device according to the first embodiment.

Then, as shown in FIG. 17, at each of the voltage adjusting circuits 144, the original gradation voltage Vorg having a negative potential, which is outputted from the gradation voltage generating circuit 142 to the voltage adjusting circuit 144, and offset voltage Vofst having a negative potential, which is outputted from the offset voltage generating circuit 143 to the voltage adjusting circuit 144, are added so as to satisfy formula (12), and then correction gradation voltage Vpix having a negative potential is generated (step S316) and is applied to the data line Ld. Correction gradation voltage Vpix generated in the voltage adjusting circuit 144 is set to have a voltage amplitude of a relatively negative potential around the power voltage Vcc (=Vccw) having a low potential of writing operation level that is applied to the voltage supply line Lv from the power driver 130. In other words, the correction gradation voltage Vpix is lower at the negative potential side (absolute value of voltage amplitude increases) as the gradation increases.

In this manner, as shown in FIG. 17, for each of the selected display pixels PIX, the correction gradation voltage Vpix, which is obtained by correcting the original gradation voltage Vorg by adding the threshold voltage Vth of the transistor Tr13 or the offset voltage Vofst corresponding to threshold voltage (Vth0+ΔVth), is applied to the source terminal of the transistor Tr13 of the display pixel PIX (the pixel drive circuit DC) set to the selected state. Thus, voltage Vgs (=Vccw−Vpix) corresponding to the correction gradation voltage Vpix is written and set between the gate and source terminals of the transistor Tr13 (across the capacitor Cs) (step S317). In such a writing operation, a desired voltage is directly applied to a gate terminal and a source terminal of the transistor Tr13 instead of flowing a current corresponding to display data and setting a voltage component, so that the potentials of terminals or contact points can be set quickly at a predetermined state.

In this writing operation period Twrt as well, a voltage value of the correction gradation voltage Vpix applied to the contact point N12 at the anode terminal side of the organic EL element OLED is set so as to be lower than the reference voltage Vss applied to the cathode terminal TMc (namely, the organic EL element OLED is set to a backward bias state). Thus, no current flows to the organic EL element OLED, and no light emitting operation occurs.

(Holding Operation)

Figure 18:
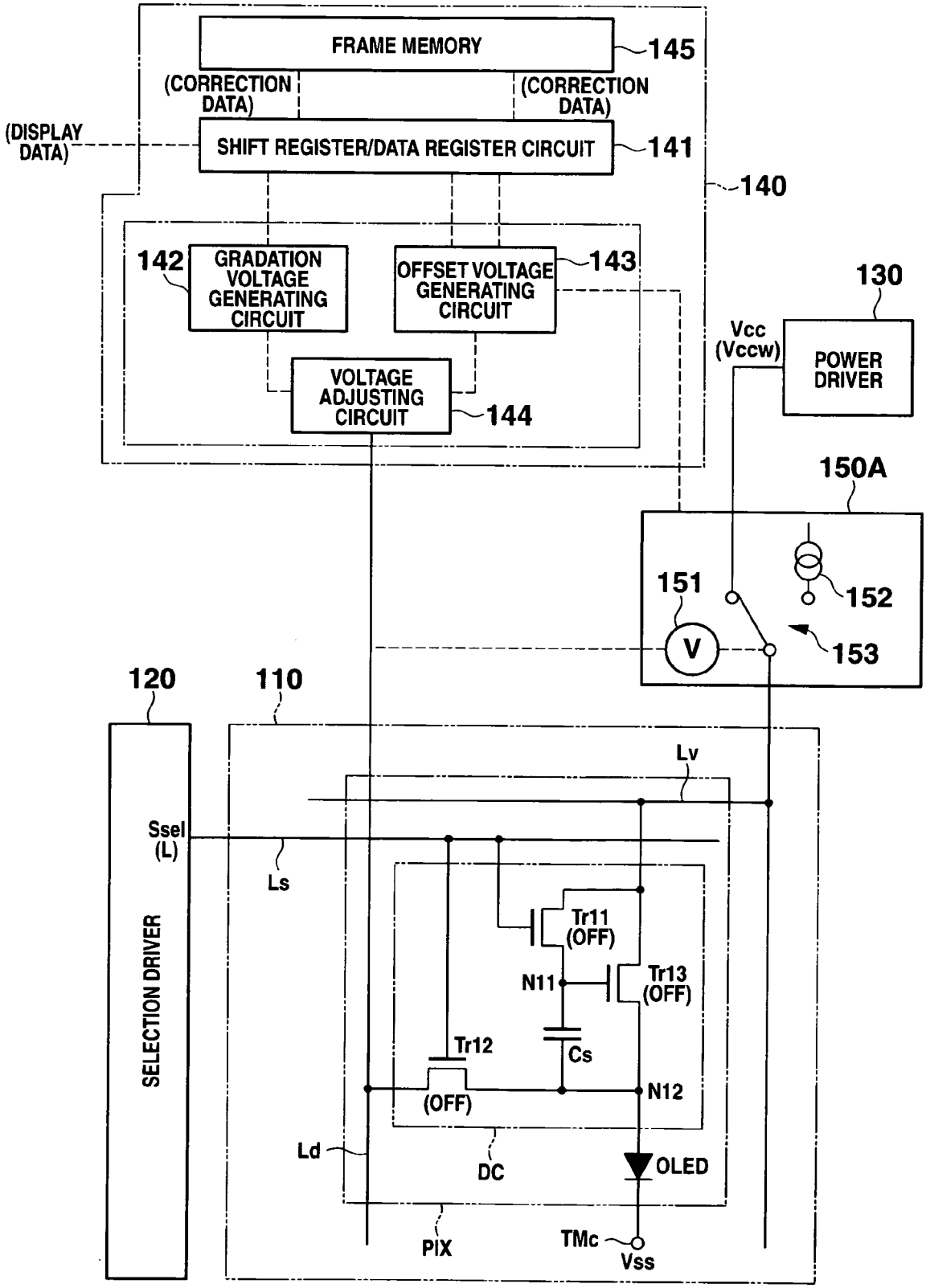
FIG. 18 is a conceptual view showing a holding operation in the display device according to the first embodiment.

In a holding operation after the completion of the writing operation period Twrt as described above (holding operation period Thld), as shown in FIG. 15, a selection signal Ssel having a non-selection level (low level) is applied to the selection scan line Ls of the i-th row, whereby, as shown in FIG. 18, the transistors Tr11 and Tr12 are turned OFF, and a diode-connection state of the transistor Tr13 is released. In addition, the application of the correction gradation voltage Vpix to the source terminal (contact point N12) of the transistor Tr13 is shut down. Then, a voltage component applied between the gate and source terminals of the transistor Tr13 (across the capacitor Cs), i.e., a voltage component that has been compensated by threshold voltage Vth or threshold voltage (Vth0+ΔVth) after fluctuation is charged and held.

In the driving method of the display device according to the present embodiment, as shown in FIG. 15, selection signals Ssel having the selection level (high level) are sequentially applied with different timings from the selection driver 120 to the selection scan lines Ls after (i+1)-th row in holding operation period Thld after the writing operation described above has terminated relative to display pixels PIX of the i-th row. As such, writing operations of writing correction gradation voltage Vpix corresponding to display data are sequentially executed in the same manner as described above by rows relative to display pixels PIX after (i+1)-th row. Therefore, in a holding operation period Thld of display pixels PIX of the i-th row, a holding operation is continued until voltage components (correction gradation voltages Vpix) are sequentially written, the components corresponding to display data, to display pixels PIX of any other row of a group in which the i-th row is included.

(Light Emitting Operation)

In a light emitting operation after the completion of a writing operation and a holding operation (light emitting operation period Tem), as shown in FIG. 15, in a state in which a selection signal Ssel having the non-selection level (low level) is applied to the selection scan lines Ls a group of the selection scan lines Ls including the i-th row, a power voltage (second power voltage) Vcc (=Vcce>Vss) having a higher potential (positive voltage) than reference voltage Vss, so as to be at a light emitting operation level, is applied to voltage supply line Lv connected in common to the display pixels PIX of the rows of the group.

Figure 19:
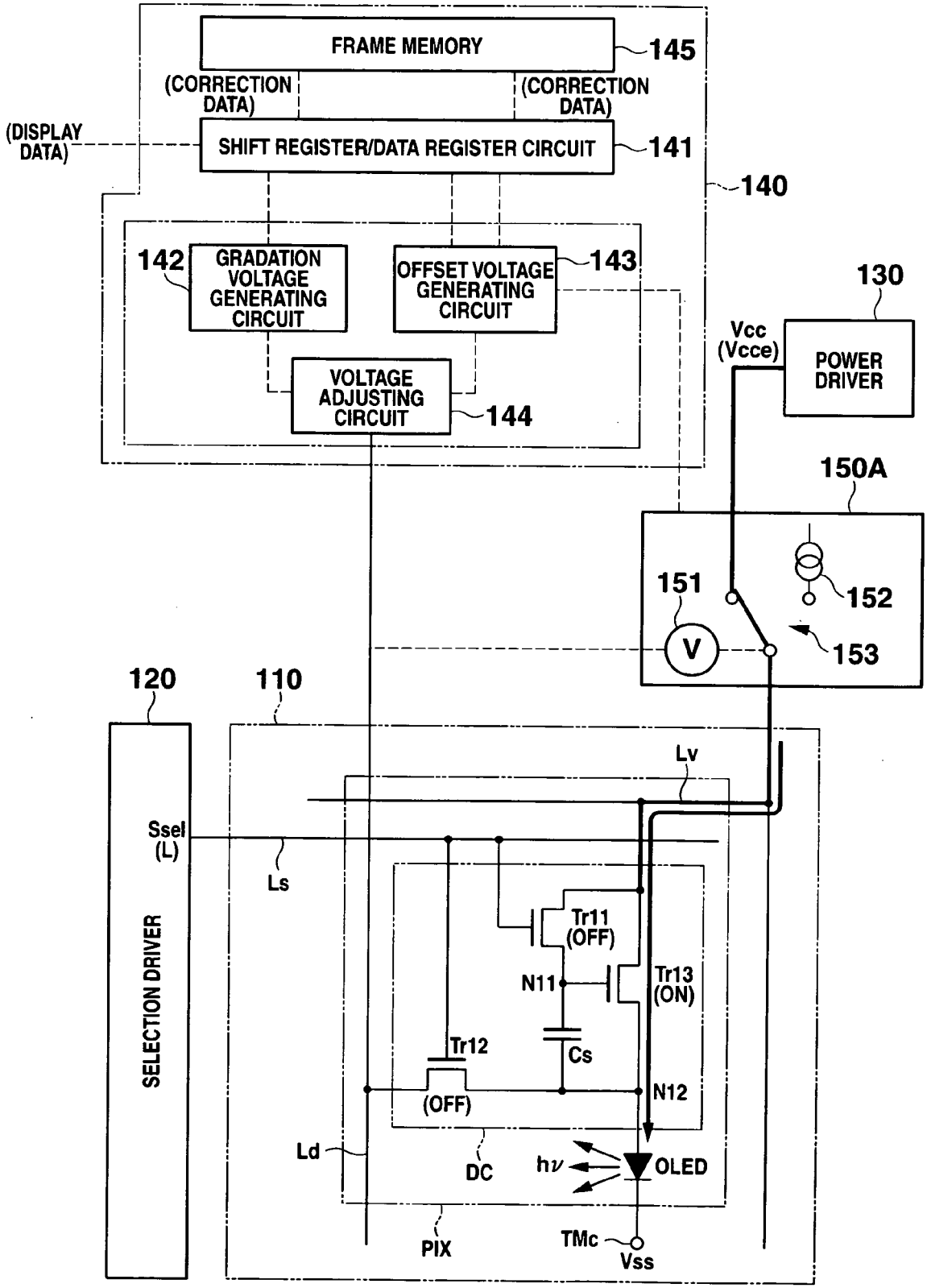
FIG. 19 is a conceptual view showing a light emitting operation in the display device according to the first embodiment.

Power voltage Vcc (=Vcce) having a high potential applied to the voltage supply line Lv, as is the case shown in FIGS. 7A and 7B and FIGS. 8A and 8B, is set such that a potential difference Vcce−Vss is greater than a sum of a saturated voltage (pinch-off voltage Vpo) of the transistor Tr13 and a driving voltage (Voled) of the organic EL element OLED, and thus the transistor Tr13 operates in a saturated area. In addition, a positive voltage corresponding to a voltage component (|Vpix−Vccw|) written and set between the gate and source terminals of the transistor Tr13 is applied to the anode side (the contact point N12) of the organic EL element OLED by the writing operation. On the other hand, reference voltage Vss (grounding potential, for example) is applied to the cathode terminal TMc. In this manner, the organic EL element OLED is set to a forward bias state. Thus, as shown in FIG. 19, light emitting driving current Iem (drain-source current Ids of the transistor Tr13) flows to the organic EL element OLED through the transistor Tr13 from voltage supply line Lv. The light emitting driving current Iem has a current value corresponding to the correction gradation voltage Vpix serving as a gradation voltage corrected to be a gradation corresponding to display data, in other words, in accordance with a threshold voltage Vth of the transistor Tr13 or a threshold voltage (Vth0+ΔVth) after fluctuation, and a light emitting operation occurs at a predetermined luminance gradation.

This light emitting operation is continuously executed until a timing at which the application of power voltage Vcc (=Vccw) having the writing operation level (negative voltage) is started from the power driver 130 in the next display drive period (single-processing cycle period) Tcyc.

Thus, in the display driving operation, as shown in FIG. 15, in a state in which the power voltage Vcc (=Vccw) having the writing operation level is applied to display pixels PIX in rows arranged in the display area 110, operations of writing the correction gradation voltage Vpix for each pixel, and then holding a predetermined voltage component (|Vpix−Vccw|) in each S pixel, are sequentially performed row by row. Thus, light can be emitted from the display pixels PIX of a row by applying power voltage Vcc (=Vcce) having a light emitting operation level to the display pixels PIX of the row on which the writing operation and the holding operation have been terminated.

Second Embodiment

A specific description will now be given with respect to a second embodiment of the display device according to the present invention. Description is omitted or provided only in brief for structural elements and method steps of the second embodiment that are the same as or similar to structural elements or method steps of the first embodiment.

<Display Device>

The display device according to the second embodiment includes a display area 110 (including display pixels PIX), a selection driver 120, a power driver 130, a data driver 140, a system controller 160, and a display signal generating circuit 170, which are substantially identical to those of the first embodiment described above, and a detailed description thereof is omitted.

The description of the first embodiment describes measuring and comparing a voltage component equivalent to gate-source voltage Vgs_x of the transistor Tr13, i.e., a potential difference between voltage supply line Lv and data line Ld (reference voltage Vref_x and detected voltage Vdet) in a state in which a predetermined reference current Iref_x is flowed to a display pixel PIX (the pixel drive circuit DC) via voltage supply line Lv from the constant current source 152 provided in the voltage comparison/decision circuit section 150A and in a state in which predetermined adjustment voltage Vadj is applied from the data driver 140 to the display pixel PIX via data line Ld, as a technique of acquiring correction data (offset setting value) for compensating fluctuation of a threshold voltage of the transistor Tr13 for light emitting driving. The present embodiment, however, applies a technique of acquiring correction data by comparing, by a current comparison circuit, although not shown, a detection current Idet and a predetermined reference current Iref flowing into the display pixel PIX (voltage supply line Lv) in a state in which predetermined adjustment voltage Vadj is applied from the data driver 140 to the display pixel PIX via data line Lv.

The data driver 140 applied to the display device 100 according to the present embodiment, as in the first embodiment described above, includes: the shift register/data register circuit 141; the gradation voltage generating circuit 142; the offset voltage generating circuit 143; and the voltage adjusting circuit 144. The offset voltage generating circuit 143 sequentially increases offset setting values (variables) Minc based on a comparison decision result outputted from the comparison/decision circuit section 150 (the current comparison/decision circuit section 150B in the present embodiment). This generating circuit 143 generates an offset voltage (compensation voltage) Vofst increased and set by unit voltage Vunit, and then extracts, as correction data, the offset setting value Minc used to obtain the offset voltage Vofst, the voltage corresponding to a change amount (equivalent to ΔVth shown in FIG. 4A) of element characteristics (threshold voltage Vth of transistor Tr3) of the driving transistor in a display pixel PIX (element drive circuit DC). On the other hand, in a writing operation of display data, the extracted correction data (offset setting value Minc) is multiplied by unit voltage Vunit, and offset voltage Vofst is generated and outputted to the voltage adjusting circuit 144.

Figure 20:
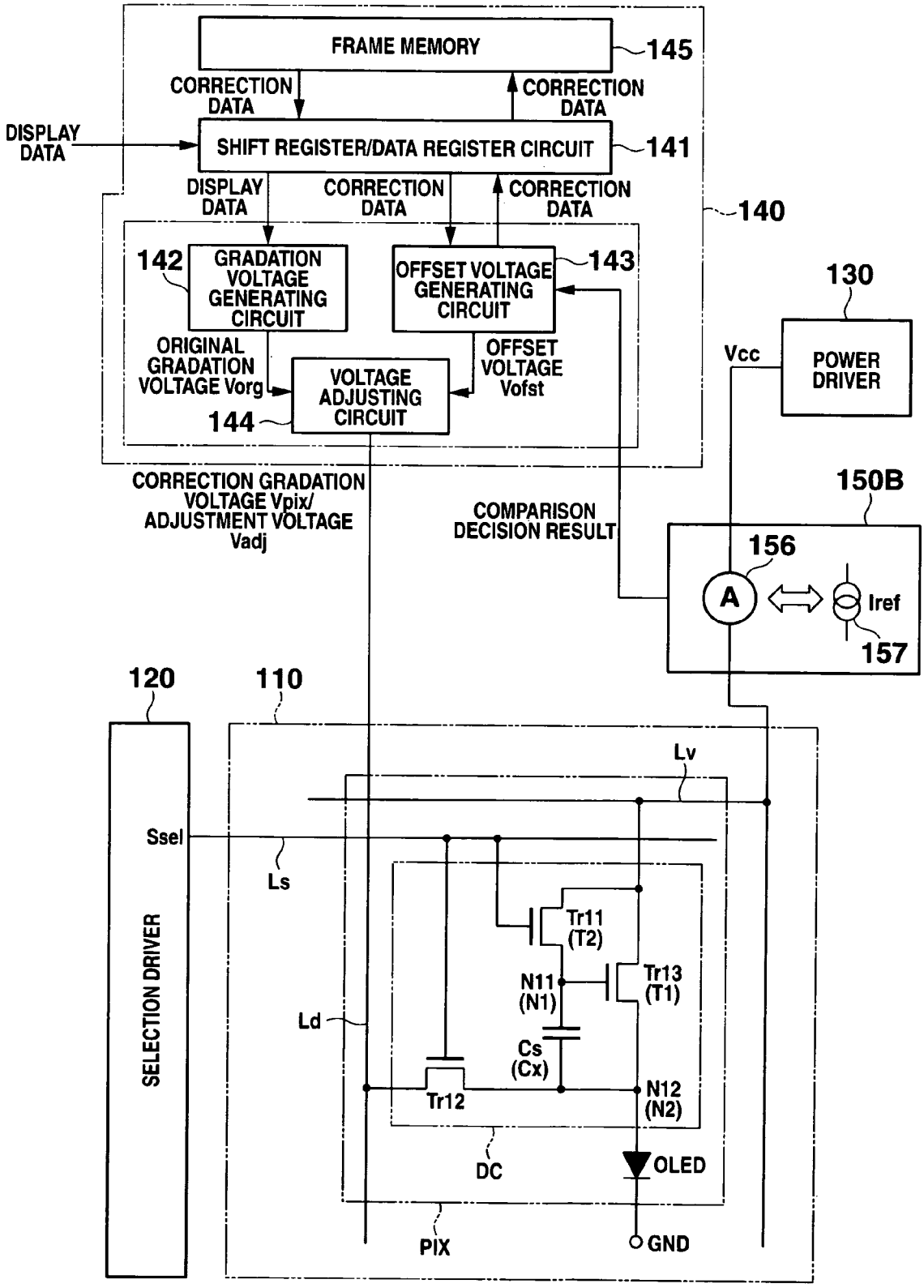
FIG. 20 is a configuration diagram showing an example of a data driver, a comparison/decision circuit section and a display pixel according to a second embodiment.

In addition, the comparison/decision circuit section 150 applied to the display device 100 according to the present embodiment, for example, as shown in FIG. 20, is a current comparison/decision circuit section 150B internally including at least an ammeter 156 and a reference current value memory 157 in which a current value of reference current Iref described later is held. Fluctuation of threshold voltage Vth of the transistor Tr13 of a display pixel PIX (the pixel drive circuit DC) is detected by comparing a current value of detection current Idet measured by the ammeter 156 with a predetermined timing, based on a comparison control signal supplied from the system controller, with a current value of reference current Iref held in the reference current value memory 157.

While a detailed description will be given later, the current comparison/decision circuit section 150B sequentially applies adjustment voltage Vadj generated by changing (modulating) a voltage value by means of the voltage adjusting circuit 144 to specific display pixels PIX (the pixel drive circuit DC) via data lines Ld in a correction data acquisition operation. Then, a current value of a current (detection current Idet) flowing into the data driver 140 via voltage supply line Lv, the display pixel PIX (the pixel drive circuit DC), and data line Ld from the power driver 130 is measured by the ammeter 156 provided at voltage supply line Lv in accordance with a potential difference generated between the adjustment voltage Vadj applied to the data line Ld and the power voltage Vcc (=Vccw) applied to voltage supply line Lv.

The current comparison/decision circuit section 150B compares the current value of the measured detection current Idet with the current value of reference current Iref, which is stored in the reference current value memory 157 and serves as a predetermined current value in a preset predetermined gradation (maximum luminance gradation, for example) (for example, the current value required to cause the organic EL element OLED to emit light at the maximum luminance gradation). Further, the circuit section 150B outputs the magnitude relationship (comparison decision result) to the offset voltage generating circuit 143 of the data driver 140.

During a writing operation, although correction gradation voltage Vpix generated by the voltage adjusting circuit 144 is applied to display pixels PIX via data line Ld, a process is not carried out for measuring and comparing a current flowing into voltage supply line Lv. Thus, for example, at the time of writing operation, it is preferable that voltage supply line Lv be configured so as to bypass the current comparison/decision circuit section 150B. Moreover, the current value of the reference current Iref corresponds to the current value of current Ids flowing between drain and source of the transistor Tr13 of the pixel drive circuit DC, when a voltage obtained by subtracting the unit voltage Vunit from the adjustment voltage Vadj is applied to the data line Ld while initial characteristics are maintained such that the transistor Tr13 of the pixel drive circuit DC is in an initial state and fluctuation of element characteristics due to the drive history hardly occurs. As described in the first embodiment set forth above, when a voltage difference between drain-source voltages Vds corresponding to adjacent gradations is applied as the unit voltage Vunit, the current value of current Ids flowing between the drain and source of the transistor Tr13, in a state in which initial characteristics are maintained, is obtained as a current value of reference current Iref when a gradation voltage lower than adjustment voltage Vadj by one gradation is applied to data line Ld.

Figure 21A:
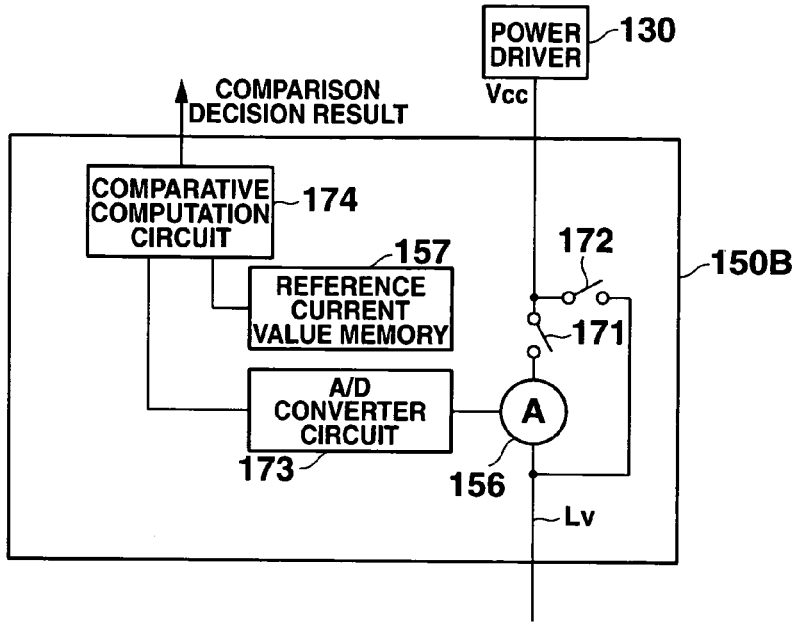
FIGS. 21A and 21B are schematic views each showing an example of a configuration of a current comparison/decision circuit section according to the second embodiment.
Figure 21B:
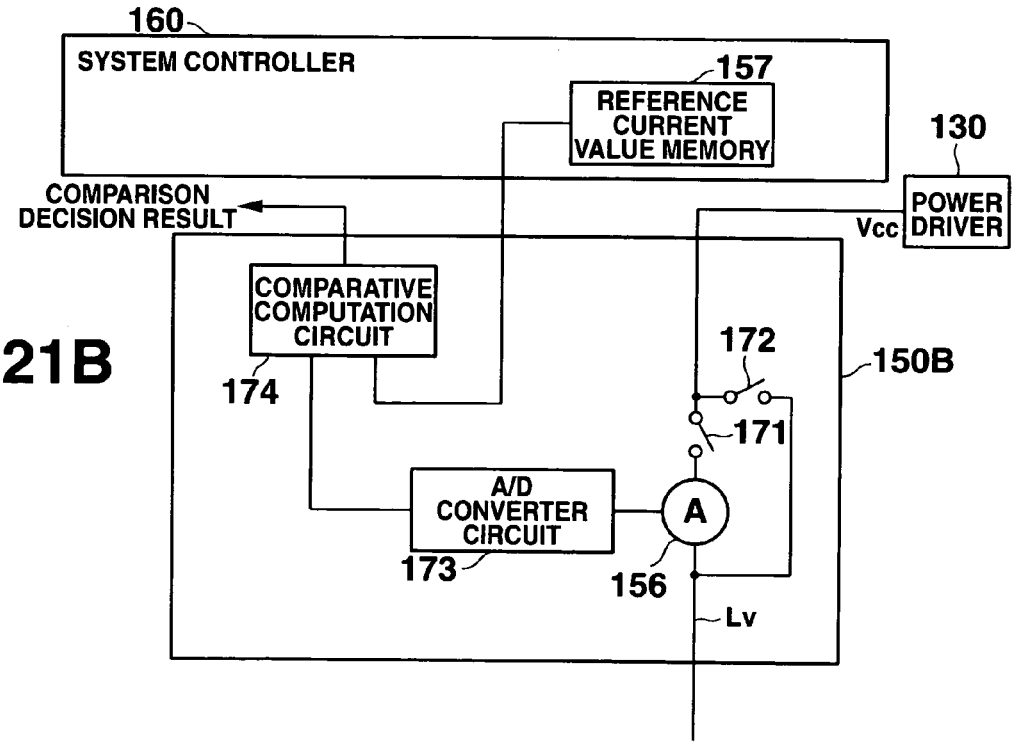

A description will now be given with respect to an example of a specific configuration of the current comparison/decision circuit section 150B. FIGS. 21A and 21B are schematic views each showing an example of a configuration of a current comparison circuit according to the second embodiment.

The voltage comparison/decision circuit section 150B as shown in FIG. 21A, for example, includes: the ammeter 156; changeover switches 171 and 172; the reference current value memory 157; an A/D converter circuit 173; and a comparative computation circuit 174 forming a current comparison circuit. In this case, in a state in which the changeover switch 171 is conductive and the changeover switch 172 is opened, measurement of a current value of a current flowing into the voltage supply line Lv is carried out by the ammeter 156, and the current value of the measured detection current Idet is converted to a digital value by the A/D converter circuit 173 and is applied to one input terminal of the comparative computation circuit 174. The current value of the reference current Iref held in the reference current value memory 157 is applied to the other input terminal of the comparative computation circuit 174. Then, comparison and computation of a magnitude relationship between the current value of the reference current Iref and the current value of the detection current Idet are carried out by the comparative computation circuit 174, and a comparison decision result is obtained.

In the structure shown in FIG. 21A, the reference current value memory 157 is provided in the current comparison/decision circuit section 150B. Alternatively, this memory may be provided in the system controller 160, for example. FIG. 21B shows an exemplary configuration of this structure. In this structure, as described above, the current value of the detection current Idet, which has been converted to a digital value by the A/D converter circuit 173 is applied to one input terminal of the comparative computation circuit 174. Moreover, in the structure shown in FIG. 21B, the current value of reference current Iref is inputted from the reference current value memory 157 in the system controller 160 to the other input terminal of the comparative computation circuit 174. And a comparative computation is carried out in the same manner as described above with respect to FIG. 21A.

In the exemplary configuration of the current comparison/decision circuit section 150B described above, it is assumed that the value of reference current Iref is held in the reference current value memory 157. However, for example, a constant current source flowing a current having a value corresponding to the reference current Iref may be provided in the current comparison/decision circuit section 150B, and this current may be compared with a value of a current flowing into the voltage supply line Lv.

In addition, as described above, the current comparison/decision circuit section 150B includes a changeover switch 171 for inserting the ammeter 156 in the voltage supply line Lv, and a changeover switch 172 for bypassing the voltage supply line Lv from the ammeter 156. During a writing operation, it is preferable that the changeover switch 171 be opened, that the changeover switch 172 be conductive, and that the voltage supply line Lv bypass the current comparison/decision circuit section 150B.

<Drive Control Method of Display Device>

A description will now be given of a driving method for the display device according to the present embodiment.

A drive control operation of the display device 100 according to the present embodiment includes a correction data acquisition operation of detecting, for each of the display pixels PIX arranged in the display area 110, the offset voltage Vofst (strictly, the detection current Idet) corresponding to fluctuation of element characteristics of the transistor Tr13 for driving the display pixel PIX to emit light, and then storing an offset setting value Minc for generating the offset voltage Vofst as correction data in the frame memory 145 to correspond to the display pixel, and a display driving operation. As in the first embodiment described above, the display driving operation includes writing into each of the display pixels PIX the corresponding correction gradation voltage Vpix generated based on the correction data, supplying a in each of the display pixels PIX a light emitting driving current Iem that has been compensated for the influence of fluctuation of element characteristics of the transistor Tr13 provided in the display pixel PIX (the pixel drive circuit DC), and causing the organic EL element OLED to emit light at a luminance gradation corresponding to display data.

(Correction Data Acquisition Operation)

Figure 22:
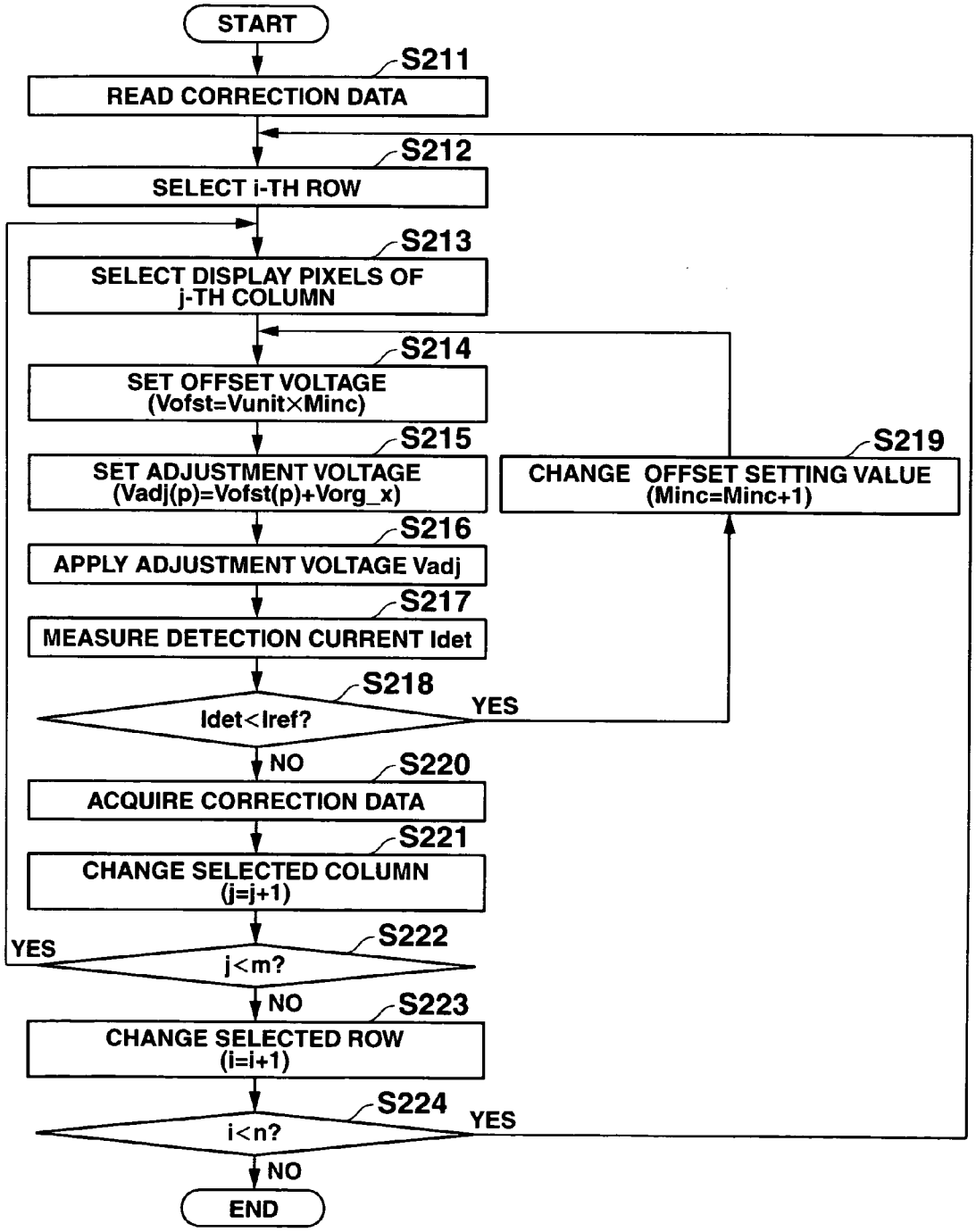
FIG. 22 is a flow chart showing an example of a correction data acquisition operation in the display device according to the second embodiment.

In the correction data acquisition operation according to the present embodiment, first, as shown in FIG. 22, each of the offset voltage generating circuits 143 corresponding to the columns (data lines Ld) is caused to read an offset setting value Minc for a display pixel PIX in an i-th row and in the column of the offset voltage generating circuit from the frame memory 145 (Minc=0 at the time of initial state) via the shift-register/data register circuit 141, for example (step S211). Then, in a state in which power voltage Vcc having a low potential that is a writing operation level from the power driver 130 (=Vccw≦reference voltage Vss: first power voltage) is applied to the voltage supply line Lv connected to the display pixels PIX of the i-th row (the voltage supply line Lv connected in common to all of the display pixels PIX of a group in which the i-th row is included, in the present embodiment), a selection signal Ssel having a selection level (high level) is applied to the selection scan line Ls of the i-th row from the selection driver 120, so as to set the display pixels PIX of the i-th row to a selected state (step S212).

In this manner, display pixels PIX of the i-th row are set to a selected state, and the transistor Tr13 is set to a diode-connected state. Power voltage Vcc (=Vccw) is applied to a drain terminal and a gate terminal of the transistor Tr13 (the contact point N11 and one end of the capacitor Cs) and a source terminal of the transistor Tr13 (the contact point N12 and the other end of the capacitor Cs) is electrically connected to the data line Ld.

At this time, in order to select a pixel at the i-th row and a j-th column for measurement, the other data lines Ld are configured such that the detection current Idet flowing from the power driver 130 (described below) does not flow into the data lines Ld other than the data line Ld of the j-th column. Thus, for example, in the voltage adjusting circuits 144 provided in the data lines Ld other than the data line Ld of the j-th column, the data lines Ld are configured to enter a floating state. (step S213).

Figure 23:
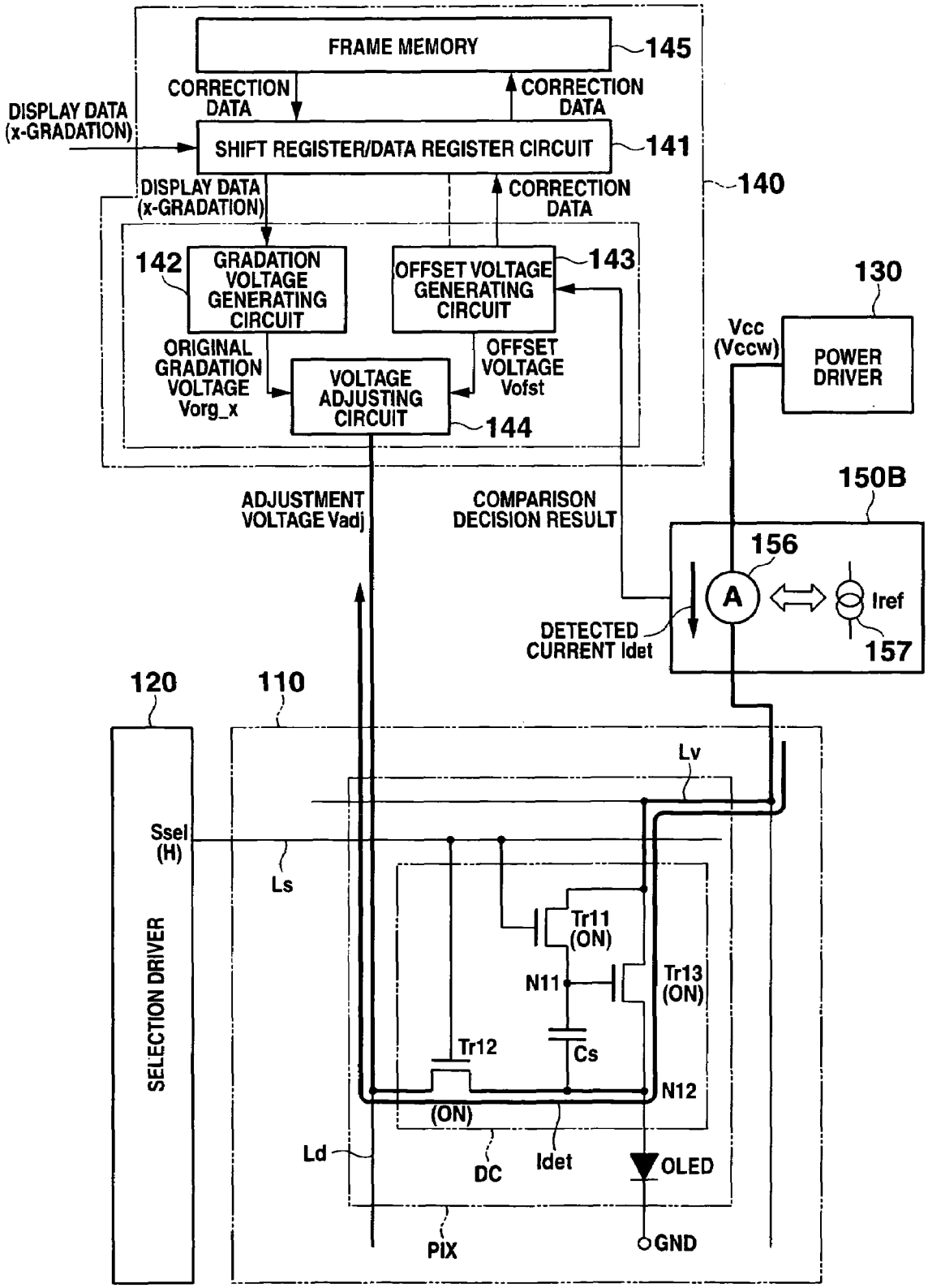
FIG. 23 is a conceptual view showing a correction data acquisition operation in the display device according to the second embodiment.

As shown in FIG. 23, for the display pixel PIX of the i-th row and j-th column, offset voltage Vofst is set as shown in formula (11), based on offset setting value Minc inputted to the offset voltage generating circuit 143 corresponding to data line Ld of the j-th column (step S214). As in the first embodiment described above, offset voltage Vofst generated in the offset voltage generating circuit 143 is calculated by multiplying the offset setting value Minc by the unit voltage Vunit (Vofst=Vunit×Minc). Thus, in the initial state, when no threshold shift has occurred, the offset setting value Minc=0, and the initial value of offset voltage Vofst is obtained as 0 V.

Then, the voltage adjusting circuit 144 adds the offset voltage Vofst outputted from the offset voltage generating circuit 143 and the original gradation voltage Vorg_x of a predetermined gradation (x-gradation) outputted from the gradation voltage generating circuit 142 based on display data, as shown in formula (13) to generate adjustment voltage Vadj (p) (step S215) and applies the generated voltage to the data line Ld of the j-th column (step S216).

In this manner, the adjustment voltage Vadj(p) (=Vofst(p)+Vorg_x) is applied to the source terminal (the contact point N12) of the transistor Tr13 via the transistor Tr12, and power voltage Vccw having a low potential is applied to a gate terminal (the contact point N11) and a drain terminal of the transistor Tr13. Thus, a voltage component (|Vadj(p)−Vccw|) equivalent to a difference between the adjustment voltage Vadj(p) and the power voltage Vccw is applied between the gate and source terminals of the transistor Tr13 (both ends of the capacitor Cs), and the transistor Tr13 is turned ON.

Next, in the state in which the adjustment voltage Vadj is applied from the voltage adjusting circuit 144 to the data line Ld of the j-th column, a value of a current (detection current) Idet flowing into the voltage supply line Lv is measured by the ammeter 156 of the current comparison/decision circuit section 150B that is individually provided at voltage supply line Lv (step S217). With respect to a voltage relationship in the display pixel PIX, the adjustment voltage Vadj applied to the data line Ld has a lower potential than the power voltage Vccw applied to the voltage supply line Lv. Therefore, the detection current Idet flows toward the data driver 140 (the voltage adjusting circuit 144) via the voltage supply line Lv, the display pixels PIX, and the data line Ld from the power driver 130. At this time as explained above, the other data lines Ld are configured such that the detection current Idet flowing from the power driver 130 does not flow into the data lines Ld other than that of the j-th column. Thus, for example, in the voltage adjusting circuits 144 provided in the data lines Ld other than the data line Ld of the j-th column, the data lines Ld are configured to enter a floating state.

In the current comparison/decision circuit section 150B, a current value of the detection current Idet measured by the ammeter 156 is compared with a numeric value (current value of reference current Iref) obtained based on a current flowing in voltage supply line Lv when display pixels PIX (the organic EL element OLED) are caused to emit light at the arbitrary luminance gradation (maximum luminance gradation, for example). For example, the detection current Idet is compared to reference current Iref to determine whether or not detection current Idet is smaller than reference current Iref (step S218).

If an adjustment voltage Vadj (p) that results in the detection current Idet being smaller than the reference current Iref were applied to the data line Ld as a correction gradation voltage Vpix during a writing operation, a current corresponding to the gradation to be displayed cannot be flowed between the drain and source of the transistor Tr13 due to the influence of a threshold shift indicated by V-I characteristic line SPw2 of the transistor Tr12 and the transistor Tr13 and that a current at a lower gradation than the gradation to be displayed will flow between the drain and source of the transistor Tr13.

Thus, if the detection current Idet is smaller than the reference current Iref, the current comparison/decision circuit section 150B outputs to a counter of the offset voltage generating circuit 143 a comparison decision result indicating that the detection current Idet is lower than the reference current Iref (a positive voltage signal, for example) and the counter value of the counter of the offset voltage generating circuit 143 increases (counts up) by one. If the counter of the offset voltage generating circuit 143 counts up by one, the offset voltage generating circuit 143 adds 1 to a value of the offset setting value Minc (step S219), repeats step S214 again based on the added offset setting value Minc, and then, generates Vofst (p+1) that satisfies formula (14).

Steps S215, S216, S217, S218, S219 and S214 are repeated until the detection current Idet is greater than the reference current Iref in step S218.

In step S218, when the detection current Idet is equal to or greater than reference current Iref, the current comparison/decision circuit section 150B outputs to the counter of the offset voltage generating circuit 143 a comparison decision result indicating that the detection current Idet is equal to or greater than the reference current Iref (a negative voltage signal, for example), and the counter value of the counter of the offset voltage generating circuit 143 is not counted up.

If the comparison decision result indicating that the detection current Idet is equal to or greater than the reference current Iref (negative voltage signal) is picked up by the counter, the offset voltage generating circuit 143 determines that adjustment voltage Vadj (p) has corrected the threshold shift indicated by V-I characteristic line SPw2 of the transistor Tr12 and the transistor Tr13. The offset setting value Minc is defined as correction data so that the adjustment voltage Vadj (p) is defined as a correction gradation voltage Vpix to be applied to the data line Ld, and then the correction data is output to the shift register/data register circuit 141 (step S220).

As in the first embodiment described above, after correction data has been acquired for the display pixel PIX at the i-th row and the j-th column described above (after the correction data has been outputted to the shift register/data register circuit 141), a process for incrementing the variable "j" for specifying a column (j=j+1) is executed (step S221), and then, the incremented variable "j" and the total number of columns "m" in the display area 110 are compared with each other to determine whether or not the incremented variable "j" is smaller than the total number of columns "m" (step S222).

In step S222, if it is determined that variable "j" is smaller than column number "m" (j<m), the processes from step S213 through step S222 described above are executed again to obtain the correction data for the next display pixel PIX in the i-th row (i.e., the display pixel PIX at the next column (j+1-th column) and the i-th row). The processing is repeatedly executed until it is determined that variable "j" is equal to column number "m" (j=m) so as to obtain the correction data for all of the display pixels PIX in the i-th row.

When it is determined that variable "j" is equal to column number "m" in step S222 (j=m), it is assumed that offset setting value Minc serving as correction data has been outputted to the shift register/data register circuit 141 for all of the display pixels PIX of the i-th row. Further, these items of correction data are sequentially transferred to the frame memory 145 by the shift register/data register circuit 141, and then are individually stored in a predetermined storage area.

After correction data has been acquired for all of the display pixels PIX of the i-th row as described above, a process (i=i+1) for incrementing variable "i" for specifying a row is executed (step S223), and then the variable "i" and total number of rows "n" in the display area 110 are compared with each other to determine whether or not the incremented variable "i" is smaller than the total number of rows "n" (step S224).

When it is determined that variable "i" is smaller than the total number of rows "n" in step S224 (i<n), the processes from step S212 through step S224 described above are executed again to obtain the correction data for all of the display pixels PIX in the next (i+1-th row). The processing is repeatedly executed until it is determined that variable "i" is equal to row number "n" (i=n) in step S224 so as to obtain the correction data for all of the display pixels PIX.

Then, when it is determined that variable "i" is equal to row number "n" (i=n) in step S224, a correction data acquisition operation for the display pixels PIX in each row has been executed for all of the rows of the display area 110. It is assumed that correction data on display pixels PIX is individually stored in a predetermined storage area of the frame memory 145, and the correction data acquisition operation described above is terminated.

During correction data acquisition operation described above, the potentials of terminals of display pixels PIX (the pixel drive circuit DC) satisfy formula (3) through formula (10) described above. Therefore, no current flows to the organic EL element OLED and no light emitting operation occurs.

As described above, for a correction data acquisition operation, as shown in FIG. 23, a predetermined power voltage Vcc (=Vccw) is applied to the voltage supply line Lv, and then adjustment voltage Vadj is applied to the data line Ld, and a current (detection current Idet) flowing from the power driver 130 via the voltage supply line Lv and the display pixel PIX into the data driver 140 is measured by the current comparison/decision circuit section 150B (the ammeter 156) provided at voltage supply line Lv. Then, the detection current Idet and the predetermined reference current Iref are compared with each other. Based on the comparison decision result, if the drain-source current Ids_x of the transistor Tr13 at x-gradation according to V-I characteristic line SPw in an initial state is defined as an expected value, the adjustment voltage Vadj is set for flowing a drain-source current Ids of the transistor Tr13 that is approximated to the expected value during writing operation, and then offset setting value Minc in the offset voltage Vofst is saved as correction data in the frame memory 145.

Therefore, according to the correction data acquisition operation, one current comparison/decision circuit section 150B is provided to each voltage supply line Lv connected in common to each group of the display pixels PIX arranged in the display area 110 (upper area or lower area in FIG. 9). The value of a current (detection current Idet) flowing into the voltage supply line Lv when the adjustment voltage Vadj is applied to a display pixel PIX is compared with the value of a reference current Iref generated by a constant current source 157. In this manner, offset setting values Minc corresponding to changes amounts of threshold voltages of the transistors Tr13 (driving transistor) provided in the display pixels PIX (the pixel drive circuits DC) are sequentially acquired as correction data (plotting sequential operation), and then the correction data can be stored for each display pixel PIX in the frame memory 145.

(Display Driving Operation)

A description will now be given of a display driving operation in the display device according to the present embodiment.

The timing chart and flow chart in the display driving operation are identical to those of the first embodiment described above. A description thereof will be briefly given with reference to FIGS. 15 and 16.

The display driving operation of the display device 100 according to the present embodiment includes at least a writing operation (writing operation period Twrt), a holding operation (holding operation period Thld), and a light emitting operation (light emitting operation period Tem) in a predetermined display driving period (single-processing cycle period) Tcyc as in the first embodiment described above (refer to FIG. 15) (Tcyc≧Twrt+Thld+Tem).

Figure 24:
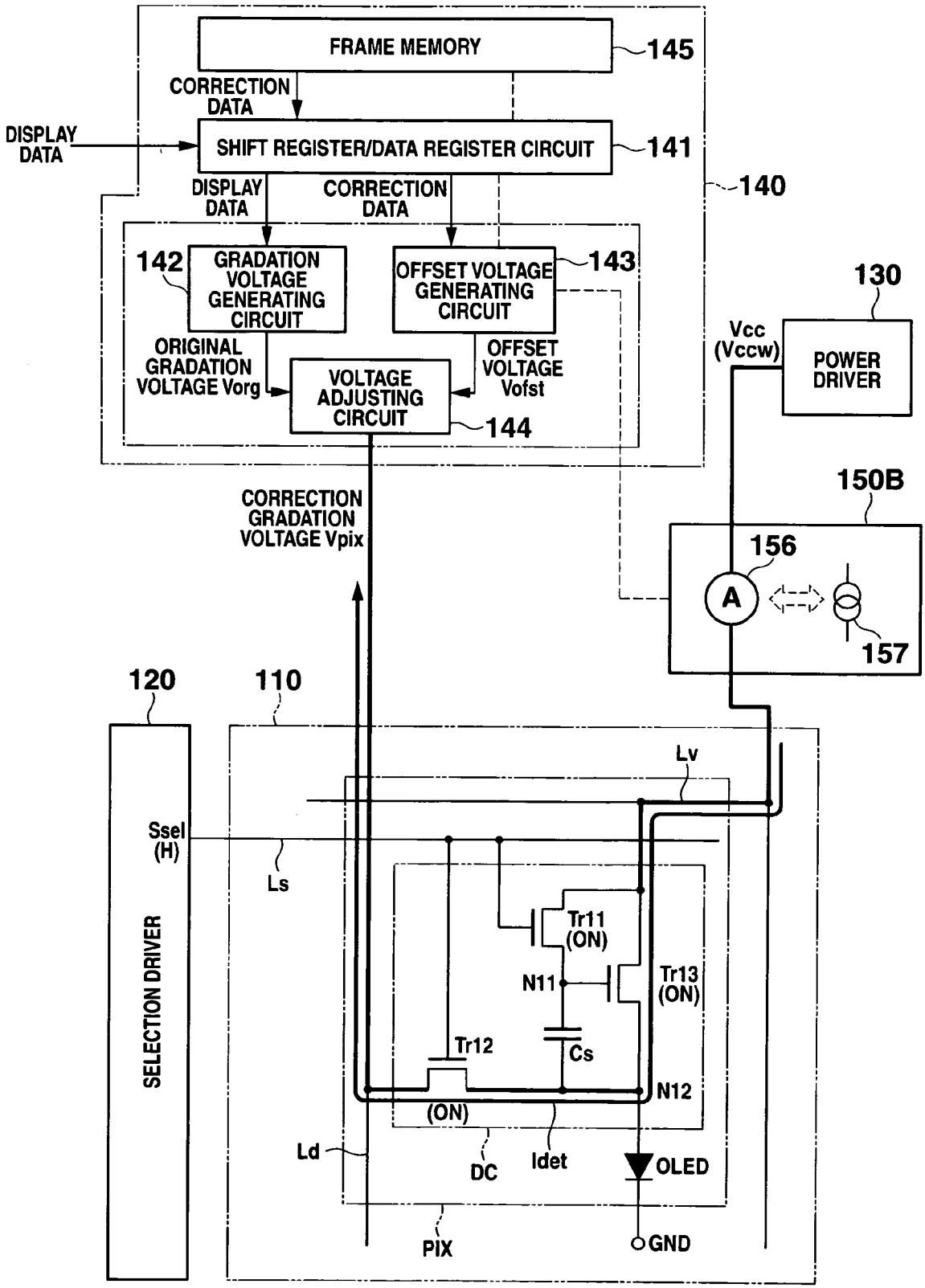
FIG. 24 is a conceptual view showing a writing operation in the display device according to the second embodiment.

In the writing operation (writing operation period Twrt) according to the present embodiment, as shown in FIGS. 15 and 24, first, in a state in which a power voltage (first power voltage) Vcc (=Vccw≦reference voltage Vss) having a low potential that is at a writing operation level is applied to voltage supply line Lv connected to display pixels PIX of the i-th row, a selection signal Ssel having a selection level (high level) is applied to the selection scan line Ls of the i-th row, so as to set display pixels PIX of the i-th row to a selected state. In this manner, the transistor Tr13 (driving transistor) is set to a diode-connected state and the power voltage Vcc is applied to a drain terminal and a gate terminal of the transistor Tr13. In addition, the source terminal is connected to the data line Ld.

In synchronism with this timing, correction gradation voltage Vpix corresponding to display data is applied to the data line Ld based on a series of processing operations (gradation voltage correction operation) as shown in FIG. 16.

In other words, display data by display pixels PIX picked up via the shift register/data register circuit 141 from the display signal generating circuit 170 is transferred to the gradation voltage generating circuits 142 corresponding respectively to the columns, and then, in each of the gradation voltage generating circuits 142, an original gradation voltage Vorg having a voltage value corresponding to a luminance gradation value included in the display data is generated and outputted to the corresponding voltage adjusting circuit 144.

At a timing before or after the operation of picking up of the display data, correction data acquired by the correction data acquisition operation described above and stored in respective correspondence with the display pixels PIX in the frame memory 145 is transferred to the offset voltage generating circuits 143 corresponding respectively to the columns via the shift register/data register circuit 141. In each of the offset voltage generating circuits 143, an offset voltage Vofst is generated by multiplying the predetermined unit voltage Vunit by the correction data (offset setting value Minc), and the generated offset voltage Vofst is outputted to the corresponding voltage adjusting circuit 144.

Then, in each of the voltage adjusting circuits 144, the original gradation voltage Vorg and the offset voltage Vofst are added to each other, so as to generate correction gradation voltage Vpix having a negative potential, which is applied to the corresponding data line Ld.

When the luminance gradation value included in the display data is "0", a predetermined gradation voltage (black gradation voltage) Vzero for carrying out a no-light emitting operation (or black display operation) is outputted by the gradation voltage generating circuit 142, and is applied to data line Ld as it is without adding offset voltage Vofst in the voltage adjusting circuit 144.

In this manner, as shown in FIG. 24, a respective correction gradation voltage Vpix, which has been corrected in response to a threshold voltage (Vth0+ΔVth) after fluctuation, is applied to a source terminal (the contact point N12) of the transistor Tr13 of display pixels PIX (the pixel drive circuit DC) set to a selected state. Thus, in such a writing operation in which voltage Vgs (=Vccw−Vpix) corresponding to the correction gradation voltage Vpix is written and set between the gate and source terminals (across the capacitor Cs) of the transistor Tr13, a desired voltage is directly applied to a gate terminal and a source terminal of the transistor Tr13, so that potentials of terminals and contact points can be quickly set at a desired state.

Figure 25:
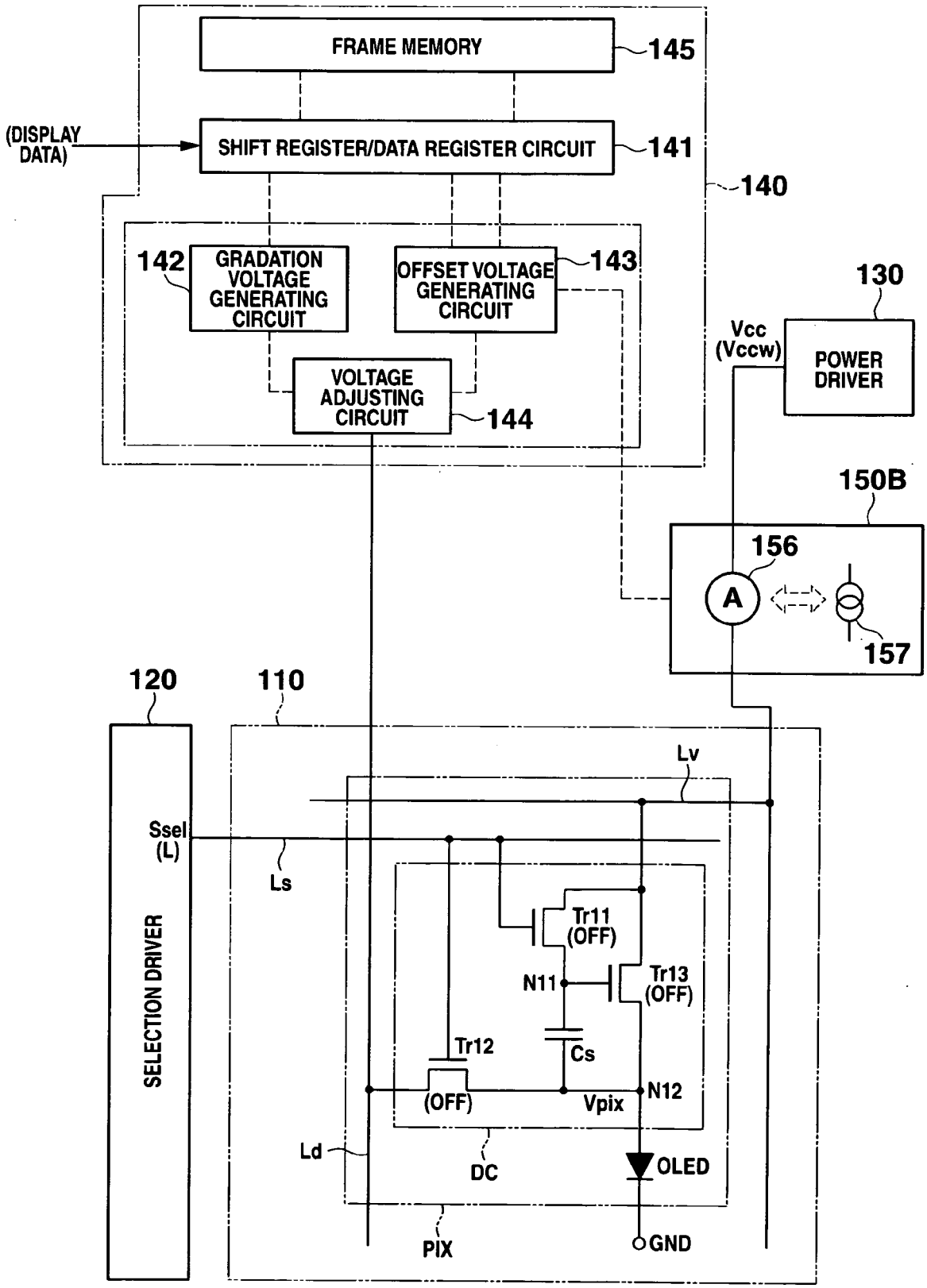
FIG. 25 is a conceptual view showing a holding operation in the display device according to the second embodiment.

In a holding operation (holding operation period Thld), as shown in FIGS. 15 and 25, a selection signal Ssel having a non-selection level (low level) is applied to the selection scan line Ls of the i-th row, thereby setting the display pixels PIX of the i-th row to an unselected state to release the diode-connected state of the transistor Tr13 in each of the display pixels PIX. In addition, connection between a source terminal (the contact point N12) of the transistor Tr13 and data line Ld is shut down, and the voltage component applied between the gate and source terminals of the transistor Tr13 (across the capacitor Cs) in the writing operation is charged to and held in the capacitor Cs.

In the writing operation period Twrt and in the holding operation period Thld, the voltage value of the correction gradation voltage Vpix applied to the contact point N12 at the anode terminal side of the organic EL element OLED is set so as to be lower than reference voltage Vss applied to the cathode terminal TMc. Thus, no current flows to the organic EL element OLED and no light emitting operation occurs.

Figure 26:
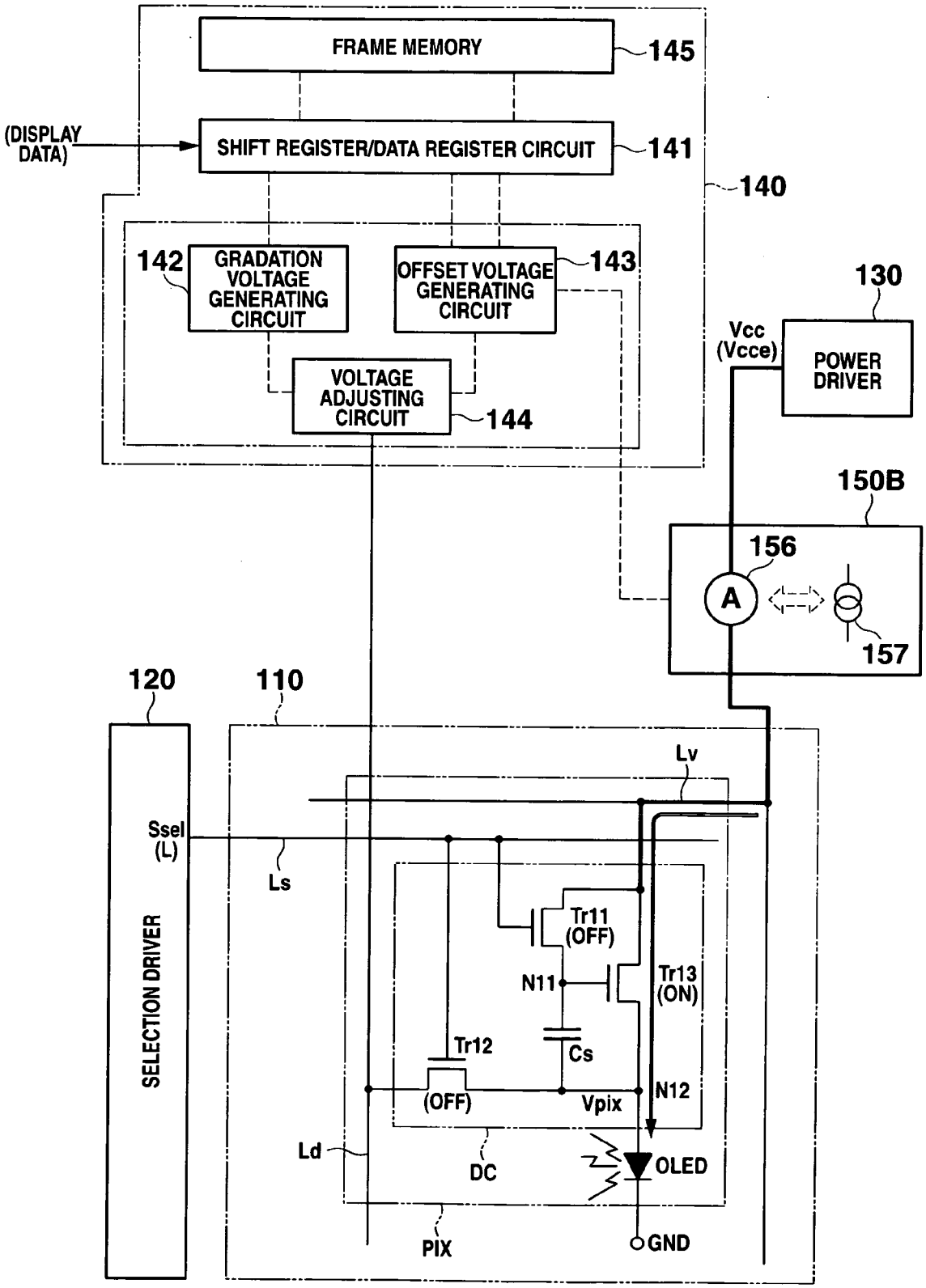
FIG. 26 is a conceptual view showing a light emitting operation in the display device according to the second embodiment.

Next, in a light emitting operation (light emitting operation period Tem), as shown in FIGS. 15 and 26, in a state in which a selection signal Ssel having a non-selection level (low level) is applied to the selection scan lines Ls of the rows of one of the groups of pixels (e.g., upper area or lower area in FIG. 9) to set the display pixels PIX of the rows to the unselected state, a power voltage (second power voltage) Vcc (=Vcce>reference voltage Vss) having a high potential that is at a light emitting operation level is applied to the voltage supply line Lv connected in common to the display pixels PIX of the rows (e.g., to the voltage supply line Lv1 or Lv2 in FIG. 9), whereby the transistors Tr13 in the display pixels PIX in the group of display pixels operate in a saturated area.

At this time, in each of the display pixels PIX in the group, a positive voltage corresponding to a voltage component written and set between the gate and source terminals of the transistor Tr13 is applied by means of the above writing operation to an anode side (the contact point N12) of the organic EL element OLED. On the other hand, reference voltage Vss (grounding potential, for example) is applied to the cathode terminal TMc. In this manner, the organic EL element OLED is set to a forward bias state, and a light emitting driving current Iem having a current value corresponding to the correction gradation voltage Vpix flows from the voltage supply line Lv to the organic EL element OLED via the transistor Tr13, and then a light emitting operation occurs at a predetermined luminance gradation.

Therefore, according to the display driving operations, as in the first embodiment described above, in a state in which the power voltage Vcc (=Vccw) having the writing operation level is applied to the display pixels PIX of the rows arranged in the display area 110, the correction gradation voltage Vpix is written in the display pixels PIX row by row, and operations of holding a predetermined voltage component (|Vpix−Vccw|) are sequentially carried out row by row, and then the power voltage Vcc (=Vcce) having the light emitting operation level is applied to the display pixels PIX of a row at which the writing operation and the holding operation terminate, whereby display pixels PIX of the row can emit light.

<Specific Example of Driving Method>

A specific description will be given of a driving method specific to the display device 100 including the display area 110 shown in FIG. 9.

In the display device (FIG. 9) according to the embodiments described above, display pixels PIX arranged in the display area 110 are grouped into two groups, namely, an upper area and a lower area of the display area 110, so as to apply the power voltage Vcc independently for the two groups via individual power supply lines Lv (first voltage supply line Lv1 or second voltage supply line Lv2) branched by groups. Thus, in the light emitting operation described above, as shown in FIG. 15, display pixels PIX of a plurality of rows included in groups can caused to emit light. A specific drive control operation in this case will be described below.

Figure 27:
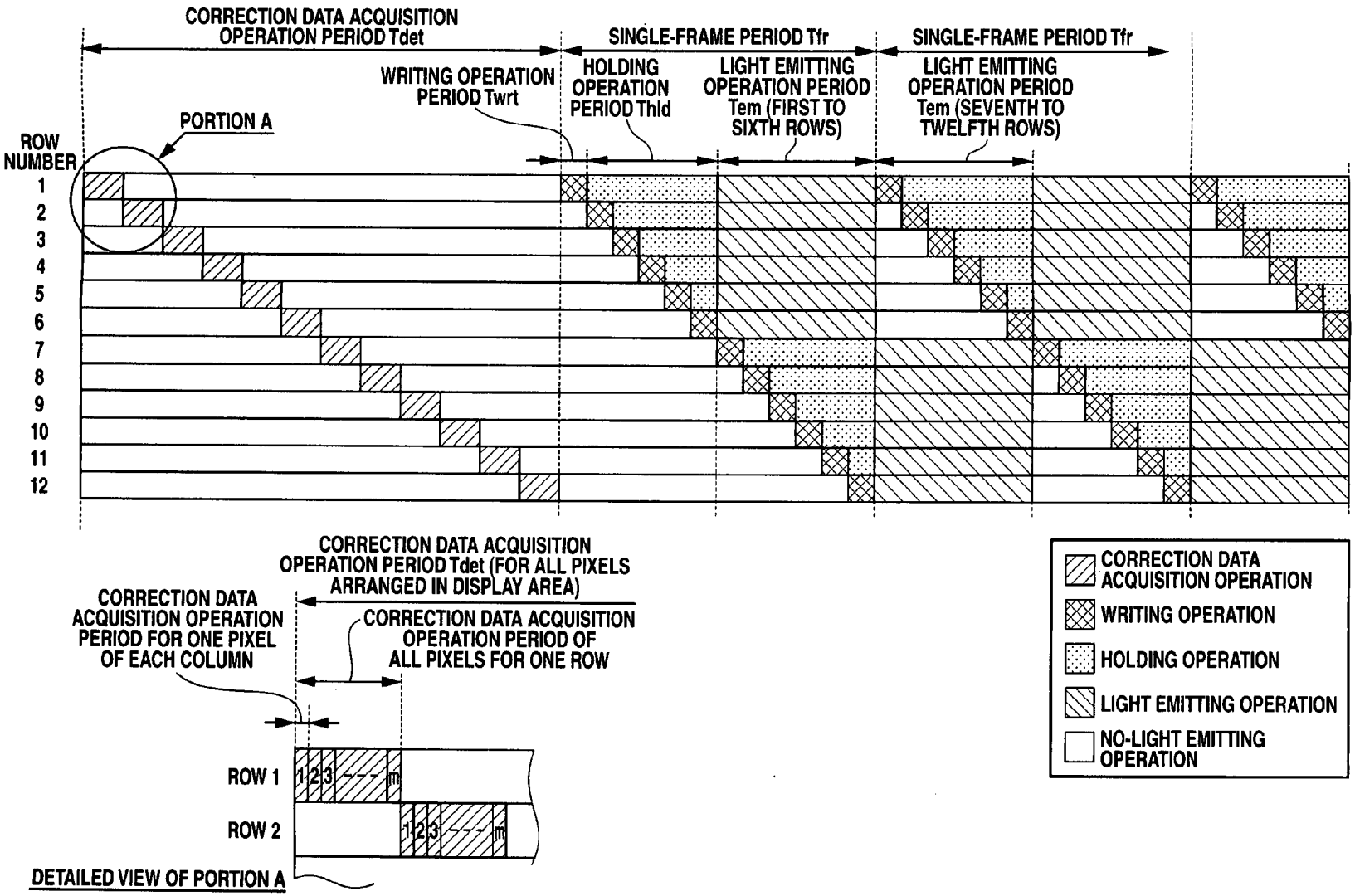
FIG. 27 is an operating timing chart schematically depicting a specific example of a driving method in a display device according to any of the embodiments.

FIG. 27 is an operational timing chart schematically depicting a specific example of a driving method in the display device including the display area, according to the embodiments described above. In FIG. 27, for the sake of clarity, an operating timing chart is shown in which the display pixels are arranged in 12 rows (n=12; first row to twelfth row) in a display area, and in which the display pixels are divided into two groups, namely a group of rows 1 to 6 (corresponding to the upper area described above) and a group of rows 7 to 12 (corresponding to the lower area described above).

In the drive control operation in the display device 100 having the display area 110 shown in FIG. 9, the correction data acquisition operations are sequentially executed with a predetermined timing on a pixel-by-pixel basis for all of the display pixels PIX arranged in the display area 110, as shown in FIG. 27, for example. After the end of the correction data acquisition operations for all of the display pixels PIX (in other words, after the completion of the correction data acquisition operation period Tdet), the operation of writing respective correction gradation voltages Vpix obtained by adding an offset voltage Vofst corresponding to fluctuation of element characteristics of a driving transistor (the transistor Tr13) of a display pixel PIX to an original gradation voltage Vorg corresponding to display data for the display pixel into the display pixels PIX (the pixel drive circuit DC) row by row for all of the rows of the display area 110 in single frame period Tfr. An operation of holding a predetermined voltage component (|Vpix−Vccw|) is performed after the writing operation in each row. At the same time, a display driving operation (display driving period Tcyc shown in FIG. 15) of simultaneously causing each of the display pixels PIX included in one of the groups to emit light at a luminance gradation corresponding to display data (correction gradation voltage Vpix) with a timing with which the above writing operation terminates relative to display pixels (the organic EL element OLED) of rows 1 to 6 and rows 7 to 12 that are divided in advance into two groups, whereby image information for one screen of the display area 110 is displayed.

More specifically, with respect to the display pixels PIX arranged in the display area 110, in the groups of display pixels of rows 1 to 6 and rows 7 to 12, in a state in which the power voltage Vcc (=Vccw) having a low potential is applied via the voltage supply lines Lv (first voltage supply line Lv1 and second voltage supply line Lv2) connected in common to display pixels PIX by groups, the correction data acquisition operations are sequentially executed pixel-by-pixel for each row, row-by-row for each of the display pixels PIX starting with the first row (correction data acquisition operation period Tdet). Then, for each of the display pixels PIX arranged in the display area 110, the correction data (offset setting value Minc) corresponding to fluctuation of a threshold voltage of the transistor Tr13 (driving transistor) provided in the pixel drive circuit DC is stored individually in a predetermined area of the frame memory 145.

After the completion of the correction data acquisition operation period Tdet, in the group of display pixels PIX of rows 1 to 6, in a state in which the power voltage Vcc (=Vccw) having a low potential is applied via the voltage supply line Lv (first voltage supply line Lv1) connected in common to the display pixels PIX of the group, the writing operation (writing operation period Twrt) and holding operation (holding operation period Thld) are executed sequentially in each row, row-by-row starting with the first row. Then, at a timing at which the writing operation terminates for the display pixels PIX of the sixth row (last row in the group), the power voltage Vcc is switched to the power voltage Vcc (=Vcce) having a high potential to be applied via the voltage supply line Lv (first voltage supply line Lv1) of the group In this manner, the display pixels PIX in the six rows of the group are caused to emit light simultaneously at a luminance gradation based on display data (correction gradation voltage Vpix) written into the respective display pixels PIX. This light emitting operation is continued until a timing at which a next writing operation is started for the display pixels PIX of a first row (light emitting operation period Tem of rows 1 to 6).

In addition, at the timing at which the writing operation terminates with respect to the sixth (last) row of the first group of display pixels PIX (of the first to sixth rows), in the second group of display pixels PIX of the seventh to twelfth rows, the power voltage Vcc (=Vccw) of low potential is applied via the voltage supply line Lv (second voltage supply line Lv2) connected in common to the display pixels PIX of the group. The writing operation (writing operation period Twrt) and holding operation (holding operation period Thld) are executed sequentially for each of the rows of the second group, starting from the seventh row. Then, at a timing at which the writing operation terminates for the display pixels PIX of the twelfth row (last row in the group), the power voltage Vcc is switched to the power voltage Vcc (=Vcce) having a high potential to be applied via the voltage supply line Lv (second voltage supply line Lv2). In this manner, the display pixels PIX of the six rows of the second group are caused to emit light simultaneously at a luminance gradation based on display data (correction gradation voltage Vpix) written into the respectively display pixels PIX (light emitting operation period Tem of rows 7 to 12). In the period in which the writing operation and the holding operation are executed for the display pixels of rows 7 to 12, as described above, the power voltage Vcc (−Vcce) of high potential is applied via the voltage supply line Lv (voltage supply line Lv1) to the display pixels PIX of rows 1 to 6.

As described above, after a correction data acquisition operation has been executed by means of a plotting sequential operation with respect to all of the display pixels PIX arranged in the display area 110, a writing operation and a holding operation are sequentially executed with a predetermined timing row by row. Once the writing operation has terminated for the last row of a group (the groups being set in advance), all of the display pixels PIX of the group are driven and controlled so as to emit light simultaneously at a time point.

Therefore, according to the driving method (display driving operation) of such a display device, among a single-frame period Tfr, during a period in which a writing operation is executed for the display pixels of the rows of a given group, a light emitting operation of all of the display pixels (light emitting elements) in the given group is not carried out; that is, and then a no-light emitting state (black display state) is set for the pixels in the group.

For example, in the operational timing chart shown in FIG. 27, the display pixels PIX of the twelve rows configuring the display area 110 are divided into two groups, and control is effected so as to execute a light emitting operation of each group at a different timing, while during the light emitting operation of a group, all of the pixels in the group are caused to emit light simultaneously, whereby a rate (black insert rate) of a black display period exerted by the no-light emitting operation in the single-frame period Tfr can be set to 50%. In a human visual sense, in order to visually recognize a moving image clearly without out-of-focus or blurring, in general, it is a standard to have a black insert rate of approximately 30% or more. Thus, according to this drive control method, a display device having a comparatively reasonable display image quality can be realized.

In the display device 100 shown in FIG. 9, the plurality of display pixels PIX arranged in the display area 110 are divided into two groups each made up of a continuous group of rows, the present invention is not limited thereto. Rather, the display pixels of a display device in accordance with the invention may be divided into an arbitrary number of groups such as three or four groups. In addition, these display pixels may be divided into groups of discrete lines such as even-numbered rows or odd-numbered rows. According to the present invention, a rate of a light emitting time and a black display period (black display state), i.e., a rate of a black display period (black insert rate) caused by a no-light display period in single frame period Tfr, can be arbitrarily set in accordance with the number of groups, thereby enabling improved display image quality.

In addition, the voltage supply lines may arranged (connected) individually by rows without grouping a plurality of display pixels PIX arranged in the display area 110 as described above. With this structure, the power voltage Vcc may be independently applied to the voltage supply lines with respectively different timings, whereby the display pixels PIX may caused to emit light on a row-by-row basis. Alternatively, common power voltage Vcc may be applied simultaneously to all of the display pixels PIX for one screen (all of the pixels in the display area 110), whereby all of the display pixels for one screen in the display area 110 may caused to emit light simultaneously.

As has been described above, in the display device and the drive control method thereof according to the present invention, a voltage-specified (or voltage-applied) gradation control method can be applied such that correction gradation voltage Vpix having a specified voltage value corresponding to display data and fluctuation of element characteristics (threshold voltage) of a driving transistor is directly applied between gate and source terminals of the driving transistor (the transistor Tr13) during a display data writing operation, thereby holding a predetermined voltage component by a capacitor (the capacitor Cs), and controlling a light emitting driving current Iem flowing into a light emitting element (organic EL element OLED) based on the voltage component, and causing a light emitting operation at a desired luminance gradation.

Therefore, in comparison with a current-specified gradation control method for supplying a current corresponding to display data to carry out a writing operation (holding a voltage component corresponding to display data), even when a display panel has a large size or is high-definition, or alternatively, when a low gradation display is made, a gradation signal (correction gradation voltage) corresponding to display data can be reliably and quickly written into display pixels. Thus, the occurrence of insufficient writing of display data is restrained, while a light emitting element (organic EL element) can be caused to emit light at a proper luminance gradation corresponding to display data, and reasonable display image quality can be achieved.

In addition, prior to an operation of writing display data into display pixels (pixel drive circuit) (or at an arbitrary timing prior to a writing operation), correction data corresponding to fluctuation of a threshold voltage of a driving transistor in display pixels is acquired. During a writing operation, a corrected gradation signal (correction gradation voltage) for each of the display pixels can be generated and applied based on the correction data. Thus, the influence of fluctuation of the threshold voltage (shift of voltage-current characteristics of the driving transistor) is compensated for, while display pixels (light emitting elements) can be caused to emit light at a proper luminance gradation corresponding to display data. In addition, while dispersions of light emitting characteristics by display pixels are restrained, display image quality can be improved.

Further, a potential difference between a data line and a voltage supply line or a value of a current flowing into a voltage supply line is measured by a comparison circuit (voltage comparison circuit or current comparison circuit) that is individually or independently provided at each voltage supply line connected in common to a plurality of display pixels arranged in a display area. Correction data corresponding to the fluctuation of threshold voltages of driving transistors provided in display pixels can be acquired by performing a comparison with a predetermined reference value (reference voltage or reference current). Thus, a display device can be realized as having reasonable display image quality while circuit magnitude or part cost with respect to compensation for the fluctuation of element characteristics of a driving transistor is restrained.

As has been described above, when display pixels PIX arranged in the display area 110 have a pixel configuration corresponding to color image display and one display pixel PIX is configured of one group of three-color pixels of red (R), green (G), and blue (B), three voltage supply lines, each connected in common the pixels of one color are provided, and the comparison/decision circuit section 150 according to the present invention may be independently or individually provided for each of the three voltage supply lines (in other words, three circuits may be provided). In this case, the correction data acquisition operations described above may be executed independently for each color of pixel. When these correction data acquisition operations are executed simultaneously in parallel, the time for the correction data acquisition operation period Tdet can be substantially reduced, e.g., to ⅓, in comparison with embodiments described above.

In addition, although in the embodiments described above the correction data acquisition operation is executed with respect to all of the display pixels arranged in the display area prior to starting the display data writing operation, the present invention is not limited thereto. Rather, for example, the correction data acquisition operation may be executed during a system activation immediately after turning on power supply to a display device or during a system deactivation immediately before power shutdown, or alternatively, may be executed at an arbitrary timing. Further, the correction data acquisition operation may be executed a plurality of times (at different timings relative to display pixels belonging to the upper area and those belonging to the lower area described above) without being limited to the execution of the above acquisition operation with respect to all display pixels at one time.

What is claimed is:

1. A method for driving a display device for displaying image information corresponding to display data, wherein the display device includes a display panel comprising: (i) a plurality of selection scan lines arranged in rows and a plurality of data lines arranged in columns; (ii) a plurality of display pixels arranged in a matrix shape, each of the display pixels being arranged in a vicinity of a point at which one of the plurality of selection scan lines crosses one of the plurality of data lines, and each of the display pixels including a light emitting element and a driving element that supplies a current flowing into a current path thereof to the light emitting element; and (iii) a voltage supply line connected in common to the respective current paths of the driving elements of a predetermined number of the display pixels of the plurality of display pixels, the method comprising:

supplying a predetermined voltage to the voltage supply line;

applying a selection signal to one of the selection scan lines that correspond to rows of the display pixels that are connected to the voltage supply line, so as to set the row of the display pixels corresponding to said one of the selection scan lines to a selected state;

performing a process when the row is selected by the selection signal to detect a specific value corresponding to element characteristics of the driving element of at least one of the display pixels in the row, the process, the process comprising:

generating an adjustment voltage based on a predetermined voltage;

applying the generated voltage to the display pixel via one of the plurality of data lines connected thereto; and detecting the specific value for the display pixel, based on a detection value which is one of a value of a potential difference between the data line and the voltage supply line and a value of a current flowing in the current path of the driving element of the display pixel via the voltage supply line;

generating a gradation voltage having a voltage value for causing the light emitting element of the display pixel to emit light at a luminance gradation corresponding to display data;

generating a correction gradation voltage by correcting the gradation voltage based on the specific value detected for the display pixel; and supplying the generated correction gradation voltage to the data line connected to the display pixel.

2. The method according to claim 1, wherein the process to detect the specific value is performed for each of the display pixels at an arbitrary timing prior to the supplying of the correction gradation voltage to the display pixels.

3. The method according to claim 1, wherein the process to detect the specific value is performed sequentially for each of the display pixels in the row selected by the selection signal.

4. The method according to claim 3, wherein the selection signal is applied to each of the selection scan lines sequentially so as to set the rows of the display pixels to the selected state sequentially; and wherein for each row that is set to the selected state, the process to detect the specific value is performed sequentially for each of the display pixels in the row that is set to the selected state.

5. The method according to claim 1, further comprising storing the detected specific value as correction data in a storage circuit, wherein the process to detect the specific value further comprises:

reading out the correction data from the storage circuit;

multiplying the unit voltage and an offset setting value corresponding to the read out correction data to generate an offset voltage;

setting a value of the adjustment voltage to a value obtained by adding a value of the offset voltage to an initial value of the adjustment voltage to apply the adjustment voltage having the set value to the display pixel;

detecting as the detection value one of the value of the potential difference between the data line and the voltage supply line and the value of the current flowing into the current path via the voltage supply line;

comparing the detection value with a reference value;

when it is determined that the detection value is smaller than the reference value:

incrementing the value of the offset setting value;

updating the value of the offset voltage to a value obtained by multiplying the incremented offset setting value and the unit voltage;

updating the value of the adjustment voltage to a value obtained by adding the updated offset voltage to the initial value of the adjustment voltage to apply the adjustment voltage having the updated value to the display pixel;

detecting as the detection value one of the value of the potential difference between the data line and the voltage supply line and the value of the current flowing into the current path via the voltage supply line; and comparing the detection value with the reference value; and when it is determined that the detection value is equal to or greater than the reference value, extracting a value of the offset setting value as the specific value without changing the value of the offset setting value.

6. The method according to claim 5, wherein:

the initial value of the adjustment voltage is a voltage value of a gradation voltage for causing the light emitting element to emit light at a specific first gradation;

the unit voltage corresponds to a potential difference between the gradation voltage corresponding to the first gradation and a gradation voltage corresponding to a second gradation that is lower than the first gradation by one gradation; and the reference value is based on a value of the current flowing into the current path of the driving element when a gradation voltage of the second gradation is applied to the display pixel in a state in which the driving element maintains initial characteristics thereof.

7. A display drive device for driving a plurality of display pixels, each of which includes a light emitting element and a driving element that supplies a current flowing into a current path thereof to the light emitting element, the display drive device comprising:

a specific value detecting section which, in a state in which a predetermined voltage is supplied to a voltage supply line connected in common to the respective current paths of the driving elements of a plurality of the display pixels connected to the voltage supply line, detects for at least one of the plurality of display pixels connected to the voltage supply line a specific value corresponding to element characteristics of the driving element of the display pixel by: (i) generating an adjustment voltage based on a predetermined unit voltage and applying the generated adjustment voltage to the display pixel via a data line connected to the display pixel, (ii) detecting, as a detection value, one of a value of a potential difference between the data line and the voltage supply line, and a value of a current flowing in the current path of the driving element of the display pixel via the voltage supply line, and (iii) detecting the specific value of the display pixel based the detection value; and a voltage adjusting circuit which generates a correction gradation voltage by correcting, based on the specific value detected for the display pixel, a gradation voltage for the display pixel which has a voltage value for causing the light emitting element of the display pixel to emit light at a luminance gradation corresponding to display data, and supplies the generated correction gradation voltage to the display pixel via the data line connected to the display pixel.

8. The display drive device according to claim 7, wherein the voltage adjusting circuit is supplied with the gradation voltage and a compensation voltage that is set based on the detected specific value and the unit voltage, and the voltage adjusting circuit generates the correction gradation voltage by correcting the gradation voltage based on the compensation voltage.

9. The display drive device according to claim 7, further comprising a storage circuit which stores the specific value for the pixel as correction data.

10. The display drive device according to claim 9, further comprising:

a gradation voltage generating circuit which generates the gradation voltage supplied to the voltage adjusting circuit; and a compensation voltage generating circuit which generates a voltage component obtained by multiplying the unit voltage and the correction data from the storage circuit as a compensation voltage, wherein the voltage adjusting circuit adds the compensation voltage to the gradation voltage to obtain the correction gradation voltage.

11. The display drive device according to claim 9, wherein the specific value detecting section comprises:

a comparison/decision circuit section which is coupled to the voltage supply line, and which detects, as the detection value, said one of the value of the potential difference between the data line and the voltage supply line and the value of the current flowing in the current path via the voltage supply line, and compares the detection value with a reference value;

an offset voltage generating circuit which reads out the correction data from the storage circuit to set an offset voltage having a value obtained by multiplying the unit voltage and an offset setting value corresponding to the read out correction data, updates a value of the offset setting value to a changed value, and updates the value of the offset voltage to a value obtained by multiplying the unit voltage and the changed offset setting value;

an adjustment voltage setting circuit which sets a value of the adjustment voltage to a value obtained by adding the value of the offset voltage to an initial value of the adjustment voltage; and a specific value extraction circuit which extracts a value of the offset setting value as the specific value based on an output of the comparison/decision circuit section.

12. The display drive device according to claim 11, wherein the comparison/decision circuit section comprises:

a voltmeter which measures the potential difference between the data line and the voltage supply line;

a current source which supplies a predetermined reference current to the voltage supply line;

a changeover circuit which switches which one of the current source and a voltage source of the predetermined voltage is connected to the voltage supply line; and a voltage comparison circuit which determines a voltage value measured by the voltmeter as the reference value when the current source is connected to the voltage supply line and the reference current is supplied, which determines as the detection value a voltage value measured by the voltmeter when the adjustment voltage is applied, and which compares the detection value with the reference value.

13. The display drive device according to claim 11, wherein the comparison/decision circuit section comprises:

an ammeter which measures the value of the current flowing from a voltage source of the predetermined voltage into the voltage supply line; and a current comparison circuit which determines as the detection value the current value measured by the ammeter when the adjustment voltage is applied, which determines a predetermined value of a reference current as the reference value, and which compares the detection value with the reference value.

14. The display drive device according to claim 11, wherein the specific value extraction circuit extracts as the specific value a value of the offset setting value when the comparison/decision circuit section determines that the detection value is equal to or greater than the reference value.

15. The display drive device according to claim 11, wherein the offset voltage generating circuit increments the value of the offset setting value when the comparison/decision circuit section determines that the detection value is smaller than the reference value.

16. The display drive device according to claim 11, wherein:

the initial value of the adjustment voltage is a voltage value of a gradation voltage for causing the light emitting element to emit light at a specific first gradation;

the unit voltage corresponds to a potential difference between the gradation voltage corresponding to the first gradation and a gradation voltage corresponding to a second gradation which is lower than the first gradation by one gradation; and the reference value is based on a value of the current flowing into the current path of the driving element when the gradation voltage corresponding the second gradation is applied to the display pixel in a state in which the driving element maintains initial characteristics thereof.

17. A display device for displaying image information corresponding to display data, comprising:

a display panel including: (i) a plurality of selection scan lines arranged in rows and a plurality of data lines arranged in columns; (ii) a plurality of display pixels arranged in a matrix shape, each of the display pixels being arranged in a vicinity of a point at which one of the plurality of selection scan lines crosses one of the plurality of data lines, and each of the display pixels including a light emitting element and a driving element that supplies a current flowing into a current path thereof to the light emitting element; and (iii) a voltage supply line connected in common to the respective current paths of the driving elements of a predetermined number of the plurality of display pixels;

a voltage source which supplies a predetermined voltage to the voltage supply line;

a selection drive circuit which applies a selection signal to the selection scan lines that correspond to rows of the display pixels that are connected to the voltage supply line, so as to set the rows of the display pixels to a selected state;

a specific value detecting section which, for any row that is selected by the selection signal when the predetermined voltage is applied from the voltage source to the voltage supply line, detects for at least one of the plurality of display pixels in the row a specific value corresponding to element characteristics of the driving element of the display pixel by: (i) generating an adjustment voltage based on a predetermined unit voltage and applying the generated adjustment voltage to the display pixel via one of the plurality of data lines connected thereto; (ii) detecting, as a detection value, one of a value of a potential difference between the data line and the voltage supply line, and a value of a current flowing into the current path of the driving element of the display pixel via the voltage supply line; and (iii) detecting the specific value for the display pixel based on the detection value; and a voltage adjusting circuit which generates a correction gradation voltage by correcting, based on the specific value detected for the display pixel, a gradation voltage for the display pixel which has a voltage value for causing the light emitting element of the display pixel to emit light at a luminance gradation corresponding to display data, and supplies the generated correction gradation voltage to the display pixel via the data line connected to the display pixel.

18. The display device according to claim 17, wherein the voltage source applies to the voltage supply line, a first power voltage having a potential at which the light emitting elements of the display pixels connected to the voltage supply line are established in a no-light emitting state during a period in which the respective specific values for the display pixels connected to the voltage supply line are detected by the specific value detecting section and during a period in which the correction gradation voltage is supplied from the voltage adjusting circuit to the display pixels connected to the voltage supply line, and the voltage source applies to the voltage supply line a second power voltage having a potential at which the light emitting elements of the display pixels connected to the voltage supply line are established in a light emitting state during a period in which each of the light emitting elements of the display pixels connected to the voltage supply line is caused to emit light at a luminance gradation corresponding to the correction gradation voltage.

19. The display device according to claim 17, further comprising a storage circuit which stores the specific value for the pixel as correction data.

20. The display device according to claim 19, further comprising:

a gradation voltage generating circuit which generates the gradation voltage supplied to the voltage adjusting circuit; and a compensation voltage generating circuit which generates a voltage component obtained by multiplying the correction data from the storage circuit and the unit voltage as a compensation voltage, wherein the voltage adjusting circuit adds the compensation voltage to the gradation voltage to obtain the correction gradation voltage.

21. The display device according to claim 19, wherein the specific value detecting section comprises:

a comparison/decision circuit section which is coupled to the voltage supply line, and which detects, as the detection value, said one of the value of the potential difference between the data line and the voltage supply line and the value of the current flowing into the current path via the voltage supply line, and then compares the detection value with a reference value;

an offset voltage generating circuit which reads out the correction data from the storage circuit to set an offset voltage having a value obtained by multiplying the unit voltage and an offset setting value corresponding to the read out correction data, updates a value of the offset setting value to a changed value, and updates the value of the offset voltage to a value obtained by multiplying the changed offset setting value and the unit voltage;

an adjustment voltage setting circuit which sets a value of the adjustment voltage to a value obtained by adding the value of the offset voltage to an initial value of the adjustment voltage; and a specific value extraction circuit which extracts the value of the offset setting value as the specific value based on an output of the comparison/decision circuit section.

22. The display device according to claim 21, wherein:

the plurality of display pixels are divided into a plurality of groups, each comprising at least two of the rows of display pixels;

one said voltage supply line is provided for each of said plurality of groups; and one said comparison/decision circuit section is provided for each of said voltage supply lines.

23. The display device according to claim 21, wherein:

said plurality of display pixels include pixels of a plurality of colors;

said plurality of display pixels are divided into a plurality of groups, each group consisting of pixels of the same color;

one said voltage supply line is provided for each of said plurality of groups; and one said comparison/decision circuit section is provided for each of said plurality of voltage supply lines.

24. Method for driving a display drive device for driving a plurality of display pixels, each of which includes a light emitting element and a driving element that supplies a current flowing to a current path thereof to the light emitting element, the method comprising:

supplying a predetermined voltage to a voltage supply line connected in common to the respective current paths of the driving elements of a plurality of the display pixels;

performing a process to detect a specific value corresponding to element characteristics of the driving element of at least one of the display pixels connected to the voltage supply line, the process comprising:

generating an adjustment voltage based on a predetermined unit voltage;

applying the generated voltage to the display pixel via a data line connected to the display pixel; and detecting the specific value for the display pixel, based on a detection value which is one of a value of a potential difference between the data line and the voltage supply line and a value of a current flowing into the current path of the driving element of the display pixel via the voltage supply line;

generating a gradation voltage having a voltage value for causing the light emitting element of the display pixel to emit light at a luminance gradation corresponding to display data;

generating a correction gradation voltage by correcting the gradation voltage based on the specific value detected for the display pixel; and supplying the generated correction gradation voltage via the data line connected to the display pixel.

25. The method according to claim 24, wherein the process to detect the specific value is performed for each of the display pixels at an arbitrary timing prior to the supplying of the correction gradation voltage to the display pixels.

26. The method according to claim 24, wherein the process to detect the specific value is performed sequentially for each of the display pixels connected to the voltage supply line.

27. The method according to claim 24, further comprising storing the detected specific value as correction data in a storage circuit, wherein process to detect the specific value further comprises:

reading out the correction data from the storage circuit;

multiplying the unit voltage and an offset setting value corresponding to the read out correction data to generate an offset voltage;

setting a value of the adjustment voltage to a value obtained by adding a value of the offset voltage to an initial value of the adjustment voltage to apply the adjustment voltage having the set value to the display pixel;

detecting as the detection value one of the value of the potential difference between the data line and the voltage supply line and the value of the current flowing into the current path via the voltage supply line;

comparing the detection value with a reference value;

when it is determined that the detection value is smaller than the reference value:

incrementing the value of the offset setting value;

updating the value of the offset voltage to a value obtained by multiplying the incremented offset setting value and the unit voltage;

updating the value of the adjustment voltage to a value obtained by adding the updated offset voltage to the initial value of the adjustment voltage to apply the adjustment voltage having the updated value the display pixel;

detecting as the detection value one of the value of the potential difference between the data line and the voltage supply line and the value of the current flowing into the current path via the voltage supply line; and comparing the detection value with the reference value; and when it is determined that the detection value is equal to or greater than the reference value, extracting a value of the offset setting value as the specific value without changing the value of the offset setting value.

28. The method according to claim 27, wherein:

the initial value of the adjustment voltage is a voltage value of a gradation voltage for causing the light emitting element to emit light at a specific first gradation;

the unit voltage corresponds to a potential difference between the gradation voltage corresponding to the first gradation and a gradation voltage corresponding to a second gradation that is lower than the first gradation by one gradation; and the reference value is based on a value of the current flowing into the current path of the driving element when the gradation voltage of the second gradation is applied to the display pixel in a state in which the driving element maintains initial characteristics thereof.

* * * * *